US008931127B1

(12) United States Patent
Moses

(10) Patent No.: US 8,931,127 B1
(45) Date of Patent: Jan. 13, 2015

(54) COMPARTMENTED MULTI-TEMPERATURE CUSHIONING DEVICE

(76) Inventor: Paul Moses, Chula Vista, CA (US)

( * ) Notice: Subject to any disclaimer, the term of this patent is extended or adjusted under 35 U.S.C. 154(b) by 1214 days.

(21) Appl. No.: 12/796,667

(22) Filed: Jun. 8, 2010

Related U.S. Application Data

(60) Provisional application No. 61/185,178, filed on Jun. 8, 2009.

(51) Int. Cl.
*A47C 27/10* (2006.01)

(52) U.S. Cl.
USPC ..... 5/652; 5/646; 5/630; 2/66; 2/65

(58) Field of Classification Search
USPC ..... 5/652, 655, 655.3, 630, 646, 636; 2/65, 2/66
See application file for complete search history.

(56) References Cited

U.S. PATENT DOCUMENTS

| | | | | | |
|---|---|---|---|---|---|
| 95,240 | A | * | 9/1869 | Levy | 2/66 |
| 405,097 | A | | 6/1889 | Kaehler | |
| 482,432 | A | * | 9/1892 | Ashbaugh | 2/66 |
| 2,014,256 | A | | 9/1935 | Kramer | |
| 2,727,241 | A | | 12/1955 | Smith | |
| 3,793,643 | A | | 2/1974 | Kinoshita | |
| 4,408,355 | A | * | 10/1983 | Brock | 2/66 |
| 4,495,569 | A | * | 1/1985 | Kagawa | 710/268 |
| 4,495,659 | A | | 1/1985 | Madnick et al. | |
| 4,862,519 | A | | 9/1989 | Bull | |
| 4,893,357 | A | | 1/1990 | Evans | |
| 5,127,117 | A | | 7/1992 | Bridges | |
| 5,269,023 | A | | 12/1993 | Ross | |
| 5,499,401 | A | | 3/1996 | Heinmiller | |
| 5,584,086 | A | | 12/1996 | VanWinkle et al. | |
| 5,918,332 | A | | 7/1999 | Dees | |
| 5,918,333 | A | | 7/1999 | Takashima | |
| 6,463,608 | B1 | | 10/2002 | Moe | |
| 6,526,612 | B1 | | 3/2003 | Zarrella | |
| 7,089,617 | B1 | * | 8/2006 | Lauro | 5/636 |
| 8,108,946 | B2 | | 2/2012 | Myers | |
| 2008/0022430 | A1 | * | 1/2008 | Myers | 2/66 |
| 2008/0235877 | A1 | * | 10/2008 | Murray et al. | 5/640 |
| 2008/0307581 | A1 | * | 12/2008 | Wassilefky | 5/636 |

* cited by examiner

*Primary Examiner* — Peter M Cuomo
*Assistant Examiner* — Brittany Wilson
(74) *Attorney, Agent, or Firm* — Buche & Associates, P.C.; John K. Buche

(57) ABSTRACT

The present application is directed to a Compartmented Cushioning Device and Method offering one or more cool or warm feeling compartments, formed between or surrounded by one or more components, with each component, including filler material encased in surface material. The presence of one or more compartment openings provide access to the one or more compartments; whereby a user has multiple options when placing all or part of one or more of their fingers, hands, wrists, or arms into either the same or separate compartments to cushion, insulate, or protect them; while in addition, allowing the user to cushion, insulate, or protect, as well as support, adjust, or precisely position their head, face, or other parts of their body. An assortment of configurations, ranging from soft to firm, can be designed in an array of colors, shapes, and sizes, for a wide variety of uses: indoors, outdoors, or in vehicles.

8 Claims, 14 Drawing Sheets

10A

10I

10K

10E

10G

COMPARTMENTED MULTI-TEMPERATURE CUSHIONING DEVICE

CROSS-REFERENCE TO RELATED APPLICATIONS

61/185,178

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This application relates to the field of cushions and pillows, offering a compartmented cushioning device, designed in an array of colors, shapes, and sizes, for a wide variety of uses: indoors, outdoors, or in vehicles.

Various arrangements have been proposed in the past, for providing cushions and pillows, as a means to rest a person's head and other parts of their body. They are available in a wide variety of designs, materials, shapes, and sizes depending upon their intended use. From a conventional rectangular pillow used in bed, primarily for a person's head; to decorative cushions and throw pillows, for use on chairs, sofas, and recliners; to a wide variety of cushions and pillows made for special applications, such as body, bolster, donut, lumbar, neck, orthopedic, sleeve, sofa, and travel.

By definition, a cushion or pillow, is a cloth case stuffed with something soft, such as down, feathers, or foam. Documented history teaches us that pillows have been in existence for thousands of years, and have been found in ancient Egyptian tombs. Originally, pillows were primarily used by the wealthy, with highly decorated pillows becoming prized commodities first in China, Persia, and later in Medieval Europe. The Industrial Revolution saw the mass production of decorated textiles and pillows, making them available to many more people.

Over the centuries, there have been few significant changes to cushions and pillows. Although a number of improvements have been made; through the creation and use of new types of fillers, such as latex and memory foam; or by reshaping them, as in the case of an orthopedic or travel pillow; the basic construction of the cushion and pillow has remained unchanged; a cloth case stuffed with something soft.

And although there have been incredible advances in virtually every field of science and technology, with many innovations and inventions having been produced; up to now, the basic construction of the cushion and pillow has remained the same.

Cushions and pillows are used to cushion and position the head, face, and other parts of the body, with the object of achieving optimum comfort. And although they do cushion and position; due to the complexity and needs of the human body, and in particular the head and face; people often require more precise positioning than is offered by a conventional cushion or pillow alone.

Because an inch, or even a fraction of an inch in the position of a person's head, can make a difference in their ability to breathe, hear, or see comfortably; people frequently make use of their bare fingers, hands, or arms to support, adjust, or finely tune the position of their head or face. Supporting their head in this way, also allows its related muscles to relax. This activity is quite common, often unconscious, and now more prevalent than ever; due to the use of computers, televisions, and video devices. Just observe yourself and those around you, and you'll discover that we often use our fingers, hands, or arms to support and position our head or face, as well as other parts of our body.

While in bed, people of all ages, including babies and children, often place their fingers, hands, or arms under their cheek, chin, or jaw to slightly lift, support, and adjust the position of their head or face; allowing them to breathe and sleep more comfortably. Although this action does have its benefits; doing so with bare hands may promote the transmission of contaminants or germs to their ears, eyes, mouth, or nose, and may not be as comfortable as it could be, if there were a cushioning agent between their fingers, hands, or arms, and their head or face.

People also support and position their head, face, and other parts of their body in cars, buses, trains, and planes; as well as at their desks, on sofas, and in waiting areas; where they have to be seated for long periods of time, and if tired, would like to sleep or rest. Yet, even if they had a cushioning device; if they were to hold it up against a harsh surface; their head and face might be ok, but their hands and arms might be neglected, and subjected to a barrage of hard, rough, hot, cold, or otherwise uncomfortable surfaces. And, if the cushioning device was only being held up by the weight or pressure of the person, or by their external grip; if the person where to move or release it while sleeping, it could fall.

Cushions and pillows have been comforting people for thousands of years. And as useful as they are; a need exists, that up to now, has not been filled. The solution to this need, as being offered here, is the Compartmented Cushioning Device.

BRIEF SUMMARY OF THE INVENTION

The Compartmented Cushioning Device offers one or more compartments, formed between or surrounded by one or more components, with each component, comprised of one or more cushioning layers, and each cushioning layer, including filler material encased in surface material. The presence of one or more compartment openings provide access to the one or more compartments; whereby a user has multiple options when placing all or part of one or more of their fingers, hands, wrists, or arms into either the same or separate compartments to cushion, insulate, or protect them; while in addition, allowing the user to cushion, insulate, or protect, as well as support, adjust, or precisely position their head, face, or other parts of their body.

Another feature of the Compartmented Cushioning Device is that its one or more compartments can be constructed of cool or warm feeling surface materials having different comfort, insulative, or thermal characteristics; thereby granting the user a choice of placing all or part of one or both of their hands or arms, into either a cool or a warm feeling compartment; to keep them as cool as possible, or to maintain or increase their warmth. In configurations that offer one or more of each; the user will be able to choose or switch, between one and the other; depending upon the ambient temperature and their comfort needs.

The basic principles of the Compartmented Cushioning Device can be applied to create a variety of configurations that are designed to address a number of specific needs; such as some that are designed for use in bed; others for use on chairs, recliners, and sofas; and a number of others, that are designed for use indoors, outdoors, or in vehicles; all of which, provide the user with a level of comfort and control not found in traditional cushions and pillows.

DISCUSSION OF PRIOR ART

Numerous innovations have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Compartmented Cushioning Device and the prior art.

U.S. Pat. No. 4,495,659 of Herman Madnick et al. describes a cold-weather muff that includes an elongated generally cylindrically shaped insulative member having open ends, a water resistant and wind-proof lining surrounding the insulative member, and an inner liner disposed within the insulative member having longitudinally opposed left and right hand receiving pockets and a chemical heating element receiving chamber intermediate the left and right hand receiving pockets. Resilient collars are provided on the open ends that are individually cooperative with respective ones of the left and right hand receiving pockets to minimize convective heat loss by preventing wind from passing through the muff. An emblem may be fastened to the outer lining displaying any desired indicia. A flap on the outer lining provides a resealable closure for the chemical heating element receiving chamber. The cold-weather muff is particularly advantageous for spectator sports, and may readily be incorporated in any suitable body garment such as a hooded sweatshirt.

This patent describes a water resistant and wind proof cold weather muff for the specific purpose of warming the hands. It has not been designed to be used as a cushioning device or pillow; granting the user the ability to support, adjust, or precisely position their head, face, or other parts of their body. Nor does it offer optional cool feeling compartments, or air circulation openings, to keep the hands or arms of the user as cool as possible; a hand-sanitizing capability; or the other unique advantages and features of the Compartmented Cushioning Device.

U.S. Pat. No. 4,893,357 of Keith O. Evans tells of a combination reversible hand-warming muff with a belt attached to the same. The muff is composed of a cylindrical tube having inner and outer layers or surfaces and an insulative layer in between the above two. The combination includes a belt attached to the muff by channels formed on the inner and outer surfaces of the muff and the belt is inserted therethrough. The muff is made reversible by turning the same inside out. The inside layer is composed of a different color and/or material than the outer layer.

This patent tells of a combination reversible hand-warming muff with a belt attached to the same. It has not been designed as a cushioning device or pillow that optionally allows a user to place each of their hands or arms into separate compartments, where they are cushioned and insulated one from the other. Nor has it been designed to be used as a conventional cushion or pillow; to comfort and rest a user's head, face, or other parts of their body.

U.S. Pat. No. 5,499,401 of Helen Heinmiller discloses an insulated hand warmer adapted to be attached to the user's waist by a belt apparatus. The insulated hand warmer has a front wall, a top wall, a back wall, a bottom wall and a collapsible wall, and a plurality of adjustment straps. The hand warmer can be compressed against the user's body by the adjustment straps when not in use. The insulated hand warmer also features a central pocket wherein a heat source can be placed. The user's hands are inserted from each end of the insulated hand warmer to come into contact with the heat source. A front pocket for storage of the user's travel articles is also taught herein.

This patent discloses an insulated hand warmer with a central pocket wherein a heat source can be placed; as well as a front pocket, for storage of a user's travel articles. It is designed to insert the hands with the object of warming them, and is not designed to accommodate or warm the arms as well. It does not combine the feature of being used as a cushion or pillow to comfort and rest the head, face, or other parts of a user's body. Nor does it describe the presence of optional cool compartments, or the possibility of sanitizing the user's hands or arms.

U.S. Pat. No. 5,584,086 of Tresa A. VanWinkle et al. discloses a therapeutic pillow. This pillow has a bag-like cover filled with natural granular material having water content in the range of 5% to 25% by weight. The preferred range of water content is from 9% to 16%. The therapeutic pillow can be in different shapes, such as the shape of a toy for use by children, a pad shape with pockets for inserting hands or feet, or muff-shaped. Also disclosed is a temperature sensor and baffles to keep the filling from gathering. A bio-magnetic embodiment is also disclosed.

This patent discloses a therapeutic pillow that can be in different shapes, such as of a toy for use by children, a pad shape with pockets for inserting hands or feet, or muff-shaped. It has been designed to contain therapeutic materials in a bag like cover. The filling for this therapeutic pillow is a natural granular material having water content in the range of 5% to 25% by weight, providing an apparatus and method for applying heat or cold to a body part for ameliorating discomfort. It has not been designed to be used as a pillow or cushioning device, or to allow a user to place one or both of their hands or arms into its interior, to cushion, insulate, or protect them; while in addition, allowing the user to cushion, insulate, or protect, as well as support, adjust, or precisely position their head, face, or other parts of their body. There has been no mention of the use of soft conventional insulative fillers such as down, feathers, or foam, or of an alternate version, which can be inflatable or refillable as provided by the Compartmented Cushioning Device. There has been no mention of the use of different fabrics or materials used on the outside or on the inside compartments for a smooth cool feeling, or a soft warm feeling. Nor has there has been any mention of a sanitizing treatment of the internal surface materials with a substance, as a method of sanitizing the hands or arms of the individual using the device.

U.S. Pat. No. 5,918,333 of Yoshie Takashima describes a deodorizing pillow that has a core covered by a cover which has pockets formed both on its upper and lower sides. The pockets on one of the sides of the cover can removably contain charcoal or active carbon granule deodorizers, while the pockets on the other side of the cover are filled with chips of Japanese cypress. In another embodiment, the core of the pillow is composed of an upper and a lower layer, and a deodorizer of active carbon granules or charcoal is tucked between the upper and lower layers.

This patent describes a deodorizing pillow with pockets containing charcoal or active carbon granule deodorizers, and chips of Japanese cypress. This pillow does not include one or more cool or warm feeling compartments, which allow a user to place one or both of their hands or arms within. In addition, this pillow is designed to be used primarily in bed, and does not provide the feature of portability, as offered by some embodiments of the Compartmented Cushioning Device.

U.S. Pat. No. 6,463,608 of Peggy Michelle Moe tells of an arm-supporting and hand-warming multipurpose pillow system having a pocket defined between an outer surface of the main pillow body and an inner surface of a panel covering at least a portion of the main pillow body.

This patent tells of a C-shaped multipurpose support pillow that can be wrapped around a human torso and used to keep the hands warm while supporting the arms of the human. This pillow is not designed to be used by a person resting in bed, sitting on a couch, or as a travel pillow, to be used in a car, bus, train, or plane. In addition, no mention has been made of cool feeling compartments that can be used when the ambient temperature is warm or hot.

U.S. Pat. No. 6,526,612 of Carmine Zarrella discloses a hand-supported headrest pillow for providing a convenient and compact headrest. The pillow includes a cushion dimensioned for seating about the palm of a user's hand. A strap attached to the cushion is provided for securing the cushion to and against a user's palm so that, when so-positioned, the user's head can be rested against the cushion. In an alternate embodiment, the strap is replaced by one or more sleeves or sheaths for accommodating insertion of one or more of the user's fingers to secure the cushion to and against the user's hand.

This patent discloses a hand-supported headrest pillow for providing a convenient and compact headrest. This pillow has been designed to strap to the hand only, and does not have internal compartments, allowing a user to place one or both of their hands or arms within. Nor, has there been any mention of a user's ability to place their hands or arms into a choice of one or more cool or warm feeling compartments; to cushion, insulate, or protect them from the environment, or from each other.

None of these previous efforts, however, provides the benefits attendant with the Compartmented Cushioning Device. The present design achieves its intended purposes, objects, and advantages over the prior art devices through a new, useful, and unobvious combination of method steps and component elements; with the use of a minimum number of functioning parts, at a reasonable cost to manufacture, and by employing readily available materials.

In this respect, before explaining at least one embodiment of the Compartmented Cushioning Device in detail, it is to be understood that the design is not limited in its application to the details of construction or to the arrangement of the components set forth in the following description or illustrated in the drawings. The Compartmented Cushioning Device is capable of other embodiments, and of being practiced and carried out in various ways. In addition, it is to be understood that the phraseology and terminology employed herein are for the purpose of description, and should not be regarded as limiting. As such, those skilled in the art will appreciate that the conception, upon which this disclosure is based, may readily be utilized as a basis for designing of other structures, methods, and systems for carrying out the several purposes of the present design. It is important, therefore, that the claims be regarded as including such equivalent construction insofar as they do not depart from the spirit and scope of the present application.

BRIEF DESCRIPTION OF THE SEVERAL VIEWS OF THE DRAWINGS

The accompanying drawings, which are incorporated in and form a part of this specification, illustrate embodiments of the Compartmented Cushioning Device and together with the description, serve to explain the principles of this application.

Figure 1:
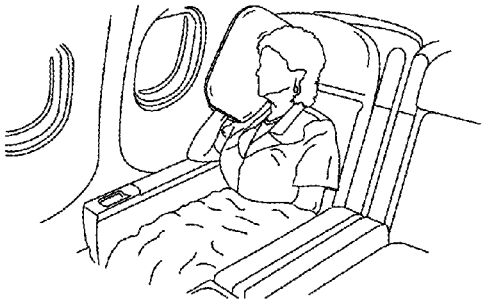
FIG. 1 depicts a person sitting in an airplane, using the Compartmented Cushioning Device, with their hand placed within a compartment; allowing them to support, adjust, and precisely position their head and face, which together with their hand, are being cushioned, insulated, and protected as well.

For a fuller understanding of the nature and advantages of the Compartmented Cushioning Device, reference should be had to the following detailed description taken in conjunction with the accompanying drawings which are incorporated in and form a part of this specification, illustrate embodiments of the design, and together with the description, serve to explain the basic principles of this application. It should be noted that for the purpose of this patent application: the term upper extremities is intended to be a synonym of the terms hands or wrists, hands or arms, fingers, hands, or arms, and fingers, hands, wrists, or arms, and can be substituted for any of the others.

DETAILED DESCRIPTION OF THE INVENTION

A principal feature of the Compartmented Cushioning Device is that it offers one or more compartments, formed between or surrounded by one or more components, with each component, comprised of one or more cushioning layers, and each cushioning layer, including filler material encased in surface material.

Another feature of the Compartmented Cushioning Device is that its one or more compartments can be reached through one or more compartment openings, which can be located at one or more edges or sides of the device, thereby providing access to the one or more compartments; whereby a user has multiple options when placing all or part of one or more of their fingers, hands, wrists, or arms into either the same or separate compartments to cushion, insulate, or protect them; while in addition, allowing the user to cushion, insulate, or protect, as well as support, adjust, or precisely position their head, face, or other parts of their body.

A further feature of the Compartmented Cushioning Device is that its one or more compartments can be constructed of cool or warm feeling surface materials having different comfort, insulative, or thermal characteristics; thereby granting the user a choice of placing all or part of one or more of their fingers, hands, wrists, or arms, into either a cool or a warm feeling compartment; to keep them as cool as possible, or to maintain or increase their warmth. In configurations that offer one or more of each; the user will be able to choose or switch between one and the other, depending upon the ambient temperature and their comfort needs.

Another feature of the Compartmented Cushioning Device is that when designed with two or more compartments, they can be located side by side or one on top of the other.

A further feature of the Compartmented Cushioning Device is that multiple compartments can be created by the means of a primary compartment, containing a single or a multiple layer inner component. Located within the primary compartment, the inner component divides the primary compartment into two separate compartments, an upper or front compartment, and a lower or rear compartment. The inner component could have a secondary compartment within it, which can also be divided by the means of still another inner component, and so on, in succession, thereby creating additional compartments within the cushioning device. The inner component or components can be attached permanently, or they can be attached releasably or detached completely, allowing them to be removed, in order to exchange or replace them, or for cleaning or washing, as required by the materials of which they are constructed.

Another feature of the Compartmented Cushioning Device is that multiple compartments can also be created by the means of a primary compartment, containing two or more inner components. Located within the primary compartment, and stacked one on top of the other, the inner components divide the primary compartment into three or more compartments. The inner components can be attached permanently, or they can be attached releasably or detached completely, allowing them to be removed, in order to exchange or replace them, or for cleaning or washing, as required by the materials of which they are constructed.

A further feature of the Compartmented Cushioning Device is that multiple compartments can as well be created by the means of two or more components stacked one on top of the other; with the surface material of the upper component, attached to the surface material of the adjacent lower component, at one or more attachment points at any location; which in turn is attached to the surface material of the following lower component in the same manner; and so on, in succession, until reaching the lowest component; wherein a compartment is created between or surrounded by each set of adjacent components.

Another feature of the Compartmented Cushioning Device is that its components can be configured in a variety of designs that will enable a smaller component, to fit and lock releasably within a larger component, which has at least one compartment, and one compartment opening. With the smaller component sized and shaped to conform to the size and shape of the compartment, this will allow the smaller component to fit and lock releasably and securely into place once inside. With the smaller component folded, it can easily be inserted through a compartment opening, to be placed within the compartment of the larger component. Once inside and fully extended, it will fit and lock releasably and securely into place within the compartment, and will not fall out. This design feature partially encases and securely retains the smaller component, within the compartment of the larger component, while still allowing it to easily be released.

A further feature of the Compartmented Cushioning Device is that it can be available in a wide variety of shapes and sizes, which can adequately accommodate all or part of one or more of a user's fingers, hands, wrists, or arms, thus allowing them to attain a level of comfort and control not found in traditional cushions and pillows. With all or part of one or more of a user's fingers, hands, wrists, or arms placed within a compartment, direct contact with their head, face, or other parts of their body can be avoided. Inside the same compartment, their fingers, hands, wrists, or arms can be cushioned, insulated, and protected from the environment, or when placed in separate compartments, from each other as well. This will provide a means for a wide variety of applications; such as for placing the hands or arms inside while lounging, traveling, or sleeping; to be used as a cool feeling cushioning device or hand or arm cooler, in warm or hot weather, when designed with one or more cool feeling compartments and optional air circulation openings; to be used as a warm feeling cushioning device or hand or arm warmer, in cool or cold weather, when designed with one or more warm feeling compartments and one or more optional heating devices; as a hand pillow, as a travel pillow, as a sleep pillow; or simply as a cushion or pillow to rest against.

Another feature is that the Compartmented Cushioning Device can be ergonomically designed for precision comfort, thereby allowing a user to place all or part of one or more of their fingers, hands, wrists, or arms into a compartment to support, adjust, or finely tune the position of their head, face, or other parts of their body. This fine tune positioning can be achieved by the user, by placing all or part of their fingers, hands, wrists, or arms within a compartment, and directly or partially beneath their head, face, or other parts of their body. Or, their fingers, hands, wrists, or arms can be placed away from, and to or toward the opposite side of the cushioning device's contact with their head, face, or other parts of their body; using the cushioning device as a lever, to lift, support, and adjust them. The compartments can offer an ample amount of room within them, allowing the user to move their fingers, hands, wrists, or arms freely, and to position them as desired. In addition, the space provided can also permit their movement within each compartment, from one area to another, as the temperature changes from extended use, or due to their proximity to an air circulation or compartment opening. This feature will allow the user to reposition their fingers, hands, wrists, or arms to a cooler, or to a warmer area within the compartment, thereby permitting them to attain or maintain a greater level of comfort.

A further feature is that the exterior and/or interior of the Compartmented Cushioning Device, as well as that of any inner components, can be designed to ergonomically imitate and accommodate the tapered shape of a user's hand, wrist, and arm; in that the hand is wider than the wrist and arm, and is tapered both at the bottom of the hand, where it joins with the wrist and arm, as well as at the top of the hand, where it tapers toward the tips of the fingers. Similarly, the maximum exterior width of the device can be designed to be wider than, then taper toward the compartment openings; along with the maximum interior widths of the compartments, which can be designed to be wider than, then taper toward the compartment openings as well. This design feature, allows the user to place their fingers, hands, wrists, or arms into a compartment, and once inside, spread and move their fingers, as well as reposition their fingers, hands, wrists, or arms freely within the compartment. This design feature will also assist in maintaining the contact between the layers of the cushioning device, producing a snug fit when a user's fingers, hands, wrists, or arms are placed within its interior. This snug fit allows the cushioning device to essentially grip the user's fingers, hands, wrists, or arms; which can help to keep it from falling, moving, or slipping when used in a vertical position, as when placed against a wall or window, such as in a car, bus, train, or plane. This design feature, which creates a reduced size of the compartment openings, as compared to the user's hand; will also assist in preventing the cushioning device from sliding off the user's hand, whether toward their arm, or opposite their arm. The cushioning device, essentially surrounds or encases a user's hand once inside, while still allowing the user to move or remove their hand easily. The user, by spreading their fingers apart to a greater or lesser degree, will be able to control or prevent the movement or slippage of the cushioning device, relative to the position of their fingers, hands, wrists, or arms. This design feature will reduce the need for the user to manually grip the cushioning device to hold it up, allowing the user to relax; while in addition, allowing them to support, adjust, or precisely position their head, face, or other parts of their body. The reduced size of the compartment openings, as compared to the maximum interior width of the compartments, is also very helpful in the retention of the shape of the embodiment; by maintaining the position of the interior surface materials, relative to the exterior surface materials; as well as by maintaining the position of the exterior and interior surface materials, relative to the filler materials. In addition, this design feature will also provide soft rounded corners at the exterior, and a cozy cocoon or pod type shape to the cushioning device. With the exterior corners rounded, this shape can further enhance the potential level of comfort for the user, by providing soft rounded transitional areas, instead of angular corners or edges.

Another feature of the Compartmented Cushioning Device is that when a user places one or both of their hands or arms into the same or separate compartments; the weight of their hands or arms can be held up by the cushioning device; thereby allowing them, as well as their back, neck, shoulder, and surrounding muscles to relax.

A further feature of the Compartmented Cushioning Device is that the surface materials on the exterior, as well as the surface materials within the individual compartments, can be available in a wide assortment of materials having different comfort, insulative, or thermal characteristics; thereby offering user's a variety of choices, such as smooth cool feeling fabric materials, soft warm feeling fabric materials, or a variety of other natural and/or synthetic materials such as leather, nylon, vinyl, wool, or any combination of the above. This feature will allow for the design of embodiments that offer all cool feeling surface materials, all warm feeling surface materials, as well as a combination of both. The cool feeling materials are so described in this application, because they are composed of materials such as cotton or linen, which due to their intrinsic qualities, can assist in dissipating heat. These qualities can allow the cool feeling surface materials to initially cool the user's skin, and then increase in temperature at a slower rate, than if they were composed of materials with greater insulating characteristics. Once warmer, a cooler feeling can once again be experienced by the user, by moving or switching to another area of the cool feeling material surface. On the other hand, the warm feeling materials are so described in this application, because they are composed of materials such of fleece or wool, which due to their insulating qualities, can assist in retaining heat. These materials, through their use, can work together with the heat generating nature of a user's skin, to retain and maintain, or increase their warmth. The exterior surface materials of the cushioning device, as well as the materials within the cool or warm feeling compartments, will start out at one temperature; and through their use, will increase or vary, thereby revealing the dynamics of their multi-temperature characteristics.

Another feature of the Compartmented Cushioning Device is that in embodiments with multiple compartments, they can be constructed with one or more cool feeling compartments, and one or more warm feeling compartments; as well as one or more cool feeling exterior surface materials, and one or more warm feeling exterior surface materials; thereby providing the option of exterior surface materials having different comfort, insulative, or thermal characteristics, and a compartment or compartments having different comfort, insulative, or thermal characteristics as well; each of which will either stay as cool as possible, or become as warm as possible. This feature will grant the user a choice of resting against or touching a cool or a warm feeling exterior surface material, as well as a choice of placing all or part of one or both of their hands or arms, into either a cool or a warm feeling compartment; to keep them as cool as possible, or to maintain or increase their warmth. In addition, the user will be able to choose or switch between one and the other; depending upon the ambient temperature and their comfort needs. If desired, the exterior surface temperatures of the cushioning device, as well as the interior temperatures of the compartments, can be cooled by the user, by running air over them, or by means of a bellowing action, to run air through air circulation or compartment openings. They can also be warmed by the user; by keeping their hand or hands on them, or within a compartment or compartments, for an extended period of time; by introducing an external heat source; by a user blowing warm air, from their lungs, or from a hair dryer, onto the exterior surface materials, or the interior surface materials through air circulation openings, compartment openings, or directly through a cushioning layer of the device; as well as by means of friction, when a user rubs their hand or hands against the exterior surfaces, or interior surfaces or walls of a compartment or compartments.

A further feature of the Compartmented Cushioning Device is that in larger configurations offering one or more warm feeling compartments, it can be used not only as a hand warmer, but as an arm warmer as well. In those offering only one warm feeling compartment; the user can place both hands or arms into the same compartment. Or, in those offering two or more warm feeling compartments; the user can place their hands or arms into separate compartments, which can be accessed from opposite sides of the device. When a user places their hands or arms deep into its snug compartment or compartments, a unique cozy and secure sensation can be experienced.

Another feature of the Compartmented Cushioning Device is that its easily accessible cool or warm feeling surfaces and compartments, can be helpful for people who suffer from cold hands or arms; as well as for people who suffer from finger, hand, wrist, or arm illnesses or injuries, such as arthritis or tendonitis; who due to the effort, pain, or time involved, may find it impractical or undesirable to put on and remove gloves.

A further feature of the Compartmented Cushioning Device is that it can be designed with essentially flat outer upper and outer lower surfaces, as well as rounded corners and edges. This shape can contribute to enhancing its level of comfort, as well as increase its usefulness, by providing flat surfaces to rest against or place things upon; along with soft rounded corners and edges that can ergonomically imitate, as well as adapt to the contours of a user's body.

Another feature of the Compartmented Cushioning Device is that it can be placed by a user behind their head, to be used as a cushion or pillow to rest against. When used in this way, the user is able to grasp the interior compartment surface materials of the cushioning device, allowing them to adjust and control the angle and position of their head. In the case of embodiments with one or more inner components; the user can also grasp the top or sides of an inner component, to hold and control the entire device. And, in the case of embodiments with two or more compartment openings; the user can interlace their fingers, or grasp their hands as well. These uses can be very convenient while lounging or watching television, and will permit the user to attain a greater potential level of comfort by allowing them to support, adjust, and precisely position their head; while at the same time, permitting their back, neck, shoulder, and surrounding muscles to relax.

A further feature of the Compartmented Cushioning Device is that in embodiments that offer one or more removable inner components; the inner component or components can be folded toward the bottom within the cushioning device, thereby creating additional cushioning in the bottom half. This will allow a user to place the device behind their head, with the additionally cushioned area placed beneath the nape of their neck, to ergonomically cushion and support the contours of their head, neck, and surrounding parts of their body.

Another feature of the Compartmented Cushioning Device is that it can be placed beneath a user's head, face, or other parts of their body, whether flat or folded, to be used as a cushion, pillow, or wedge. For those embodiments offering removable inner components; they too, once removed, can be used whether flat or folded, as an additional, separate, and thinner cushion, pillow, or wedge.

A further feature of the Compartmented Cushioning Device is that for those embodiments offering single or multiple removable inner components; a user can add or subtract one or more inner components as a way of adjusting or controlling the height or thickness of the device.

Another feature of the Compartmented Cushioning Device is that it can also be designed with one or more inflatable or refillable inner components, which will allow a user to add or subtract filler material, through an access or fill valve, or an opening/closing means, thus providing a way of adjusting or controlling the height or thickness of the device.

A further feature of the Compartmented Cushioning Device is that it can be designed in a larger configuration for use in bed as a sleep pillow; with the unique quality of allowing the user to place all or part of one or both of their hands or arms between its components, cushioning layers, or partitions, and deep within the same or different cool or warm feeling compartments, thus providing them with a level of comfort and control not found in traditional sleep pillows.

Another feature of the Compartmented Cushioning Device is that when it is constructed with two, three, four, or more compartment openings, the user will be able to place all or part of one or both of their hands or arms into one compartment opening, or into two compartment openings, from opposing sides, or at a 0 to 90 degree angle in any direction, and once inside, to remain within the compartment or compartments. Or, the user will be able to place all or part of one or both of their hands or arms into one compartment opening, and depending upon their location, through the device, from a 0 to 90 degree angle in any direction, and out another compartment opening. With only a portion of their hands or arms within a compartment or compartments, this will allow the user to support, adjust, or precisely position their head, face, or other parts of their body; while at the same time, allow them to keep their hands or arms as cool as possible.

A further feature of the Compartmented Cushioning Device is that it can be used while placed on a table or desk, for sleeping or while napping. With all or part of one or both of a user's hands or arms placed within one or more compartments, the user will be able to attain a greater potential level of comfort, both for their head or face, as well as for their hands or arms. In larger configurations, the ample compartments will allow the user to move their hands or arms freely; as well as to place all or part of their hands or arms directly beneath, partially beneath, or away from the cushioning device's contact with their head or face, thereby allowing the user to support, adjust, or precisely position them. In multiple compartment configurations, the user will also be able to choose and alternate between one compartment and the other, further increasing their potential level of comfort, as well as of control.

Another feature of the Compartmented Cushioning Device is that on cool or cold days, for those embodiments constructed with two or more compartment openings, and when used in combination with a remote control for a stereo, television, or other system; a user can hold the remote control with their hand placed in a warm feeling compartment, with the front end of the remote control sticking out of the opposite side compartment opening, thereby allowing it to transmit its signal. This will allow a user to operate the remote control; while at the same time, allow them to maintain their hand as warm as possible. This use can also apply, with one or both hands placed within a compartment, when used in combination with a video game controller or other like device, in those embodiments that are specially designed for that purpose.

A further feature of the Compartmented Cushioning Device is that it can be designed with one or more air circulation openings, in one or more of the cushioning layers, which are adjacent to a compartment. This will provide a means for maintaining a cooler temperature within the compartment, by allowing additional air to flow into it, to be combined with the air that flows through the one or more compartment openings of the cushioning device. A further amount of air flow can be created by the user, when producing a bellowing action with their hands, by separating and joining the opposing surfaces that create the compartment. This will cause the air in the compartment, to be exchanged for air from the exterior, which if cooler, will cause the temperature within the compartment to become cooler as well. This feature will allow the user to keep their hands or arms as cool as possible, while they cushion, insulate, or protect them; while in addition, allowing them to cushion, insulate, or protect, as well as support, adjust, or precisely position their head, face, or other parts of their body. It should be noted that the purpose of this feature is in direct contrast to that of traditional hand warmers and muffs, which have the purpose of keeping the user's hands as warm as possible, instead of as cool as possible, as offered by this feature.

Another feature of the Compartmented Cushioning Device is that when filled with micro-beads or other soft or granular material, it can be used as a finger or hand exerciser, which can be helpful for people who suffer from finger, hand, wrist, or arm illnesses or injuries, as well as from cold hands.

A further feature of the Compartmented Cushioning Device is that it can also be used to provide comfort for others; such as while caring for babies, children, teenagers, or adults of all ages. The presence of one or more compartments within the device, will allow a user to place all or part of one or more of their fingers, hands, wrists, or arms into either the same or separate compartments, to cushion, insulate, or protect them; while in addition, allowing the user to cushion, insulate, or protect, as well as support, adjust, or precisely position the head, face, or other parts of another person's body. When used in this way, direct contact between the user and the person for whom they are caring can also be avoided; providing them both with a potentially greater level of comfort and hygiene. This use can be helpful in assisting and comforting people of all ages: in private homes, convalescent homes, hospitals, as well as in a number of other care facilities.

Another feature of the Compartmented Cushioning Device is that it can be used as a mini bed or cushion for nursing or resting a baby. With a user's hand or arm deep within a compartment, it will allow them to gently cushion and control the baby; while at the same time, allow them to cushion all sides of their hand or arm, along with parts of their legs or torso as well.

A further feature of the Compartmented Cushioning Device is that it can be designed for use by children, teenagers, or adults of all ages.

Another feature of the Compartmented Cushioning Device is that depending upon its intended use, it can be designed and constructed in an assortment of shapes and sizes, for a wide variety of uses indoors, outdoors, or in vehicles; such as a single hand pillow, in a smaller version, a convenient travel pillow, in a medium version, or a partitioned sleep pillow, in a larger version; as well as in a wide variety of decorative or geometric shapes, comprised of straight lines and/or curves, as in the shape of a circle, ellipse, polygon, or any combination thereof; as for example, in the shape of any animal, logo, person, plant, sports equipment, or symbol; as well as any other entity, object, or thing, found on earth or in the universe.

A further feature of the Compartmented Cushioning Device is that its exterior and interior surface materials can be composed of conventional fabrics or materials, such as cotton, fleece, polyester, or wool; as well as a wide variety of other natural and/or synthetic materials.

Another feature of the Compartmented Cushioning Device is that its filler materials can be composed of conventional filler or insulative materials, such as cotton, down, foam, or polyester; as well as a wide variety of other natural and/or synthetic materials.

A further feature of the Compartmented Cushioning Device is that its filler materials can be composed of a natural and/or synthetic gas, semi-liquid, liquid, semi-solid, or solid, or any combination thereof; and can be semi-soft, soft, semi-firm, firm, semi-rigid, or rigid, thus providing for a wide variety of configurations and uses.

Another feature of the Compartmented Cushioning Device is that depending upon the surface materials and/or the filler materials used in its composition, it can be designed in a semi-soft flexible configuration, a semi-firm contoured configuration, or a semi-rigid fixed configuration; as well as in a wide variety of other configurations, thereby affecting the shape and feel of the cushioning device.

A further feature of the Compartmented Cushioning Device is that it can be designed to be enclosed, inflatable, or refillable.

Another feature of the Compartmented Cushioning Device is that when designed in a smaller, inflatable, or refillable version; these configurations will offer the additional benefit of compact storage and portability.

A further feature of the Compartmented Cushioning Device is that its exterior and interior surface materials can be composed of leak proof materials, and designed to be permanently enclosed, or with access or fill valves, or opening/closing means, to be inflatable or refillable. Depending upon their intended use; they can be filled with a gas, semi-liquid, liquid, semi-solid, or solid material or materials: such as air, gel, water, foam, or micro-beads.

Another feature of the Compartmented Cushioning Device is that the filler materials and surface materials, either independently or jointly, can be created in a mold as one complete unit. Or, they can be comprised of two or more separate components, which can be detached, or connected one to the other.

A further feature of the Compartmented Cushioning Device is that it can be constructed with a minimum number of pieces of surface material, as well as with a minimum number of exterior and interior seams. As the number of pieces of surface material decreases, so does the number of required seams; thus enhancing the potential level of comfort for the user, by providing a maximum number of smooth and soft non-seam areas on the cushioning device.

Another feature of the Compartmented Cushioning Device is that it can be constructed with a minimum number of exterior facing seams, which can be designed to be relatively small, as well as hidden within a compartment. This minimum number of exterior facing seams, with one being possible, enhances the potential level of comfort for the user, by providing a maximum number of smooth and soft areas on the surfaces of the cushioning device.

A further feature of the Compartmented Cushioning Device is that it can be designed with baffles or quilting; in those configurations that use two or more distinct types of filler material, as well as in those that use filler material which is granular or loose. The baffles or quilting, which can be built into its layers, will section off or segregate areas within the cushioning device, thereby minimizing shifting and ensuring a more even distribution of the filler material throughout.

Another feature of the Compartmented Cushioning Device is that it can be constructed with collars or cuffs, which can be attached to or made part of the compartment opening or openings, thereby increasing the retention of heat, by preventing the transfer of air in or out of the compartment or compartments of the cushioning device.

A further feature of the Compartmented Cushioning Device is that it can be designed in a reversible configuration, with either the same or different: color, design, texture, type of surface materials, or type of filler materials. This feature will allow a user to modify the feel or look of the cushioning device, as well as facilitate cleaning or washing, as required by the materials of which it is constructed.

Another feature of the Compartmented Cushioning Device is that it can be constructed with one or more opening/closing means, such as those that utilize buttons, hooks and loops, flaps, snaps, zippers, or other appropriate means. This feature will allow the surface materials or the filler materials to be removed, to exchange or replace them, or for cleaning or washing, as required by the materials of which they are constructed.

A further feature of the Compartmented Cushioning Device is that it can be constructed with replaceable outer or inner component covers, which encase the exterior and/or interior of the individual components; as well as offer one or more opening/closing means, thus allowing them to be removed and replaced. These component covers, can be available in a wide variety of fabrics or materials; as well as in a wide variety of colors, designs, textures, or comfort, insulative, or thermal characteristics. This feature will offer the device extra protection from dirty, wet, or other undesirable surfaces; allow the user to modify the feel or look of the cushioning device; as well as offer the user a choice of outer or inner component covers that are constructed of cool feeling materials, warm feeling materials, or a combination of both. In addition, the design of the component covers will allow them to be easily removed and replaced for cleaning or washing, as required by the materials of which they are constructed.

Another feature of the Compartmented Cushioning Device is that it can be constructed with replaceable outer and/or inner component covers, that encase the exterior of the device, as well as offer one or more pockets, which fit individually into a corresponding compartment, thereby allowing them to serve as a protective liner. In addition to the protection that they would offer, the design of the component covers will allow them to be easily removed and replaced for cleaning or washing, as required by the materials of which they are constructed.

A further feature of the Compartmented Cushioning Device is that it can be constructed with replaceable outer covers, which are positioned exclusively over the exterior of the device, to serve as a jacket, sweater, or vest. These outer covers can be available in a wide variety of fabrics or materials; as well as a wide variety of colors, designs, textures, or comfort, insulative, or thermal characteristics. This feature will offer the device extra protection from dirty, wet, or other undesirable surfaces; as well as allow the user to modify the feel or look of the cushioning device. In addition, the design of the outer covers will allow them to be easily removed and replaced for cleaning or washing, as required by the materials of which they are constructed.

Another feature of the Compartmented Cushioning Device is that it can be constructed with replaceable single or multiple layer inner components, which can be available in a wide variety of fabrics or materials; as well as a wide variety of colors, designs, textures, or comfort, insulative, or thermal characteristics. This feature will allow a user to modify the feel or look of the inner components, such as from cool and fresh, brightly colored cotton; to warm and cozy, richly colored artificial fur; to a wide variety of other cool or warm, single or multiple layer inner components.

A further feature of the Compartmented Cushioning Device is that it can also offer the user a health related benefit. This is in response to the fact that contaminants and diseases are commonly found on the hands of people, both out in public and in their home; and although they should, people frequently do not wash their hands as often as recommended. By putting their hands next to and touching their face, these contaminants and diseases are placed where they can do the most damage. By placing their hands inside the compartment or compartments of the device, they will be prevented from touching their face while using it. Another benefit is that the interior compartment surface materials can be coated with a substance for sanitizing the user's hands. The sanitizing substance, which will only be located within the compartments, will therefore not be in contact with the user's face when resting against the exterior surfaces of the cushioning device. It should be noted that although the above paragraph focuses entirely on the user's hands, the same can apply to their arms as well.

Another feature of the Compartmented Cushioning Device is that it can be available with a disposable cover and/or liner. As an option, the compartment surface materials of the disposable cover and/or liner can be coated with a substance for sanitizing the hands or arms of the user.

A further feature of the Compartmented Cushioning Device is that it can be used in combination with a custom fitted outer cover, which can be composed of a wide variety of materials, including those that are impermeable or waterproof. When placed within it, the outer cover will help to protect the device from dirty, wet, or other undesirable surfaces; while at the same time, allowing it to be used as a cushion or pillow to rest against. One or more opening/closing means on the outer cover will allow the user to access the compartment or compartments of the device; as well as provide a means for placement of the device within it. With the opening/closing means on the outer cover closed, this feature will allow the user to store, transport, or use the device, while protecting it from the outside elements. In addition, the user will also be able to store, protect, or transport other items within the compartment or compartments of the cushioning device.

Another feature of the Compartmented Cushioning Device is that it can be used in combination with a custom fitted outer cover, along with one or more opening/closing means, an attachment device, and a suction cup accessory. When used in this way, it can be secured to a window or other smooth surface, such as in a car, bus, train, or plane. This will allow a user to place their head, face, or other parts of their body on or against the device; as well as allow the user to access its interior compartment or compartments if desired. When used secured to the window of a car, bus, train, or plane, it can serve as a light or sunlight blocker as well.

A further feature of the Compartmented Cushioning Device is that it can be used in combination with a custom fitted outer cover, along with a fastening device, and one or more opening/closing means, to be placed over the shoulders or around the waist. When used in this way, it can be used as a hand or arm warmer; or by a person with injured fingers, hands, wrists, or arms to reduce mobility and provide rest. This use can also be very convenient for people who work or play outside in cool or cold weather, as in the case of a photographer or a football player, who need instant access to the use of their fingers and hands, and who would be limited by the use of gloves. In addition, its use can easily be converted to that of a comfortable cushion or pillow to rest against. This convenient transition of use can apply indoors, outdoors, or in vehicles.

Another feature of the Compartmented Cushioning Device is that when used in combination with a custom fitted outer cover, along with a fastening device, and worn by a user around their waist; the device can be turned 180 degrees toward the user's back, to serve as a back cushion or lumbar support. The custom fitted outer cover can also be available with a pivoting system, allowing it to be turned up to 90 degrees or more in any direction, thereby permitting it to comfort and support a larger portion of the user's back.

A further feature of the Compartmented Cushioning Device is that it can be used in combination with a cord or other attachment means. Secured to a bedspread, blanket, comforter, pillow, sheet, or to a user's sleep wear, wrist, or waist; it can assist the user in locating the cushioning device, while in bed or in the dark.

And yet another feature of the Compartmented Cushioning Device is that in addition to all of the above mentioned qualities, it also shares the following features and uses with existing products: It can be used as a conventional cushion or pillow; as an advertising medium for corporate logos, service marks, or trademarks; as an armrest; as a book or laptop pad; as a cushioning device with an electronic or other device installed, such as an audio, heart beat simulation, heating, or vibration device; as a cushioning device with one or more custom pockets built into it to hold an article or articles, such as a gift, identification card, keepsake, money, music player, passport, remote control, ticket, or wallet; as a cushion to be used around or between a user's ankles or knees; as a cushion to be used around a user's arm; as a cushion to be placed beneath a user's feet or legs to cushion or raise them; as a cushion or pillow between two people; as a cushion and storage combination device with one or more opening/closing means, such as hooks and loops or zippers, that will allow a user to fill all or part of the interior of the device with a blanket, filler material, inner component, sleep wear, or a variety of other objects; as a decorative cushion or pillow with chosen exterior artwork or materials; as a face warmer when a user momentarily places it over their face and breathes warm air into it; as a heat pack or ice pack with specially designed baffles or pockets; as a lumbar support; as a light or sunlight blocker; as a meditation or prayer aid by keeping the hands and arms of the user rested and still; as a pet lap bed; as a pillow wedge for a person in a hospital or other bed; as a security comforter for children, teenagers, or adults of all ages, as similar to a security blanket; as a sleep aid; as a toy for children, teenagers, or adults of all ages, as similar to a plush toy, stuffed toy, or teddy bear, or with a cartoon character, school logo, sports logo, or other logo or indicia; as a way to conserve energy and money by keeping the user warm; in combination with a blanket within a specially designed pouch; in combination with a hooded jacket or other apparel into which it is inserted; in combination with or as a supplement to other cushions or pillows; as well as perhaps a number of other uses not included here, that may be discovered or revealed in the future.

With respect to the above description then, it is to be realized that the optimum dimensional relationships for the parts of this application, to include variations in size, materials, shape, form, function, and manner of operation, assembly, and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Compartmented Cushioning Device. Further, since numerous modifications and changes will readily occur to those skilled in the art, it is not desired to limit the design to the exact construction and operation shown and described, and accordingly, all suitable modifications and equivalents may be resorted to, falling within the scope of this application. There are additional features of the Compartmented Cushioning Device that will be described hereinafter and which will form the subject matter of the claims appended hereto.

DETAILED DESCRIPTION OF THE EMBODIMENTS

Referring now to the drawings, FIG. 1 depicts a person sitting in an airplane, using the Compartmented Cushioning Device 10A, positioned against the wall near the window, with their hand placed within a compartment; allowing them to support, adjust, and precisely position their head and face, which together with their hand, are being cushioned, insulated, and protected as well, thus allowing the person to travel more comfortably.

Figure 2:
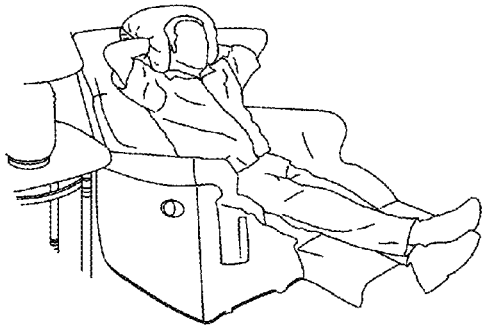
FIG. 2 depicts a person sitting in a recliner, using the Compartmented Cushioning Device, with their hands placed within the single compartment; allowing them to support, adjust, and precisely position their head and neck, which together with their hands, are being cushioned, insulated, and protected as well.

FIG. 2 depicts a person sitting in a recliner, using the Compartmented Cushioning Device 10I, positioned behind their head, with their hands placed within the single compartment; allowing them to support, adjust, and precisely position their head and neck, which together with their hands, are being cushioned, insulated, and protected as well, thus allowing the person to lounge more comfortably.

Figure 3:
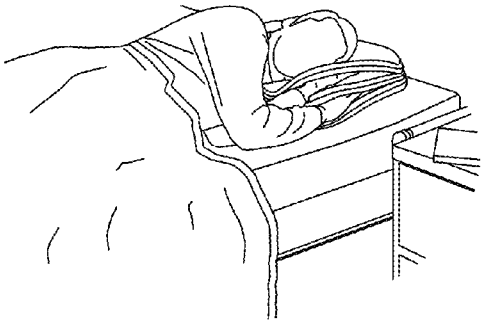
FIG. 3 depicts a person laying in bed, using the Compartmented Cushioning Device, with their hands placed within the compartments; allowing them to support, adjust, and precisely position their head and face, which together with their hands, are being cushioned, insulated, and protected as well.

FIG. 3 depicts a person laying in bed, using the Compartmented Cushioning Device 10K, positioned beneath their head, with their hands placed within the compartments; allowing them to support, adjust, and precisely position their head and face, which together with their hands, are being cushioned, insulated, and protected as well, thus allowing the person to sleep more comfortably.

Figure 4:
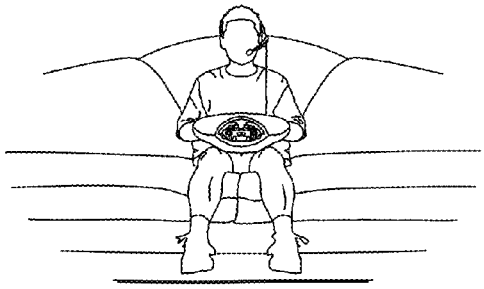
FIG. 4 depicts a person sitting on a couch, using the Compartmented Cushioning Device, holding and using a video game controller, with their hands placed within a compartment; allowing them to cushion, insulate, and protect their hands, and lap as well.

FIG. 4 depicts a person sitting on a couch, using the Compartmented Cushioning Device 10E, holding and using a video game controller, while wearing a headset, with its cord placed through an opening on the back of the device, and their hands placed within a compartment; allowing them to cushion, insulate, and protect their hands, and lap as well, thus allowing the person to play more comfortably.

Figure 5:
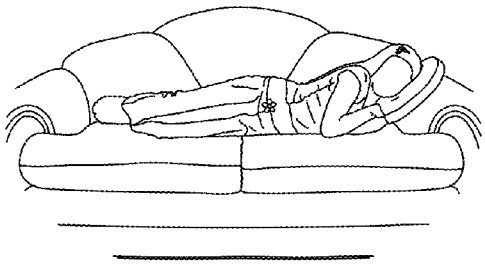
FIG. 5 depicts a person laying on a love seat, using the Compartmented Cushioning Device, with their hands placed within one or more compartments; allowing them to support, adjust, and precisely position their head and face, which together with their hands, are being cushioned, insulated, and protected as well.

FIG. 5 depicts a person laying on a love seat, using the Compartmented Cushioning Device 10G, positioned against the arm, with their hands placed within one or more compartments; allowing them to support, adjust, and precisely position their head and face, which together with their hands, are being cushioned, insulated, and protected as well, thus allowing the person to watch television more comfortably.

Figure 6:
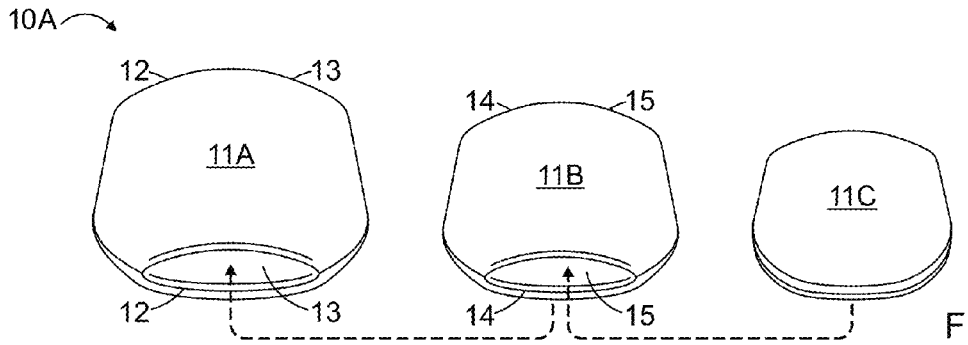
FIG. 6 depicts a top-side perspective view of the first embodiment of the Compartmented Cushioning Device in a rounded corner elongated octagon configuration, and designed for use in multiple applications. It is shown here with its three components: the principal outer component and the first inner component, each with two compartment openings and one compartment, along with the second inner component, with each component shown separated from the others; as well as with two dashed line arrows to illustrate that each smaller component has been designed to fit within a larger one.

FIG. 6 depicts a top-side perspective view of the first embodiment of the Compartmented Cushioning Device 10A in a rounded corner elongated octagon configuration, and designed for use in multiple applications. It is shown here with its three components: the principal outer component 11A, the first inner component 11B, and the second inner component 11C, with each component shown separated from the others. The second inner component 11C is sized and shaped, to fit within the secondary compartment 15, of the first inner component 11B. In the same manner, the first inner component 11B is sized and shaped, to fit within the primary compartment 13, of the principal outer component 11A. The two dashed line arrows in this figure have been included to indicate the direction, movement, and placement within the principal outer component 11A, of the first inner component 11B, as well as the placement within the first inner component 11B, of the second inner component 11C; illustrating that each smaller component has been designed to fit within a larger one. The principal outer component 11A has two matching primary compartment openings 12 and 12, located at opposite sides of the device, which allow access, through either side, into its primary compartment 13. The principal outer component 11A is sized and shaped with four rounded and tapered corners, so that the perimeters of the primary compartment openings 12 and 12 are smaller than all or part of the parallel perimeters of the primary compartment 13. In turn, the first inner component 11B is sized and shaped with four rounded and tapered corners, conforming to the size and shape of the primary compartment 13, thereby allowing it to fit and lock releasably and securely into place once inside. The four rounded and tapered corners, by reducing the perimeters of the two primary compartment openings 12 and 12, as compared respectively to all or part of the parallel perimeters of the primary compartment 13, work together, to lock in the first inner component 11B, within the primary compartment 13, of the principal outer component 11A. The first inner component 11B has two matching secondary compartment openings 14 and 14, located at opposite sides of the device, which allow access, through either side, into its secondary compartment 15. The first inner component 11B is sized and shaped with four rounded and tapered corners, so that the perimeters of the secondary compartment openings 14 and 14 are smaller than all or part of the parallel perimeters of the secondary compartment 15. In turn, the second inner component 11C is sized and shaped with four rounded and tapered corners, conforming to the size and shape of the secondary compartment 15, thereby allowing it to fit and lock releasably and securely into place once inside. The four rounded and tapered corners, by reducing the perimeters of the two secondary compartment openings 14 and 14, as compared respectively to all or part of the parallel perimeters of the secondary compartment 15, work together, to lock in the second inner component 11C, within the secondary compartment 15, of the first inner component 11B. With the first inner component 11B folded, it can easily be inserted through either primary compartment opening 12 or 12, to be placed within the primary compartment 13, of the principal outer component 11A. Once inside and fully extended, it will fit and lock releasably and securely into place within the primary compartment 13, and will not fall out. The larger perimeters of the primary compartment 13, combined with the smaller parallel perimeters of the primary compartment openings 12 and 12, work together, to lock in the first inner component 11B, within the primary compartment 13, of the principal outer component 11A. This design feature partially encases and securely retains the first inner component 11B, within the primary compartment 13, while still allowing it to easily be released. Equally, with the second inner component 11C folded, it can easily be inserted through either secondary compartment opening 14 or 14, to be placed within the secondary compartment 15, of the first inner component 11B. Once inside and fully extended, it will fit and lock releasably and securely into place within the secondary compartment 15, and will not fall out. The larger perimeters of the secondary compartment 15, combined with the smaller parallel perimeters of the secondary compartment openings 14 and 14, work together, to lock in the second inner component 11C, within the secondary compartment 15, of the first inner component 11B. This design feature partially encases and securely retains the second inner component 11C, within the secondary compartment 15, while still allowing it to easily be released.

Figure 7:
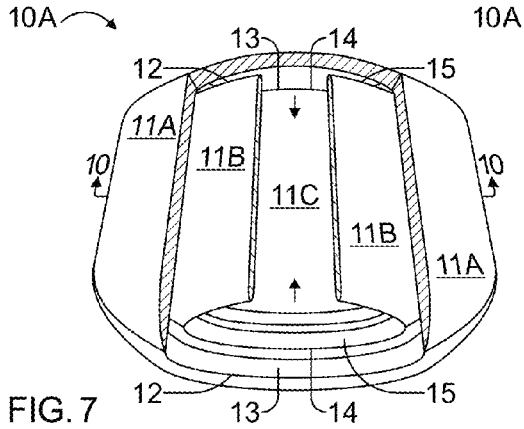
FIG. 7 depicts a top-side perspective cut-away view of the first embodiment of the Compartmented Cushioning Device showing the principal outer component, with a center portion of its upper cushioning layer cut away, revealing portions of its two compartment openings, its compartment, and the first inner component located within; also shown with a center portion of its upper cushioning layer cut away, to reveal portions of its two compartment openings, its compartment, and the second inner component.
Figure 10:
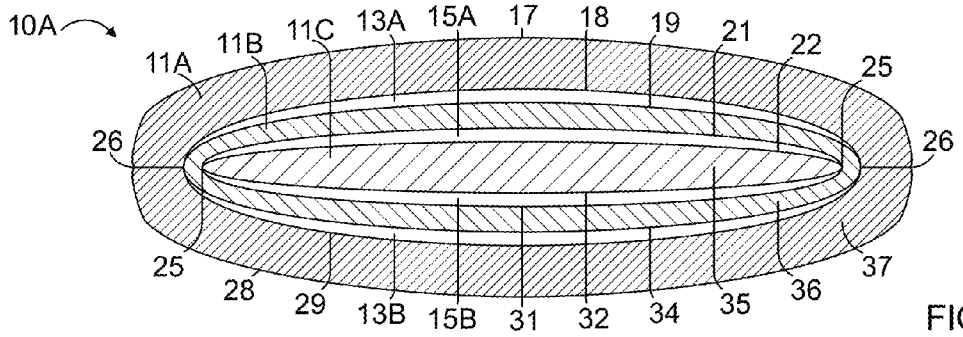
FIG. 10 depicts a side-to-side cross section view of the first embodiment of the Compartmented Cushioning Device, showing the principal outer component, the first inner component, and the second inner component, located one within the other; along with numbers with lead lines to point out individual parts that help make up its three components, four compartment openings, and four compartments.

FIG. 7 depicts a top-side perspective cut-away view of the first embodiment of the Compartmented Cushioning Device 10A, showing the principal outer component 11A, with a center portion of its upper cushioning layer cut away, revealing a portion of the first inner component 11B, fitted and locked releasably within the primary compartment 13. The first inner component 11B is depicted with a center portion of its upper cushioning layer cut away, to reveal a portion of the second inner component 11C, fitted and locked releasably within the secondary compartment 15, thus forming the center of the Compartmented Cushioning Device 10A. The principal outer component 11A is depicted with a center portion of its upper cushioning layer cut away, from and including its entire primary compartment opening 12, shown here at the front, then cut all the way back, leaving a small portion of the cushioning layer directly above its opposite side primary compartment opening 12, thereby allowing portions of its two primary compartment openings 12 and 12 to be observed. The first inner component 11B is depicted with a center portion of its upper cushioning layer cut away, from and including a portion of its secondary compartment opening 14, shown here at the front, then cut all the way back, including a portion of its opposite side secondary compartment opening 14, thereby allowing portions of its two secondary compartment openings 14 and 14 to be observed. Included in this figure are cross section reference arrows 10 and 10, to show the location and direction of the side-to-side cross section view as depicted in FIG. 10. The two arrows in this figure that are located at the center, and floating above the second inner component 11C, are included to indicate the paths for placement and removal from either side of the first and the second inner components 11B and 11C, into and out of their respective primary and secondary compartments, 13 and 15. These two arrows also serve to show the paths for movement of a user's fingers, hands, wrists, or arms, into, out of, or through the device. It should be noted that the first inner component 11B, can be attached permanently to the principal outer component 11A; or, it can be attached releasably and removable, or detached completely and removable from it as well. Likewise, the second inner component 11C, can be attached permanently to the first inner component 11B; or, it can be attached releasably and removable, or detached completely and removable from it as well.

Figure 8:
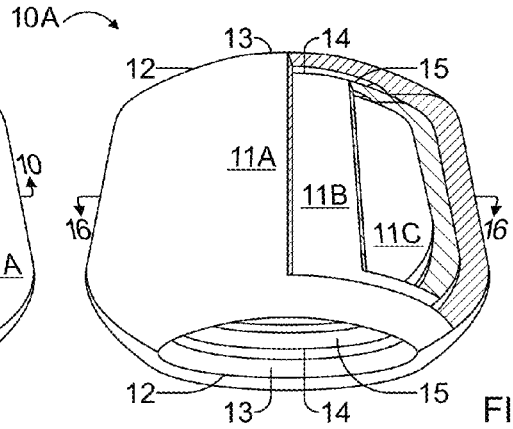
FIG. 8 depicts a top-side perspective cut-away view of the first embodiment of the Compartmented Cushioning Device showing the principal outer component, with a side portion of its upper cushioning layer cut away, revealing portions of its two compartment openings, its compartment, and the first inner component located within; also shown with a side portion of its upper cushioning layer cut away, to reveal portions of its two compartment openings, its compartment, and the second inner component.
Figure 16:
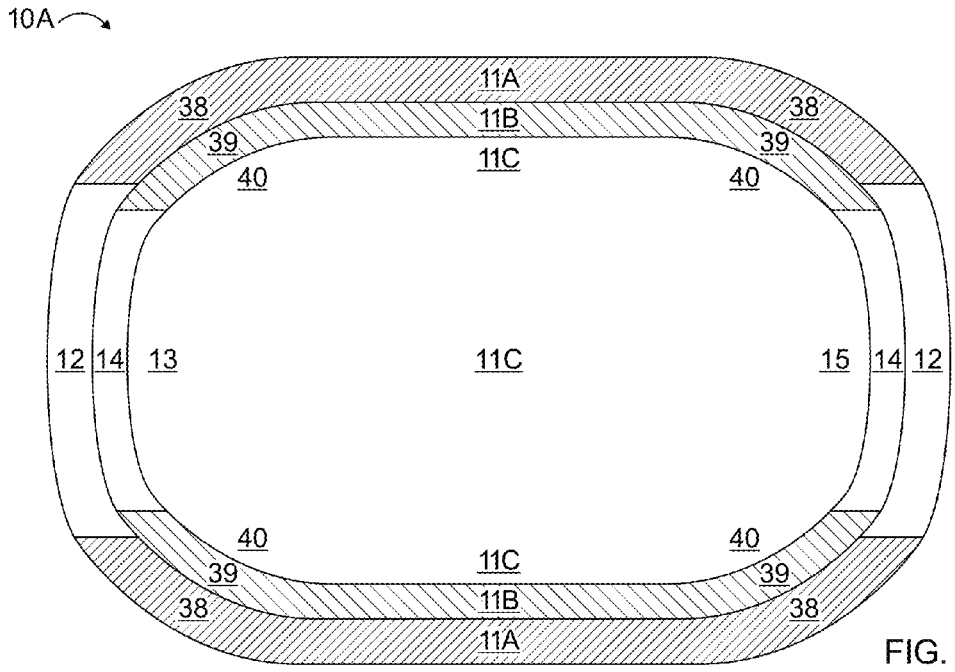
FIG. 16 depicts a top/front to bottom/back cut-away view of the first embodiment of the Compartmented Cushioning Device, showing the principal outer component and the first inner component, each with their entire upper cushioning layer cut away, revealing the second inner component located within; along with each of their respective compartment openings, compartments, and/or sides, as well as four rounded comfort-lock-in tapers, four rounded fit-in-lock-in tapers, and four rounded fit-in tapers.

FIG. 8 depicts a top-side perspective cut-away view of the first embodiment of the Compartmented Cushioning Device 10A, showing the principal outer component 11A, with a side portion of its upper cushioning layer cut away, leaving small portions directly above both side primary compartment openings 12 and 12, revealing a portion of the first inner component 11B located within; also with a side portion of its upper cushioning layer cut away, leaving small portions directly above both side secondary compartment openings 14 and 14, to reveal a portion of the second inner component 11C located within. This figure illustrates the manner in which the first inner component 11B, is fitted and locked releasably within the primary compartment 13, of the principal outer component 11A; as well as the manner in which the second inner component 11C, is fitted and locked releasably within the secondary compartment 15, of the first inner component 11B. In addition, this figure provides an alternate and further revealing view of the primary and secondary compartment openings 12, 12, 14, and 14, respectively of the principal outer component 11A, and the first inner component 11B; as well as cut-away reference arrows 16 and 16, to show the location and direction of the top/front to bottom/back cut-away view as depicted in FIG. 16.

Figure 9:
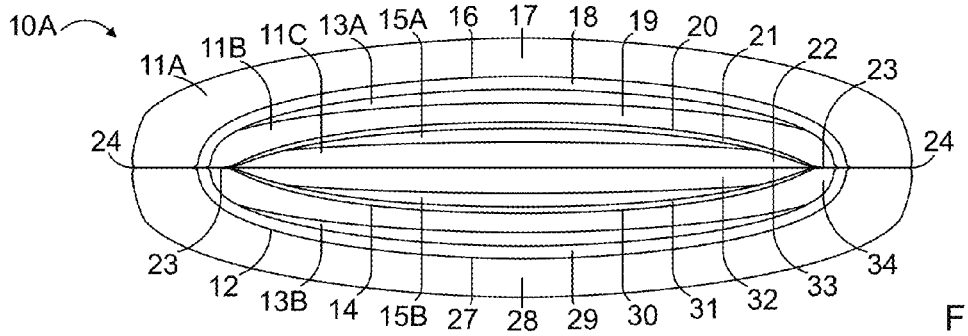
FIG. 9 depicts a side compartment opening view of the first embodiment of the Compartmented Cushioning Device, showing the principal outer component, the first inner component, and the second inner component, located one within the other; along with numbers with lead lines to point out individual parts that help make up its three components, four compartment openings, and four compartments.

FIG. 9 depicts a side compartment opening view of the first embodiment of the Compartmented Cushioning Device 10A, showing the principal outer component 11A, the first inner component 11B, and the second inner component 11C, located one within the other, thereby creating a total of four compartments. With the first inner component 11B, located within the primary compartment 13 of the principal outer component 11A; the primary compartment 13 is divided into the primary upper or front compartment 13A, and the primary lower or back compartment 13B. With the second inner component 11C, located within the secondary compartment 15 of the first inner component 11B; the secondary compartment 15 is divided into the secondary upper or front compartment 15A, and the secondary lower or back compartment 15B;

thereby creating a total of four compartments that can be reached through the primary compartment openings 12 or 12, which are located at both sides of the device, and provide access for a user's fingers, hands, wrists, or arms into the primary upper or front compartment 13A, and the primary lower or back compartment 13B; as well as the secondary upper or front compartment 15A, and the secondary lower or back compartment 15B, that can further be reached through the secondary compartment openings 14 or 14, which are also located at both sides of the device. This figure, as well as depicting a view of one each of the primary and secondary compartment openings 12 and 14, shown here at the front, depicts a view through each of the four primary and secondary compartments 13A, 13B, 15A, and 15B, that extend through the device, and out the primary or secondary compartment openings 12 or 14, which are located at the opposite side. The principal outer component 11A is constructed with an outer upper surface material 17, and an outer lower surface material 28, attached at both side edges by the means of seams 24 and 24, as well as attached to the inner upper surface material 18, and the inner lower surface material 29, by the means of seams 16 and 27, where they meet at both side primary compartment openings 12 and 12. In addition, the inner upper surface material 18, and the inner lower surface material 29, are attached to each other at both side edges, initially by the means of seams 24 and 24, where they meet at the primary compartment openings 12 and 12, as well as internally, by the means of seams 26 and 26, which due to their interior location, are shown in the cross section view as depicted in FIG. 10. The first inner component 11B is constructed with an outer upper surface material 19, and an outer lower surface material 34, attached at both side edges by the means of seams 23 and 23, as well as attached to the inner upper surface material 21, and the inner lower surface material 31, by the means of seams 20 and 30, where they meet at both side secondary compartment openings 14 and 14. In addition, the inner upper surface material 21, and the inner lower surface material 31, are attached to each other at both side edges, initially by the means of seams 23 and 23, where they meet at the secondary compartment openings 14 and 14, as well as internally, by the means of seams 25 and 25, which due to their interior location, are shown in the cross section view as depicted in FIG. 10. The second inner component 11C is constructed with an upper surface material 22, and a lower surface material 32, attached by the means of a seam 33. It should be noted that the surface materials 17 and 28 can be two or more separate pieces of material attached to each other; or, they can be one continuous piece, attached by the means of seams at each of the rounded and tapered corners, as well as at one end only. The same applies to the surface materials 18 and 29, 19 and 34, and 21 and 31; as well as 22 and 32, which additionally would be attached at its sides.

FIG. 10 depicts a side-to-side cross section view of the first embodiment of the Compartmented Cushioning Device 10A, showing the principal outer component 11A, the first inner component 11B, and the second inner component 11C, located one within the other, thereby creating a total of four compartments: the two primary compartments 13A and 13B, and the two secondary compartments 15A and 15B. The filler material 37, of the principal outer component 11A, between surface materials 17 and 28, along with 18 and 29, can be a conventional filler material, such as cotton, down, or foam; although a wide variety of other natural and/or synthetic materials are available. The filler material 36, of the first inner component 11B, between surface materials 19 and 34, along with 21 and 31, can be the same as 37, or of a different composition. The filler material 35, of the second inner component 11C, between surface materials 22 and 32, can be the same as 36 or 37, or of a different composition. In addition, the filler materials 35, 36, and 37, can be composed of one type of filler material, or of two or more types of filler material; which can be comprised of separated elements, connected elements, or of one continuous piece. By varying the types of materials within the Compartmented Cushioning Device 10A, it can produce a cool or a warm feeling for the user. The outer upper surface material 17, along with the surface materials 18, 19, 29, and 34, on both sides of the primary compartments 13A and 13B, can be a cool feeling material, such as cotton or linen; while the outer lower surface material 28, along with the surface materials 21, 22, 31, and 32, on both sides of the secondary compartments 15A and 15B, can be a warm feeling material, such as fleece or wool. In an alternate configuration, the surface materials 18, 19, 29, and 34, on both sides of the primary compartments 13A and 13B can be a warm feeling material, such as fleece or wool; while the surface materials 21, 22, 31, and 32, on both sides of the secondary compartments 15A and 15B, can be a cool feeling material, such as cotton or linen. With a wide variety of combinations, a user can place one or both of their hands or arms into either the same or separate compartments, with varied effects. In configurations as those described above, offering two cool feeling compartments, along with two warm feeling compartments; the user will be able to place one or both of their hands or arms into the same or different cool feeling compartments, to keep them as cool as possible, or into the same or different warm feeling compartments, to maintain or increase their warmth. When the temperature in a compartment is too cool, or becomes too warm, the user will be able to switch to a warmer or a cooler feeling compartment, thereby allowing them to attain a greater potential level of comfort. As an option, the outer upper surface material 17, together with the outer lower surface material 28, can be the same cool feeling or warm feeling surface material, thereby allowing the device to be configured for decorative, as well as seasonal purposes. Please see cross section reference arrows 10 and 10, in FIG. 7, to see the location and direction of the side-to-side cross section view as depicted in this figure.

Figure 11:
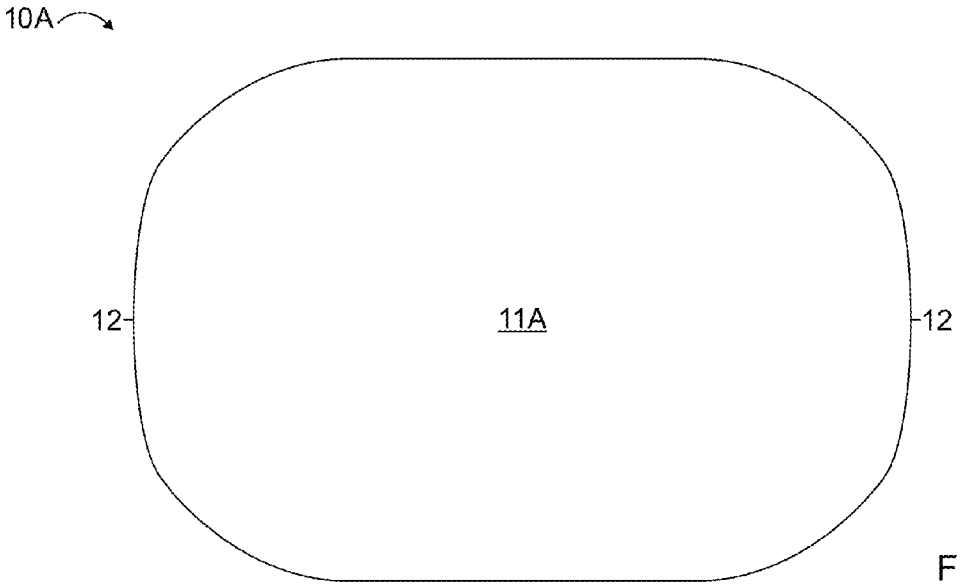
FIG. 11 depicts a top/front view of the first embodiment of the Compartmented Cushioning Device, showing the principal outer component, with the first and the second inner components located within; along with numbers with lead lines to point out the location of its two matching compartment openings, which are located at opposite sides of the device.

FIG. 11 depicts a top/front view of the first embodiment of the Compartmented Cushioning Device 10A, showing the principal outer component 11A, with the first and the second inner components located within; along with numbers with lead lines to point out the location of its two matching primary compartment openings 12 and 12, which are located at opposite sides of the device. In addition, this figure depicts the rounded and tapered corners, located at each side of the primary compartment openings 12 and 12, which have been designed for ergonomic comfort, utility, and visual appeal. It should be noted that the view of the embodiment as depicted in this figure, can be described as either a top or front view, depending upon the position of the embodiment, as well as the perspective of the viewer. It should also be noted that the bottom, which can also be referred to as the back, is a match to the top/front of the embodiment, although it can be different.

Figure 12:
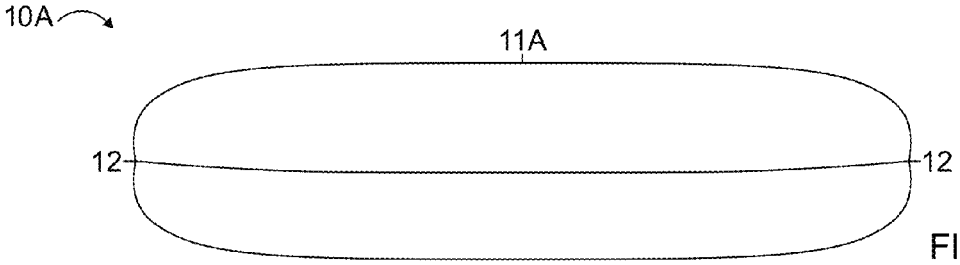
FIG. 12 depicts a side edge view of the first embodiment of the Compartmented Cushioning Device, showing the principal outer component, with the first and the second inner components located within; along with numbers with lead lines to point out the location of its two matching compartment openings, which are located at opposite sides of the device.

FIG. 12 depicts a side edge view of the first embodiment of the Compartmented Cushioning Device 10A, showing the principal outer component 11A, with the first and the second inner components located within; along with numbers with lead lines to point out the location of its two matching primary compartment openings 12 and 12, which are located at opposite sides of the device. It should be noted that the opposite side edge, is a match to the one as depicted in this figure, although it can be different.

Figure 13:
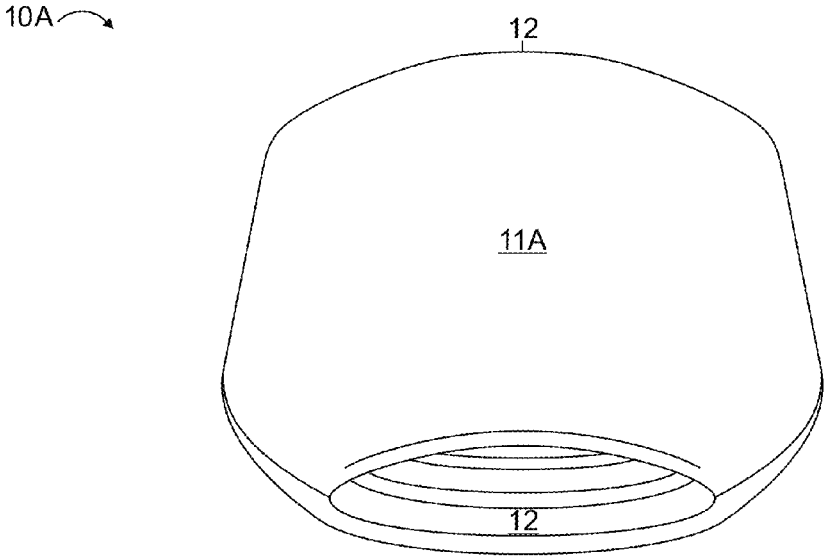
FIG. 13 depicts a top-side perspective view of the first embodiment of the Compartmented Cushioning Device, showing the principal outer component, with the first and the second inner components located within; along with numbers, with underlines or lead lines, to indicate or point out the location of its two matching compartment openings, which are located at opposite sides of the device; as well as a view into one of the compartment openings, shown here at the front, thereby revealing portions of the first and the second inner components.

FIG. 13 depicts a top-side perspective view of the first embodiment of the Compartmented Cushioning Device 10A, showing the principal outer component 11A, with the first and the second inner components located within; along with numbers, with underlines or lead lines, to indicate or point out the location of its two matching primary compartment openings 12 and 12, which are located at opposite sides of the device; as well as a view into one of the primary compartment openings 12, shown here at the front, thereby revealing portions of the first and the second inner components. In addition, this figure depicts the rounded and tapered corners, located at each side of the primary compartment openings 12 and 12, which have been designed for ergonomic comfort, utility, and visual appeal.

Figure 14:
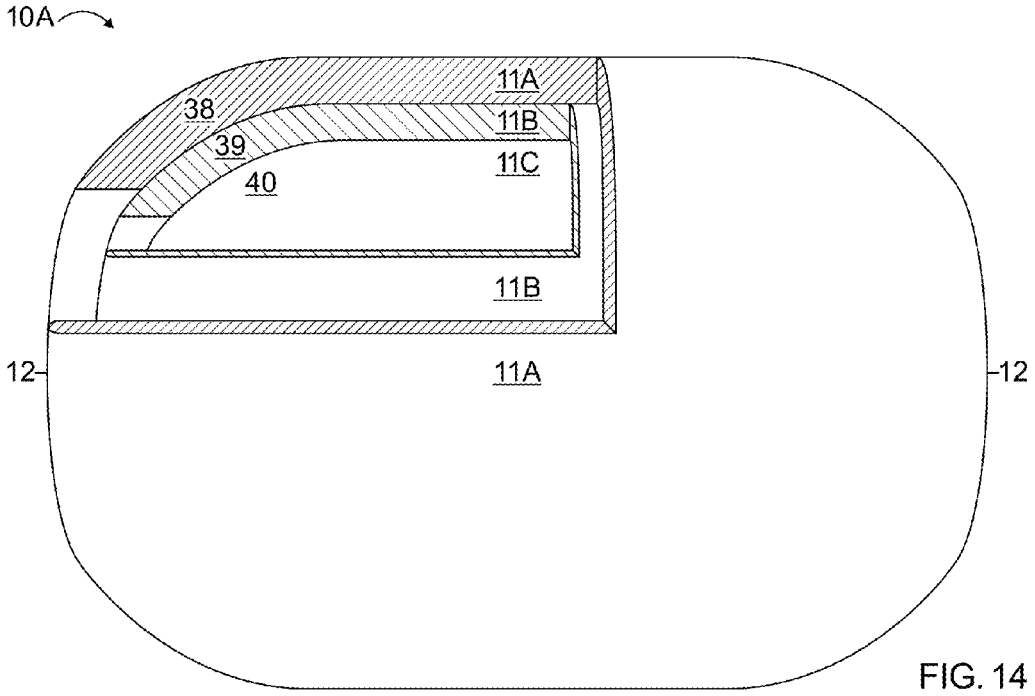
FIG. 14 depicts a top/front cut-away view of the first embodiment of the Compartmented Cushioning Device, showing the principal outer component and the first inner component, each with a corner portion of their upper cushioning layer cut away, revealing the second inner component located within; along with portions each of their respective compartment openings and/or sides, as well as one rounded comfort-lock-in taper, one rounded fit-in-lock-in taper, and one rounded fit-in taper. Also depicted, are numbers with lead lines, to point out the location of the principal outer component's two matching compartment openings.

FIG. 14 depicts a top/front cut-away view of the first embodiment of the Compartmented Cushioning Device 10A, showing the principal outer component 11A and the first inner component 11B, each with a corner portion of their upper cushioning layer cut away, revealing the second inner component 11C located within; along with portions each of their respective compartment openings and/or sides. Also depicted, with underlined numbers to indicate their locations, are one rounded comfort-lock-in taper 38, one rounded fit-in-lock-in taper 39, and one rounded fit-in taper 40, which form the rounded corners respectively of the principal outer component 11A, the first inner component 11B, and the second inner component 11C; where they work together, along with the compartment openings, to allow the first inner component 11B, to fit and lock releasably within the principal outer component 11A; as well as to allow the second inner component 11C, to fit and lock releasably within the first inner component 11B. Further depicted, are numbers with lead lines, to point out the location of the two primary compartment openings 12 and 12, of the principal outer component 11A. A detailed explanation about the rounded and tapered corners, and how they work together, along with the compartment openings, will follow.

Figure 15:
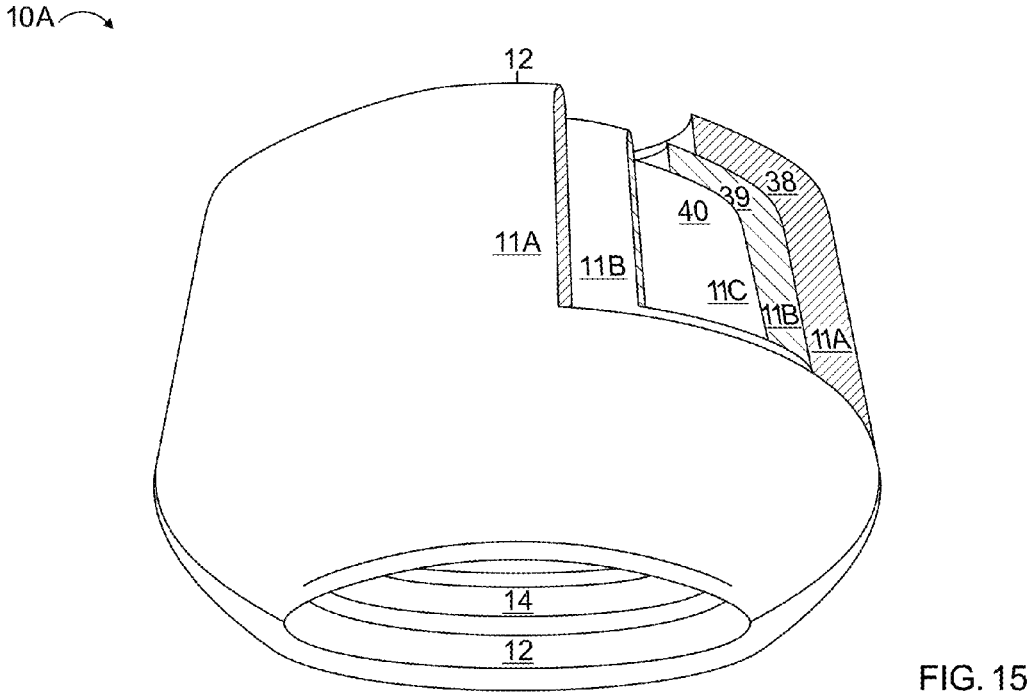
FIG. 15 depicts a top-side perspective cut-away view of the first embodiment of the Compartmented Cushioning Device as depicted and described in FIG. 14; although, turned clockwise 90 degrees, and tilted back, for an alternate and further revealing view of the embodiment's components and compartment openings.

FIG. 15 depicts a top-side perspective cut-away view of the first embodiment of the Compartmented Cushioning Device 10A as depicted and described in FIG. 14; although, turned clockwise 90 degrees, and tilted back, for an alternate view of the embodiment; thereby providing a further revealing view of the principal outer component 11A, the first inner component 11B, and the second inner component 11C; including a perspective into one each of the primary and secondary compartment openings 12 and 14, shown here at the front with underlined numbers, along with a partial perspective of those shown at the opposite side.

FIG. 16 depicts a top/front to bottom/back cut-away view of the first embodiment of the Compartmented Cushioning Device 10A, showing the principal outer component 11A and the first inner component 11B, each with their entire upper cushioning layer cut away, revealing the second inner component 11C located within; along with each of their respective primary or secondary compartment openings 12, 12, 14, or 14, primary or secondary compartments 13 or 15, and/or sides. Depicted with underlined numbers to indicate their locations, are the primary and secondary compartment openings 12, 12, 14, and 14, forming the two rounded sides respectively of the principal outer component 11A and the first inner component 11B; as well as four rounded comfort-lock-in tapers 38, 38, 38, and 38, four rounded fit-in-lock-in tapers 39, 39, 39, and 39, and four rounded fit-in tapers 40, 40, 40, and 40, which form the four rounded corners respectively of the principal outer component 11A, the first inner component 11B, and the second inner component 11C. The principal outer component 11A has two matching primary compartment openings 12 and 12, located at opposite sides of the device, which allow access, through either side, into its primary compartment 13. The principal outer component 11A is sized and shaped with four rounded comfort-lock-in tapers 38, 38, 38, and 38, so that the perimeters of the primary compartment openings 12 and 12 are smaller than all or part of the parallel perimeters of the primary compartment 13. In turn, the first inner component 11B is sized and shaped with four rounded fit-in-lock-in tapers 39, 39, 39, and 39, conforming to the size and shape of the primary compartment 13, thereby allowing it to fit and lock releasably and securely into place once inside. The four rounded comfort-lock-in tapers 38, 38, 38, and 38, by reducing the perimeters of the two primary compartment openings 12 and 12, as compared respectively to all or part of the parallel perimeters of the primary compartment 13, work together, to lock in the first inner component 11B, within the primary compartment 13, of the principal outer component 11A. The first inner component 11B has two matching secondary compartment openings 14 and 14, located at opposite sides of the device, which allow access, through either side, into its secondary compartment 15. The first inner component 11B is sized and shaped with four rounded fit-in-lock-in tapers 39, 39, 39, and 39, so that the perimeters of the secondary compartment openings 14 and 14 are smaller than all or part of the parallel perimeters of the secondary compartment 15. In turn, the second inner component 11C is sized and shaped with four rounded fit-in tapers 40, 40, 40, and 40, conforming to the size and shape of the secondary compartment 15, thereby allowing it to fit and lock releasably and securely into place once inside. The four rounded fit-in-lock-in tapers 39, 39, 39, and 39, by reducing the perimeters of the two secondary compartment openings 14 and 14, as compared respectively to all or part of the parallel perimeters of the secondary compartment 15, work together, to lock in the second inner component 11C, within the secondary compartment 15, of the first inner component 11B. With the first inner component 11B folded, it can easily be inserted through either primary compartment opening 12 or 12, to be placed within the primary compartment 13, of the principal outer component 11A. Once inside and fully extended, it will fit and lock releasably and securely into place within the primary compartment 13, and will not fall out. The larger perimeters of the primary compartment 13, combined with the smaller parallel perimeters of the primary compartment openings 12 and 12, work together, to lock in the first inner component 11B, within the primary compartment 13, of the principal outer component 11A. This design feature partially encases and securely retains the first inner component 11B, within the primary compartment 13, while still allowing it to easily be released. Equally, with the second inner component 11C folded, it can easily be inserted through either secondary compartment opening 14 or 14, to be placed within the secondary compartment 15, of the first inner component 11B. Once inside and fully extended, it will fit and lock releasably and securely into place within the secondary compartment 15, and will not fall out. The larger perimeters of the secondary compartment 15, combined with the smaller parallel perimeters of the secondary compartment openings 14 and 14, work together, to lock in the second inner component 11C, within the secondary compartment 15, of the first inner component 11B. This design feature partially encases and securely retains the second inner component 11C, within the secondary compartment 15, while still allowing it to easily be released. Please see cut-away reference arrows 16 and 16, in FIG. 8, to see the location and direction of the top/front to bottom/back cut-away view as depicted in this figure.

Figure 17:
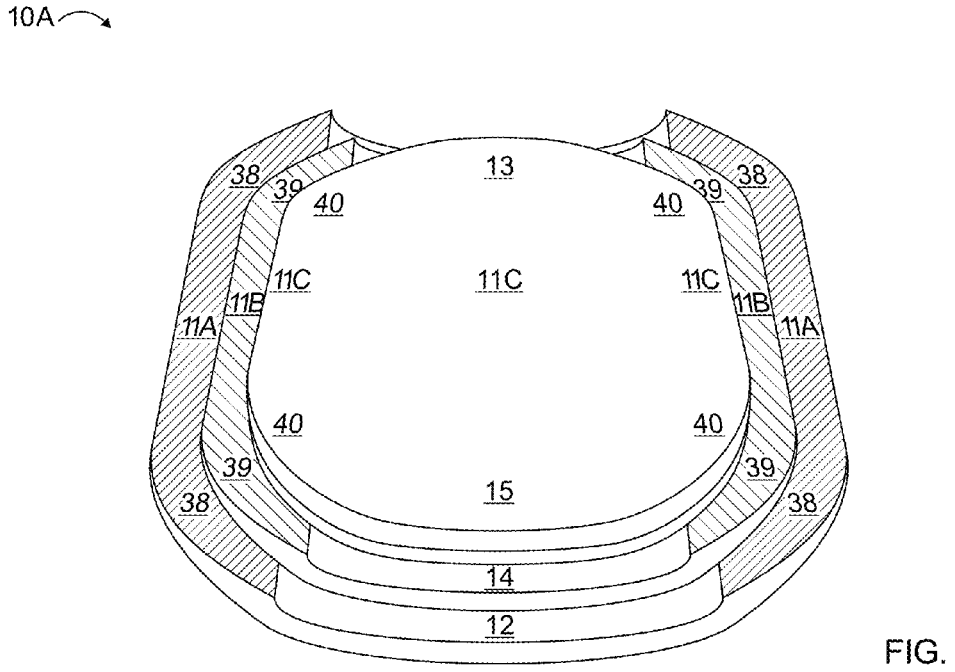
FIG. 17 depicts a top-side perspective cut-away view of the first embodiment of the Compartmented Cushioning Device as depicted and described in FIG. 16; although, turned clockwise 90 degrees, and tilted back, for an alternate and further revealing view of the embodiment's components, compartment openings, and compartments.

FIG. 17 depicts a top-side perspective cut-away view of the first embodiment of the Compartmented Cushioning Device 10A as depicted and described in FIG. 16; although, turned clockwise 90 degrees, and tilted back, for an alternate view of the embodiment; thereby providing a further revealing view of the principal outer component 11A, the first inner component 11B, and the second inner component 11C; including a perspective of one each of the primary and secondary compartment openings 12 and 14, shown here at the front, along with a partial perspective of those shown at the opposite side.

Figure 18:
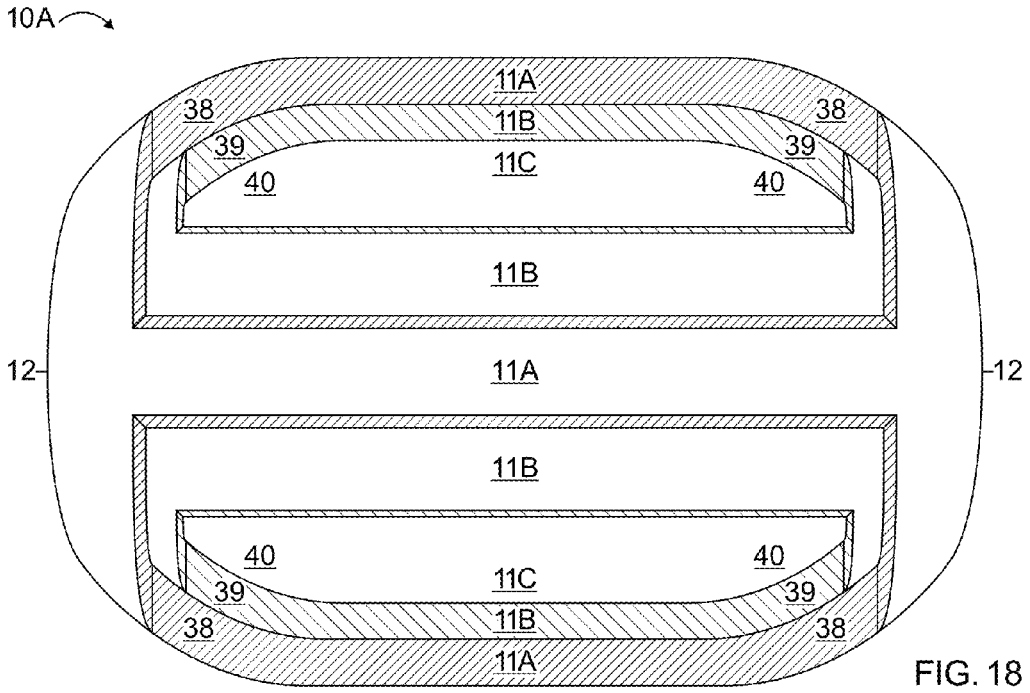
FIG. 18 depicts a top/front cut-away view of the first embodiment of the Compartmented Cushioning Device, showing the principal outer component and the first inner component, each with two side portions of their upper cushioning layers cut away, revealing portions of the second inner component located within; along with portions each of their respective sides, as well as four rounded comfort-lock-in tapers, four rounded fit-in-lock-in tapers, and four rounded fit-in tapers. Also depicted, are numbers with lead lines, to point out the location of the principal outer component's two matching compartment openings.

FIG. 18 depicts a top/front cut-away view of the first embodiment of the Compartmented Cushioning Device 10A, showing the principal outer component 11A, and the first inner component 11B, each with two side portions of their upper cushioning layers cut away, leaving small portions directly above each of their respective primary or secondary compartment openings, thereby revealing two side portions of the principal outer component 11A, along with its four rounded comfort-lock-in tapers 38, 38, 38, and 38; with the areas at the outside of these rounded and tapered corners, which provide comfort for the user when placed against their body; as well as the areas at their inside, which lock-in the first inner component 11B, within the principal outer component 11A. Also revealed, are two side portions of the first inner component 11B, along with its four rounded fit-in-lock-in tapers 39, 39, 39, and 39; with the areas at the outside of these rounded and tapered corners, which allow the first inner component 11B, to fit-in and lock releasably within the principal outer component 11A; as well as the areas at their inside, which lock-in the second inner component 11C, within the first inner component 11B. Further revealed, are two side portions of the second inner component 11C, along with its four rounded fit-in tapers 40, 40, 40, and 40; with the areas at the outside of these rounded and tapered corners, which allow the second inner component 11C, to fit-in and lock releasably within the first inner component 11B. Also depicted, are numbers with lead lines, to point out the location of the two primary compartment openings 12 and 12, of the principal outer component 11A.

Figure 19:
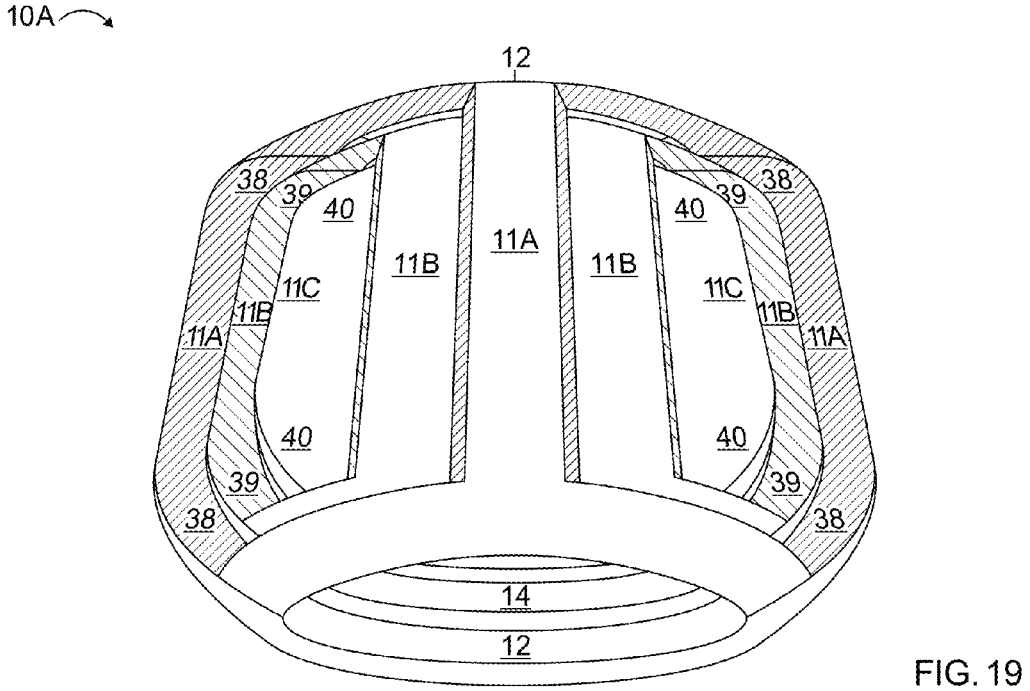
FIG. 19 depicts a top-side perspective cut-away view of the first embodiment of the Compartmented Cushioning Device as depicted and described in FIG. 18; although, turned clockwise 90 degrees, and tilted back, for an alternate and further revealing view of the embodiment's components and compartment openings.

FIG. 19 depicts a top-side perspective cut-away view of the first embodiment of the Compartmented Cushioning Device 10A as depicted and described in FIG. 18; although, turned clockwise 90 degrees, and tilted back, for an alternate view of the embodiment; thereby providing a further revealing view of the principal outer component 11A, the first inner component 11B, and the second inner component 11C; including a perspective into one each of the primary and secondary compartment openings 12 and 14, shown here at the front with underlined numbers, along with a partial perspective of those shown at the opposite side. This figure further illustrates that the second inner component 11C, fits and locks into the first inner component 11B, while the first inner component 11B, fits and locks into the principal outer component 11A. It should be noted that it is because of the flexibility of the filler materials and surface materials, combined with the rounded comfort-lock-in tapers 38, 38, 38, and 38, fit-in-lock-in tapers 39, 39, 39, and 39, and fit-in tapers 40, 40, 40, and 40; which allow the first inner component 11B to be folded, inserted into the smaller sized primary compartment openings 12 or 12, of the principal outer component 11A, and once inside, fully extended to fit and lock releasably and securely into place; as well as allow the second inner component 11C to be folded, inserted into the smaller sized secondary compartment openings 14 or 14, of the first inner component 11B, and once inside, fully extended to also fit and lock releasably and securely into place.

Figure 20:
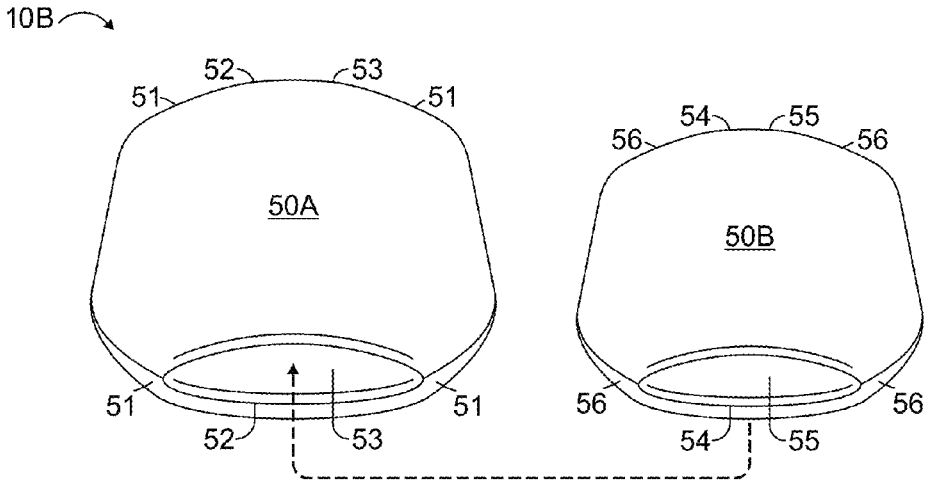
FIG. 20 depicts a top-side perspective view of the second embodiment of the Compartmented Cushioning Device in a rounded corner elongated octagon configuration, and designed for use in multiple applications. It is shown here with its two components: the principal outer component, and the single inner component, each with two compartment openings and one compartment, with each component shown separated from the other; as well as with a dashed line arrow to illustrate that the smaller component has been designed to fit within the larger one.

FIG. 20 depicts a top-side perspective view of the second embodiment of the Compartmented Cushioning Device 10B in a rounded corner elongated octagon configuration, and designed for use in multiple applications. It is shown here with its two components: the principal outer component 50A, and the single inner component 50B, with each component shown separated from the other. The single inner component 50B is sized and shaped, to fit within the primary compartment 53, of the principal outer component 50A. The dashed line arrow in this figure has been included to indicate the direction, movement, and placement within the principal outer component 50A, of the single inner component 50B; illustrating that the smaller component has been designed to fit within the larger one. The principal outer component 50A has two matching primary compartment openings 52 and 52, located at opposite sides of the device, which allow access, through either side, into its primary compartment 53. The principal outer component 50A is sized and shaped with four rounded comfort-lock-in tapers 51, 51, 51, and 51, so that the perimeters of the primary compartment openings 52 and 52 are smaller than all or part of the parallel perimeters of the primary compartment 53. In turn, the single inner component 50B is sized and shaped with four rounded fit-in-comfort tapers 56, 56, 56, and 56, conforming to the size and shape of the primary compartment 53, thereby allowing it to fit and lock releasably and securely into place once inside. The four rounded comfort-lock-in tapers 51, 51, 51, and 51, by reducing the perimeters of the two primary compartment openings 52 and 52, as compared respectively to all or part of the parallel perimeters of the primary compartment 53, work together, to lock in the single inner component 50B, within the primary compartment 53, of the principal outer component 50A. The single inner component 50B has two matching secondary compartment openings 54 and 54, located at opposite sides of the device, which allow access, through either side, into its secondary compartment 55. The single inner component 50B is sized and shaped with four rounded fit-in-comfort tapers 56, 56, 56, and 56, so that the perimeters of the secondary compartment openings 54 and 54 are smaller than all or part of the parallel perimeters of the secondary compartment 55. With the single inner component 50B folded, it can easily be inserted through either primary compartment opening 52 or 52, to be placed within the primary compartment 53, of the principal outer component 50A. Once inside and fully extended, it will fit and lock releasably and securely into place within the primary compartment 53, and will not fall out. The larger perimeters of the primary compartment 53, combined with the smaller parallel perimeters of the primary compartment openings 52 and 52, work together, to lock in the single inner component 50B, within the primary compartment 53, of the principal outer component 50A. This design feature partially encases and securely retains the single inner component 50B, within the primary compartment 53, while still allowing it to easily be released. The four rounded fit-in-comfort tapers 56, 56, 56, and 56, are also very helpful in the retention of the shape of the embodiment; by maintaining the position of the interior surface materials, relative to the exterior surface materials; as well as the position of the surface materials, relative to the filler materials. In addition, this feature also creates an ergonomic design at the interior for the user's fingers, hands, wrists, or arms, thus further enhancing their potential level of comfort and control.

Figure 21:
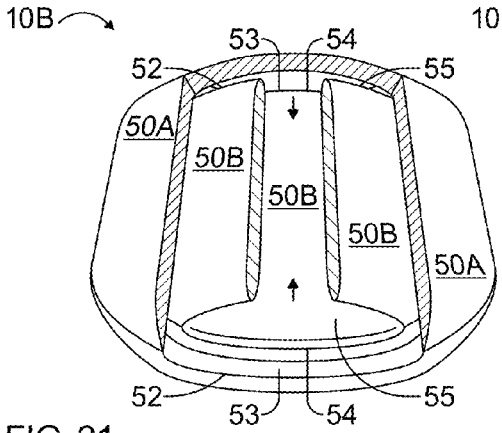
FIG. 21 depicts a top-side perspective cut-away view of the second embodiment of the Compartmented Cushioning Device showing the principal outer component, with a center portion of its upper cushioning layer cut away, revealing portions of its two compartment openings, its compartment, and the single inner component located within; also shown with a center portion of its upper cushioning layer cut away, to reveal portions of its two compartment openings and its compartment.

FIG. 21 depicts a top-side perspective cut-away view of the second embodiment of the Compartmented Cushioning Device 10B, showing the principal outer component 50A, with a center portion of its upper cushioning layer cut away, revealing a portion of the single inner component 50B, fitted and locked releasably within the primary compartment 53. The single inner component 50B is depicted with a center portion of its upper cushioning layer cut away, to reveal a portion of the secondary compartment 55, which forms the center of the Compartmented Cushioning Device 10B. The principal outer component 50A is depicted with a center portion of its upper cushioning layer cut away, from and including its entire primary compartment opening 52, shown here at the front, then cut all the way back, leaving a small portion of the cushioning layer directly above its opposite side primary compartment opening 52, thereby allowing portions of its two primary compartment openings 52 and 52 to be observed. The single inner component 50B is depicted with a center portion of its upper cushioning layer cut away, from and including a portion of its secondary compartment opening 54, shown here at the front, then cut all the way back, including a portion of its opposite side secondary compartment opening 54, thereby allowing portions of its two secondary compartment openings 54 and 54 to be observed. The two arrows in this figure that are located at the center, and floating within the secondary compartment 55, are included to indicate the paths for placement and removal from either side of the single inner component 50B, into and out of the primary compartment 53; as well as of a chemical, electric, or electronic device, into and out of the secondary compartment 55. These two arrows also serve to show the paths for movement of a user's fingers, hands, wrists, or arms, into, out of, or through the device. It should be noted that the single inner component 50B, can be attached permanently to the principal outer component 50A; or, it can be attached releasably and removable, or detached completely and removable from it as well.

Figure 22:
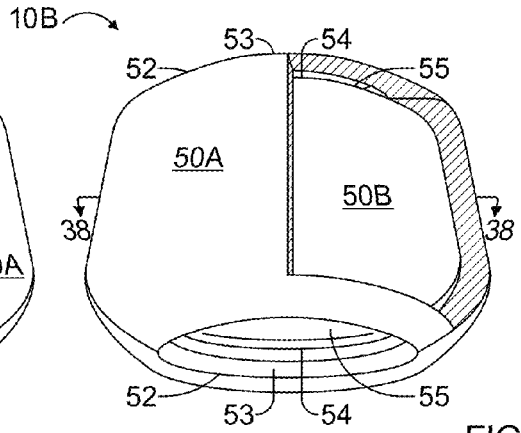
FIG. 22 depicts a top-side perspective cut-away view of the second embodiment of the Compartmented Cushioning Device showing the principal outer component, with a side portion of its upper cushioning layer cut away, to reveal portions of its two compartment openings, its compartment, and the single inner component located within.
Figure 38:
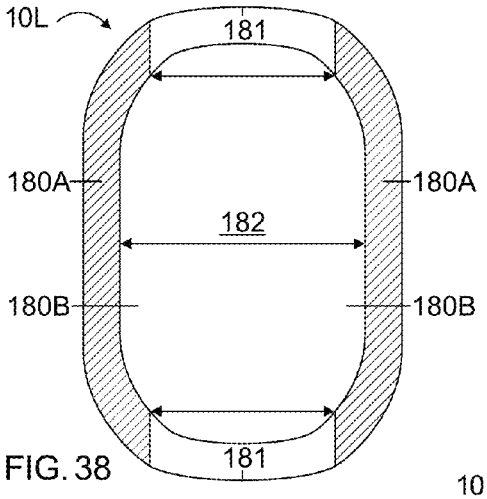
FIG. 38 depicts a top/front to bottom/back cut-away view of the twelfth embodiment of the Compartmented Cushioning Device, showing the principal outer component, with its entire upper cushioning layer cut away, revealing portions of its two compartment openings, its compartment, and the inner component located within; with the purpose of depicting and/or describing manners in which the components of the Compartmented Cushioning Device 10B and 10C can be fitted and locked releasably, one to or by the other; as well as attached releasably, or attached permanently, one to the other, in alternate configurations.
Figure 41:
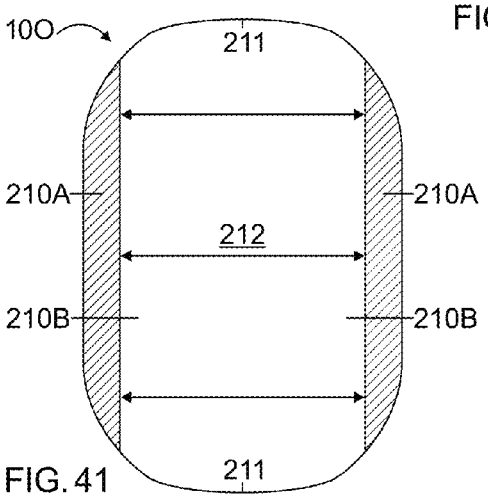
FIG. 41 depicts a top/front to bottom/back cut-away view of the fifteenth embodiment of the Compartmented Cushioning Device, showing the principal outer component, with its entire upper cushioning layer cut away, revealing portions of its two compartment openings, its compartment, and the inner component located within; with the purpose of depicting and/or describing manners in which the components of the Compartmented Cushioning Device 10B and 10C can be fitted and locked releasably, attached releasably, or attached permanently, one to or by the other, in alternate configurations.
Figure 42:
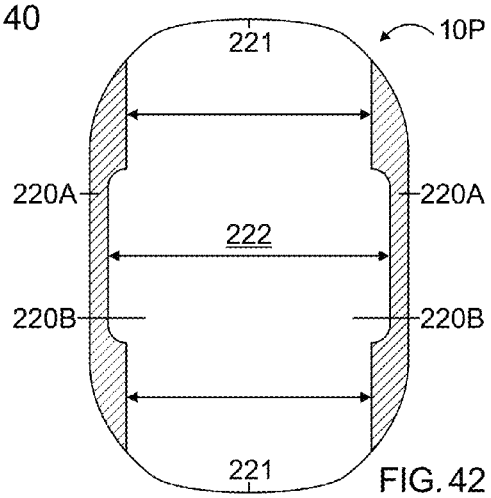
FIG. 42 depicts a top/front to bottom/back cut-away view of the sixteenth embodiment of the Compartmented Cushioning Device, showing the principal outer component, with its entire upper cushioning layer cut away, revealing portions of its two compartment openings, its compartment, and the inner component located within; with the purpose of depicting and/or describing manners in which the components of the Compartmented Cushioning Device 10B and 10C can be fitted and locked releasably, attached releasably, or attached permanently, one to or by the other, in alternate configurations.

FIG. 22 depicts a top-side perspective cut-away view of the second embodiment of the Compartmented Cushioning Device 10B, showing the principal outer component 50A, with a side portion of its upper cushioning layer cut away, leaving small portions directly above both side primary compartment openings 52 and 52, to reveal a portion of the single inner component 50B located within. This figure illustrates the manner in which the single inner component 50B, is fitted and locked releasably within the primary compartment 53, of the principal outer component 50A. In addition, this figure provides an alternate and further revealing view of the primary compartment openings 52 and 52, of the principal outer component 50A; as well as cut-away reference arrows 38 and 38, to show the location and direction of the top/front to bottom/back cut-away views as depicted in FIG. 38, FIG. 41, and FIG. 42.

Figure 23:
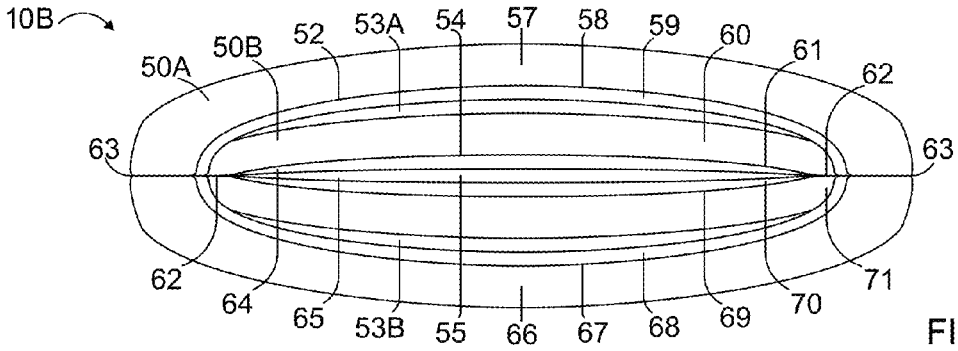
FIG. 23 depicts a side compartment opening view of the second embodiment of the Compartmented Cushioning Device, showing the principal outer component, and the single inner component, located one within the other; along with numbers with lead lines to point out individual parts that help make up its two components, four compartment openings, and three compartments.

FIG. 23 depicts a side compartment opening view of the second embodiment of the Compartmented Cushioning Device 10B, showing the principal outer component 50A, and the single inner component 50B, located one within the other, thereby creating a total of three compartments. With the single inner component 50B, located within the primary compartment 53 of the principal outer component 50A; the primary compartment 53 is divided into a primary upper or front compartment 53A, and a primary lower or back compartment 53B. The single inner component 50B is designed with a single secondary compartment 55; thereby creating a total of three compartments that can be reached through the primary compartment openings 52 or 52, which are located at both sides of the device, and provide access for a user's fingers, hands, wrists, or arms into the primary upper or front compartment 53A, and the primary lower or back compartment 53B; as well as the single secondary compartment 55, that can further be reached through the secondary compartment openings 54 or 54, which are also located at both sides of the device. This figure, as well as depicting a view of one each of the primary and secondary compartment openings 52 and 54, shown here at the front, depicts a view through each of the three primary and secondary compartments 53A, 53B, and 55, that extend through the device, and out the primary or secondary compartment openings 52 or 54, which are located at the opposite side. The principal outer component 50A is constructed with an outer upper surface material 57, and an outer lower surface material 66, attached at both side edges by the means of seams 63 and 63, as well as attached to the inner upper surface material 59, and the inner lower surface material 68, by the means of seams 58 and 67, where they meet at both side primary compartment openings 52 and 52. In addition, the inner upper surface material 59, and the inner lower surface material 68, are attached to each other at both side edges, initially by the means of seams 63 and 63, where they meet at the primary compartment openings 52 and 52, as well as internally, by the means of two additional seams, which due to their interior location, are not shown in this figure. The single inner component 50B is constructed with an outer upper surface material 60, and an outer lower surface material 71, attached at both side edges by the means of seams 62 and 62, as well as attached to the inner upper surface material 64, and the inner lower surface material 70, by the means of seams 61 and 69, where they meet at both side secondary compartment openings 54 and 54. In addition, the inner upper surface material 64, and the inner lower surface material 70, are attached to each other at both side edges, initially by the means of seams 62 and 62, where they meet at the secondary compartment openings 54 and 54, as well as internally, by the means of two additional seams, which due to their interior location, are not shown in this figure. It should be noted that the surface materials 57 and 66 can be two or more separate pieces of material attached to each other; or, they can be one continuous piece, attached by the means of seams at each of the rounded and tapered corners, as well as at one end only. The same applies to the surface materials 59 and 68, 60 and 71, and 64 and 70. By varying the types of materials within the Compartmented Cushioning Device 10B, it can produce a cool or a warm feeling for the user. The outer upper surface material 57, along with the surface materials 64 and 70 on both sides of the secondary compartment 55, can be a cool feeling material, such as cotton or linen; while the outer lower surface material 66, along with the surface materials 59, 60, 68, and 71, on both sides of the primary compartments 53A and 53B, can be a warm feeling material, such as fleece or wool. In an alternate configuration, the surface materials 59, 60, 68, and 71, on both sides of the primary compartments 53A and 53B, can be a cool feeling material, such as cotton or linen; while the surface materials 64 and 70 on both sides of the secondary compartment 55, can be a warm feeling material, such as fleece or wool. With a wide variety of combinations, a user can place one or both of their hands or arms into either the same or separate compartments, with varied effects. A safe heating device, whether independently or custom made 65, can be placed within the secondary compartment 55 to warm its interior; as well as the interiors of the primary compartments 53A and 53B, thereby allowing the user to place their hands or arms into their interiors for added warmth. In addition, a safe audio, heart beat simulation, or vibration device, whether independently or custom made 65, can be placed within the secondary compartment 55, to be utilized in combination with the cushioning device. It should be noted that embodiment 10B, in addition to differing from embodiment 10A by being comprised of three compartments, instead of four; also differs from it in that the cushioning layers are proportionally thicker than in embodiment 10A, along with being of equal thickness one to the other; although, they can vary in thickness as well.

Figure 24:
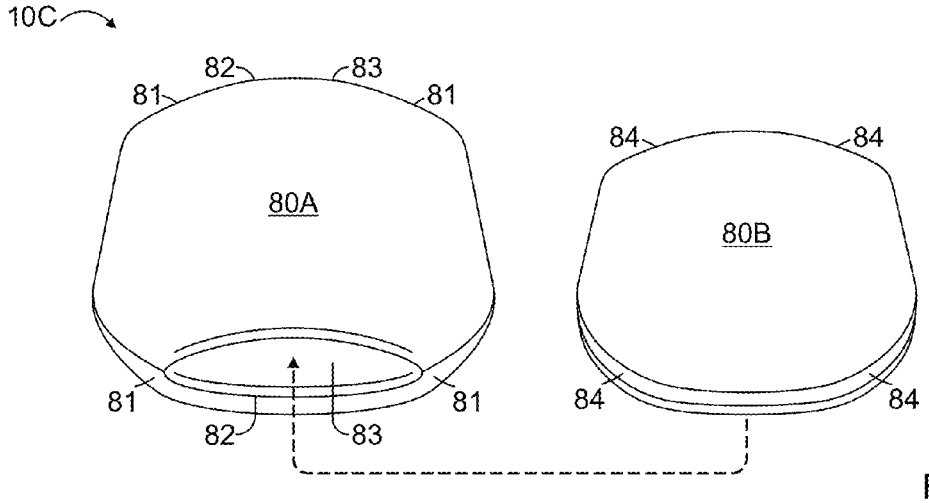
FIG. 24 depicts a top-side perspective view of the third embodiment of the Compartmented Cushioning Device in a rounded corner elongated octagon configuration, and designed for use in multiple applications. It is shown here with its two components: the principal outer component, with two compartment openings and one compartment, along with the single inner component, with each component shown separated from the other; as well as with a dashed line arrow to illustrate that the smaller component has been designed to fit within the larger one.

FIG. 24 depicts a top-side perspective view of the third embodiment of the Compartmented Cushioning Device 10C in a rounded corner elongated octagon configuration, and designed for use in multiple applications. It is shown here with its two components: the principal outer component 80A, and the single inner component 80B, with each component shown separated from the other. The single inner component 80B is sized and shaped, to fit within the primary compartment 83, of the principal outer component 80A. The dashed line arrow in this figure has been included to indicate the direction, movement, and placement within the principal outer component 80A, of the single inner component 80B; illustrating that the smaller component has been designed to fit within the larger one. The principal outer component 80A has two matching primary compartment openings 82 and 82, located at opposite sides of the device, which allow access, through either side, into its primary compartment 83. The principal outer component 80A is sized and shaped with four rounded comfort-lock-in tapers 81, 81, 81, and 81, so that the perimeters of the primary compartment openings 82 and 82 are smaller than all or part of the parallel perimeters of the primary compartment 83. In turn, the single inner component 80B is sized and shaped with four rounded fit-in tapers 84, 84, 84, and 84, conforming to the size and shape of the primary compartment 83, thereby allowing it to fit and lock releasably and securely into place once inside. The four rounded comfort-lock-in tapers 81, 81, 81, and 81, by reducing the perimeters of the two primary compartment openings 82 and 82, as compared respectively to all or part of the parallel perimeters of the primary compartment 83, work together, to lock in the single inner component 80B, within the primary compartment 83, of the principal outer component 80A. With the single inner component 80B folded, it can easily be inserted through either primary compartment opening 82 or 82, to be placed within the primary compartment 83, of the principal outer component 80A. Once inside and fully extended, it will fit and lock releasably and securely into place within the primary compartment 83, and will not fall out. The larger perimeters of the primary compartment 83, combined with the smaller parallel perimeters of the primary compartment openings 82 and 82, work together, to lock in the single inner component 80B, within the primary compartment 83, of the principal outer component 80A. This design feature partially encases and securely retains the single inner component 80B, within the primary compartment 83, while still allowing it to easily be released.

Figure 25:
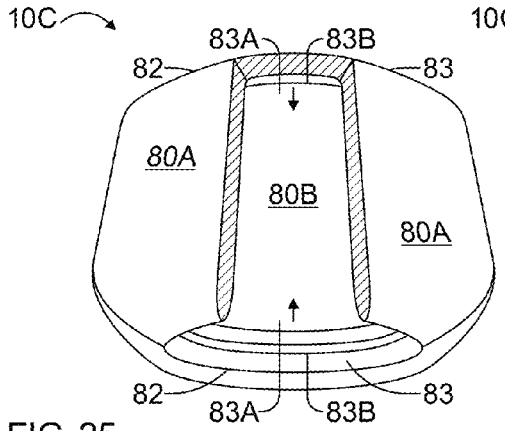
FIG. 25 depicts a top-side perspective cut-away view of the third embodiment of the Compartmented Cushioning Device showing the principal outer component, with a center portion of its upper cushioning layer cut away, to reveal portions of its two compartment openings, its compartment, and the single inner component located within.

FIG. 25 depicts a top-side perspective cut-away view of the third embodiment of the Compartmented Cushioning Device 10C, showing the principal outer component 80A, with a center portion of its upper cushioning layer cut away, revealing a portion of the single inner component 80B, fitted and locked releasably within the primary compartment 83, thus forming the center of the Compartmented Cushioning Device 10C. The principal outer component 80A is depicted with a center portion of its upper cushioning layer cut away, from and including a portion of its primary compartment opening 82, shown here at the front, then cut all the way back, leaving a small portion of the cushioning layer directly above its opposite side primary compartment opening 82, thereby allowing portions of its two primary compartment openings 82 and 82 to be observed. With the single inner component 80B, located within the primary compartment 83 of the principal outer component 80A; the primary compartment 83 is divided into a primary upper or front compartment 83A, and a primary lower or back compartment 83B. The two arrows in this figure that are located at the center, floating within the primary upper or front compartment 83A, and above the single inner component 80B, are included to indicate the paths for placement and removal from either side of the single inner component 80B, into and out of the primary compartment 83. These two arrows also serve to show the paths for movement of a user's fingers, hands, wrists, or arms, into, out of, or through the device. It should be noted that the single inner component 80B, can be attached permanently to the principal outer component 80A; or, it can be attached releasably and removable, or detached completely and removable from it as well.

Figure 26:
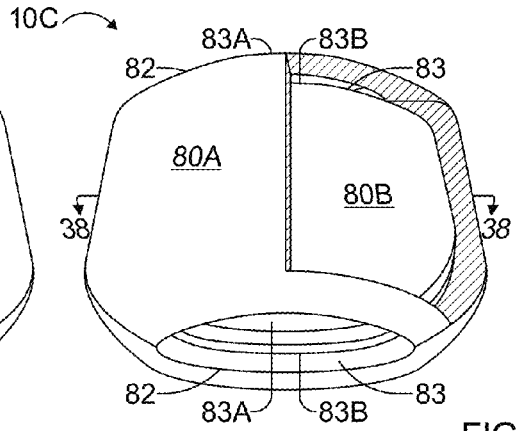
FIG. 26 depicts a top-side perspective cut-away view of the third embodiment of the Compartmented Cushioning Device showing the principal outer component, with a side portion of its upper cushioning layer cut away, to reveal portions of its two compartment openings, its compartment, and the single inner component located within.

FIG. 26 depicts a top-side perspective cut-away view of the third embodiment of the Compartmented Cushioning Device 10C, showing the principal outer component 80A, with a side portion of its upper cushioning layer cut away, leaving small portions directly above both side primary compartment openings 82 and 82, to reveal a portion of the single inner component 80B located within. This figure illustrates the manner in which the single inner component 80B, is fitted and locked releasably within the primary compartment 83, of the principal outer component 80A. In addition, this figure provides an alternate and further revealing view of the primary compartment openings 82 and 82, of the principal outer component 80A; as well as cut-away reference arrows 38 and 38, to show the location and direction of the top/front to bottom/back cut-away views as depicted in FIG. 38, FIG. 41, and FIG. 42.

Figure 27:
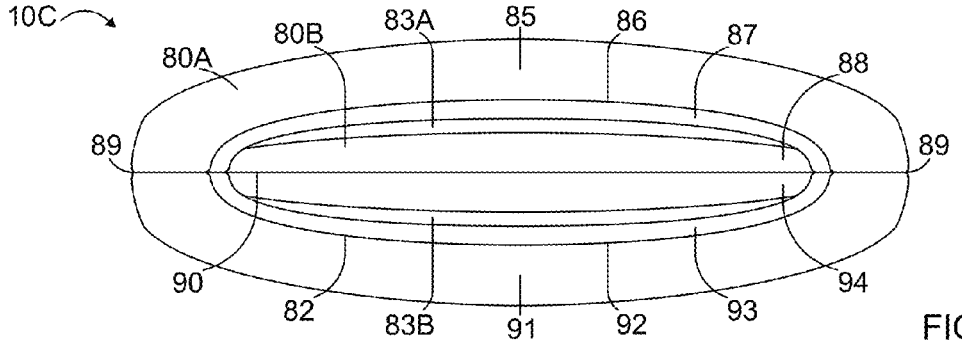
FIG. 27 depicts a side compartment opening view of the third embodiment of the Compartmented Cushioning Device, showing the principal outer component, and the single inner component, located one within the other; along with numbers with lead lines to point out individual parts that help make up its two components, two compartment openings, and two compartments.

FIG. 27 depicts a side compartment opening view of the third embodiment of the Compartmented Cushioning Device 10C, showing the principal outer component 80A, and the single inner component 80B, located one within the other, thereby creating a total of two compartments. With the single inner component 80B, located within the primary compartment 83 of the principal outer component 80A; the primary compartment 83 is divided into a primary upper or front compartment 83A, and a primary lower or back compartment 83B; thereby creating a total of two compartments that can be reached through the primary compartment openings 82 or 82, which are located at both sides of the device, and provide access for a user's fingers, hands, wrists, or arms into the primary upper or front compartment 83A, and the primary lower or back compartment 83B. This figure, as well as depicting a view of one of the primary compartment openings 82, shown here at the front, depicts a view through each of the two primary compartments 83A and 83B, that extend through the device, and out the primary compartment opening 82, which is located at the opposite side. The principal outer component 80A is constructed with an outer upper surface material 85, and an outer lower surface material 91, attached at both side edges by the means of seams 89 and 89, as well as attached to the inner upper surface material 87, and the inner lower surface material 93, by the means of seams 86 and 92, where they meet at both side primary compartment openings 82 and 82. In addition, the inner upper surface material 87, and the inner lower surface material 93, are attached to each other at both side edges, initially by the means of seams 89 and 89, where they meet at the primary compartment openings 82 and 82, as well as internally, by the means of two additional seams, which due to their interior location, are not shown in this figure. The single inner component 80B is constructed with an upper surface material 88, and a lower surface material 94, attached to each other at all side edges, by the means of a seam 90. It should be noted that the surface materials 85 and 91 can be two or more separate pieces of material attached to each other; or, they can be one continuous piece, attached by the means of seams at each of the rounded and tapered corners, as well as at one end only. The same applies to the surface materials 87 and 93; as well as 88 and 94, which additionally would be attached at its sides. By varying the types of materials within the Compartmented Cushioning Device 10C, it can produce a cool or a warm feeling for the user. The outer upper surface material 85, along with the surface materials 87 and 88 on both sides of the primary compartment 83A, can be a cool feeling material, such as cotton or linen; while the outer lower surface material 91, along with the surface materials 93 and 94 on both sides of the primary compartment 83B, can be a warm feeling material, such as fleece or wool. In alternate configurations, the outer upper surface material 85 and the outer lower surface material 91, along with the surface materials, 87, 88, 93, and 94, on both sides of the primary compartments 83A and 83B, can all be the same cool feeling surface materials, or all be the same warm feeling surface materials. With a wide variety of combinations, a user can place one or both of their hands or arms into either the same or separate compartments, with varied effects. The Compartmented Cushioning Device 10C, in those configurations offering one cool feeling, and one warm feeling compartment; the user will be able to place one or both of their hands or arms into either a cool, or a warm feeling compartment; to be used in warm or hot weather, as a cool feeling cushioning device; or in cool or cold weather, as a warm feeling cushioning device, or as a hand or arm warmer as well. In those configurations offering two cool feeling compartments; the user will be able to place one or both of their hands or arms into either the same or separate compartments, to be used in warm or hot weather, as a cool feeling cushioning device. Or, in those configurations offering two warm feeling compartments; the user will be able to place one or both of their hands or arms into either the same or separate compartments, to be used in cool or cold weather, as a warm feeling cushioning device, or as a hand or arm warmer as well. It should be noted that embodiment 10C, in addition to differing from embodiments 10A and 10B by being comprised of two compartments, instead of three or four; also differs from them in that the cushioning layers can be proportionally thicker than in embodiments 10A and 10B. In addition, as different from embodiment 10A, and as similar to embodiment 10B; the cushioning layers in embodiment 10C are of equal thickness one to the other; although, they can vary in thickness as well.

Figure 28:
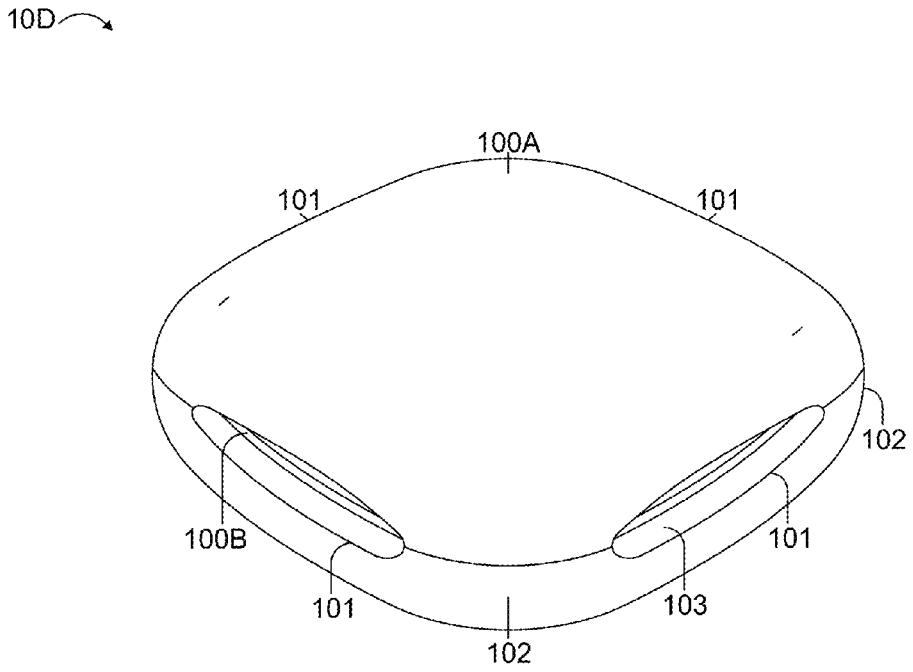
FIG. 28 depicts a top-corner perspective view of the fourth embodiment of the Compartmented Cushioning Device in a rounded corner square configuration, designed for use in multiple applications, and shown here with its principal outer component, inner component, four or more compartment openings, and two or more compartments.

FIG. 28 depicts a top-corner perspective view of the fourth embodiment of the Compartmented Cushioning Device 10D in a rounded corner square configuration, inspired by what is traditionally known as a decorative cushion, sofa cushion, throw pillow, or toss pillow, and designed for use in multiple applications. It is shown here with its two components: the principal outer component 100A, and the inner component 100B, located within. The principal outer component 100A has four matching primary compartment openings 101, 101, 101, and 101, located at each of the four sides, which provide access for a user's fingers, hands, wrists, or arms into the primary compartment 103. The inner component 100B, which is shown in the primary compartment 103 of the principal outer component 100A, divides the primary compartment 103 into two or more compartments. The inner component 100B, depending upon its design, can be comprised of one or more cushioning layers, with zero or one or more compartments, and zero or one or more compartment openings; which can be attached permanently, attached releasably, or detached completely, as depicted and described in this figure. The principal outer component 100A is designed with four rounded comfort-lock-in tapers, with one located at each corner of the component, to surround the four primary compartment openings 101, 101, 101, and 101, as illustrated in this figure, by the primary compartment opening 101, shown here at the front right, that is surrounded by the two rounded comfort-lock-in tapers 102 and 102. The four rounded comfort-lock-in tapers, by reducing the perimeters of the four primary compartment openings 101, 101, 101, and 101, as compared respectively to all or part of the parallel perimeters of the primary compartment 103, work together, to lock in the inner component 100B, within the primary compartment 103, of the principal outer component 100A. In turn, the inner component 100B is sized and shaped with four rounded fit-in tapers, conforming to the size and shape of the primary compartment 103, thereby allowing it to fit and lock releasably and securely into place once inside. This configuration, due to the location of its four primary compartment openings 101, 101, 101, and 101, will allow a person to place one or both of their hands or arms through one primary compartment opening 101, or through two primary compartment openings 101 and 101, from opposing sides or at a 0 to 90 degree angle in any direction, to be placed and remain within the compartment or compartments once inside. Or, the user will be able to place one or both of their hands or arms through one primary compartment opening 101, and depending upon their location, through the device, from a 0 to 90 degree angle in any direction, and out another primary compartment opening 101. With only a portion of their hands or arms within a compartment or compartments, this will allow the user to support, adjust, or precisely position their head, face, or other parts of their body; while at the same time, allow them to keep their hands or arms as cool as possible.

Figure 29:
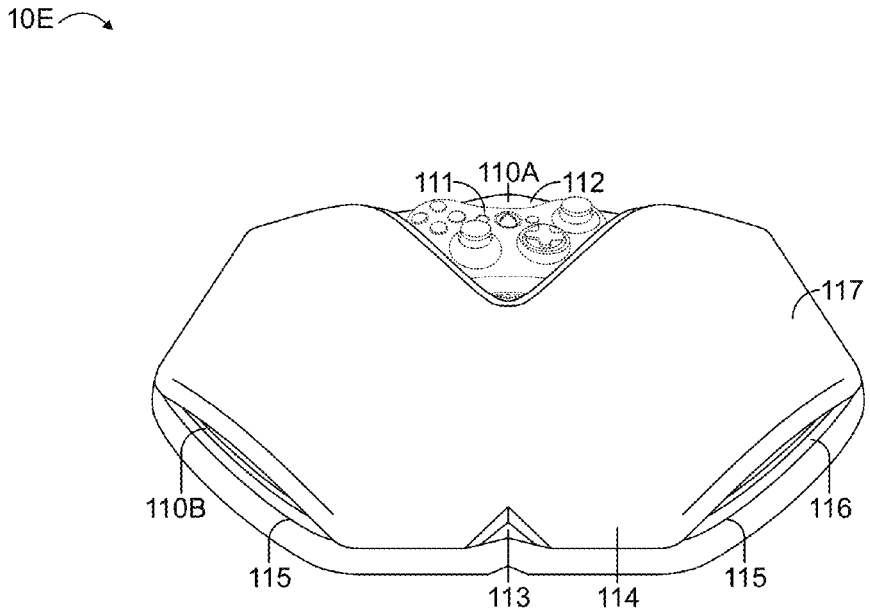
FIG. 29 depicts a top-side perspective view of the fifth embodiment of the Compartmented Cushioning Device in a rounded corner elongated heptagon configuration, designed for use primarily with a video game controller, and shown here with its principal outer component, inner component, two or more compartment openings, two or more compartments, one video game controller, one video game controller opening, and one headset cord opening.

FIG. 29 depicts a top-side perspective view of the fifth embodiment of the Compartmented Cushioning Device 10E in a rounded corner elongated heptagon configuration, and designed for use primarily with a video game controller 111. It is shown here with its two components: the principal outer component 110A, and the inner component 110B, located within. The principal outer component 110A has two matching primary compartment openings 115 and 115, which provide access for a user's hands or wrists into the primary compartment 116; along with a larger video game controller opening 112, through which the video game controller 111 can be installed, and whereby it can transmit its signal; as well as a headset cord opening 113, which is located between the two primary compartment openings 115 and 115, of the principal outer component 110A. The inner component 110B, which is shown in the primary compartment 116 of the principal outer component 110A, divides the primary compartment 116 into two or more compartments. The inner component 110B, depending upon its design, can be comprised of one or more cushioning layers, with zero or one or more compartments, and zero or one or more compartment openings; which can be attached permanently, attached releasably, or detached completely, as depicted and described in this figure. The principal outer component 110A is designed with two upper comfort-lock-in tapers, and two lower comfort-lock-in tapers, located each at two sides of the component, to surround the two primary compartment openings 115 and 115, as illustrated in this figure, by the primary compartment opening 115, shown here at the bottom right, that is surrounded by one upper comfort-lock-in taper 117, and one lower comfort-lock-in taper 114. The two upper comfort-lock-in tapers, and the two lower comfort-lock-in tapers, by reducing the perimeters of the two primary compartment openings 115 and 115, as compared respectively to all or part of the parallel perimeters of the primary compartment 116, work together, to lock in the inner component 110B, within the primary compartment 116, of the principal outer component 110A. In turn, the inner component 110B is sized and shaped with two upper fit-in tapers, and two lower fit-in tapers, conforming to the size and shape of the primary compartment 116, thereby allowing it to fit and lock releasably and securely into place once inside. The principal outer component 110A can be designed with cushioned extensions for the arms, and/or cushions or pillows for the bottom of the device, which can be attached permanently, attached releasably, or detached completely, thereby providing additional cushioning for the user's hands, wrists, arms, or other parts of their body. The inner component 110B can be designed with cushioned extensions for the arms as well, which too can be attached permanently, attached releasably, or detached completely. It should be noted that the principal outer component 110A, can also be used without the inner component 110B, thus indicating that the Compartmented Cushioning Device 10A through 10P may or may not need to include an inner component, depending upon its use.

Figure 30:
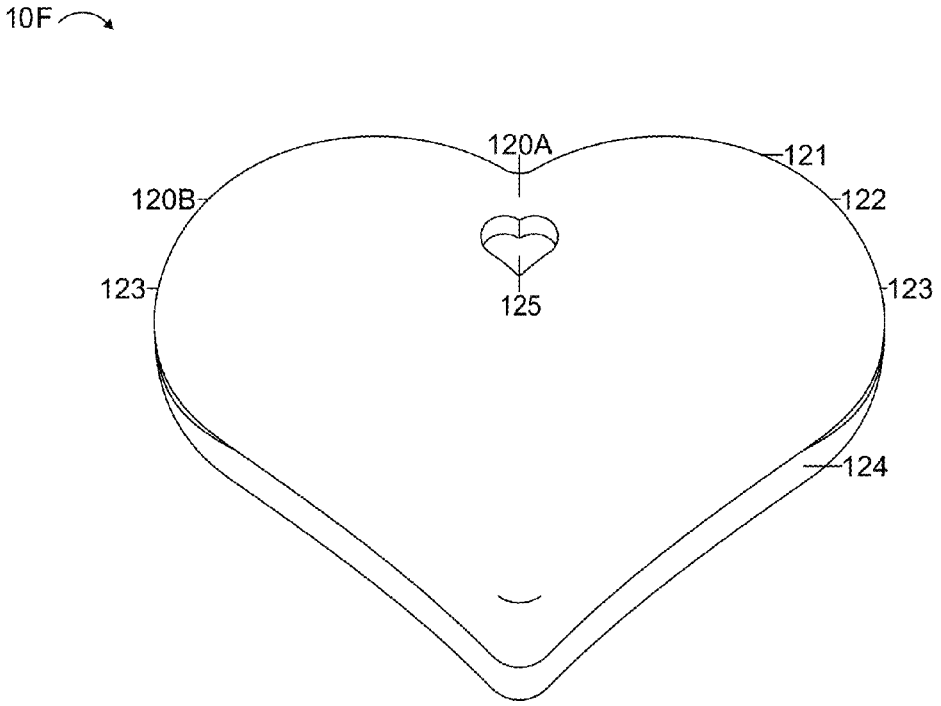
FIG. 30 depicts a top-side perspective view of the sixth embodiment of the Compartmented Cushioning Device in a heart-shaped decorative configuration, designed for use in multiple applications, and shown here with its principal outer component, inner component, two or more compartment openings, two or more compartments, and one air circulation opening.

FIG. 30 depicts a top-side perspective view of the sixth embodiment of the Compartmented Cushioning Device 10F in a heart-shaped decorative configuration, and designed for use in multiple applications. It is shown here with its two components: the principal outer component 120A, and the inner component 120B, located within. The principal outer component 120A has two matching primary compartment openings 123 and 123, which provide access for a user's fingers, hands, wrists, or arms into the primary compartment 122; along with a smaller air circulation opening 125, which is configured in a decorative, as well as functional shape, and provides a means for maintaining a cooler temperature within the compartment adjacent to it. The inner component 120B, which is shown in the primary compartment 122 of the principal outer component 120A, divides the primary compartment 122 into two or more compartments. The inner component 120B, depending upon its design, can be comprised of one or more cushioning layers, with zero or one or more compartments, and zero or one or more compartment openings; which can be attached permanently, attached releasably, or detached completely, as depicted and described in this figure. The principal outer component 120A is designed with two upper rounded comfort-lock-in tapers, and two lower rounded comfort-lock-in tapers, located each at two sides of the component, to surround the two primary compartment openings 123 and 123, as illustrated in this figure, by the primary compartment opening 123, shown here at the right, that is surrounded by one upper rounded comfort-lock-in taper 121, and one lower rounded comfort-lock-in taper 124. The two upper rounded comfort-lock-in tapers, and the two lower rounded comfort-lock-in tapers, by reducing the perimeters of the two primary compartment openings 123 and 123, as compared respectively to all or part of the parallel perimeters of the primary compartment 122, work together, to lock in the inner component 120B, within the primary compartment 122, of the principal outer component 120A. In turn, the inner component 120B is sized and shaped with two upper rounded fit-in tapers, and two lower rounded fit-in tapers, conforming to the size and shape of the primary compartment 122, thereby allowing it to fit and lock releasably and securely into place once inside. It should be noted that although this embodiment is constructed in the shape of a heart, the Compartmented Cushioning Device 10A through 10P can also be designed in a wide variety of other decorative or geometric shapes, comprised of straight lines and/or curves, as in the shape of a circle, ellipse, polygon, or any combination thereof; as for example, in the shape of any animal, logo, person, plant, sports equipment, or symbol; as well as any other entity, object, or thing, found on earth or in the universe.

Figure 31:
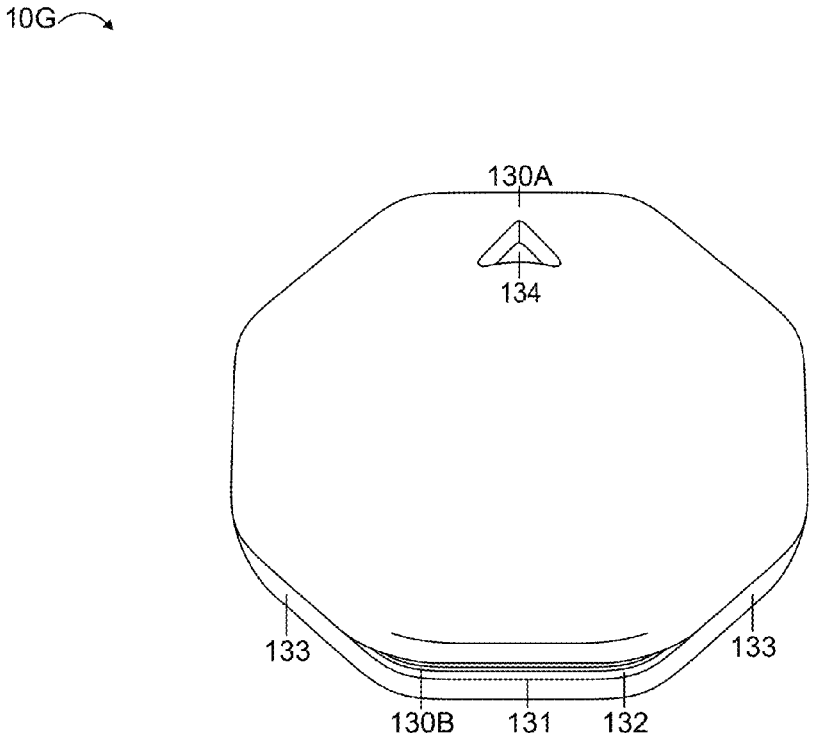
FIG. 31 depicts a top-side perspective view of the seventh embodiment of the Compartmented Cushioning Device in a rounded corner octagon configuration, designed for use in multiple applications, and shown here with its principal outer component, inner component, one or more compartment openings, two or more compartments, and one air circulation opening.

FIG. 31 depicts a top-side perspective view of the seventh embodiment of the Compartmented Cushioning Device 10G in a rounded corner octagon configuration, and designed for use in multiple applications. It is shown here with its two components: the principal outer component 130A, and the inner component 130B, located within. The principal outer component 130A has one primary compartment opening 131, which provides access for a user's fingers, hands, wrists, or arms into the primary compartment 132; as well as one smaller air circulation opening 134, which is configured in a decorative, as well as functional shape, and provides a means for maintaining a cooler temperature within the compartment adjacent to it. The inner component 130B, which is shown in the primary compartment 132 of the principal outer component 130A, divides the primary compartment 132 into two or more compartments. The inner component 130B, depending upon its design, can be comprised of one or more cushioning layers, with zero or one or more compartments, and zero or one or more compartment openings; which can be attached permanently, attached releasably, or detached completely, as depicted and described in this figure. The principal outer component 130A is designed with two comfort-lock-in tapers 133 and 133, surrounding the primary compartment opening 131. The two comfort-lock-in tapers 133 and 133, by reducing the perimeter of the primary compartment opening 131, as compared to all or part of the parallel perimeters of the primary compartment 132, work together, to lock in the inner component 130B, within the primary compartment 132, of the principal outer component 130A. In turn, the inner component 130B is sized and shaped with two fit-in tapers, conforming to the size and shape of the primary compartment 132, thereby allowing it to fit and lock releasably and securely into place once inside. It should be noted that this embodiment, as well as other embodiments of the Compartmented Cushioning Device 10A through 10P, can also be created with two or more smaller air circulation openings, and/or one or more medium sized openings for use with a remote control, or other control or device.

Figure 32:
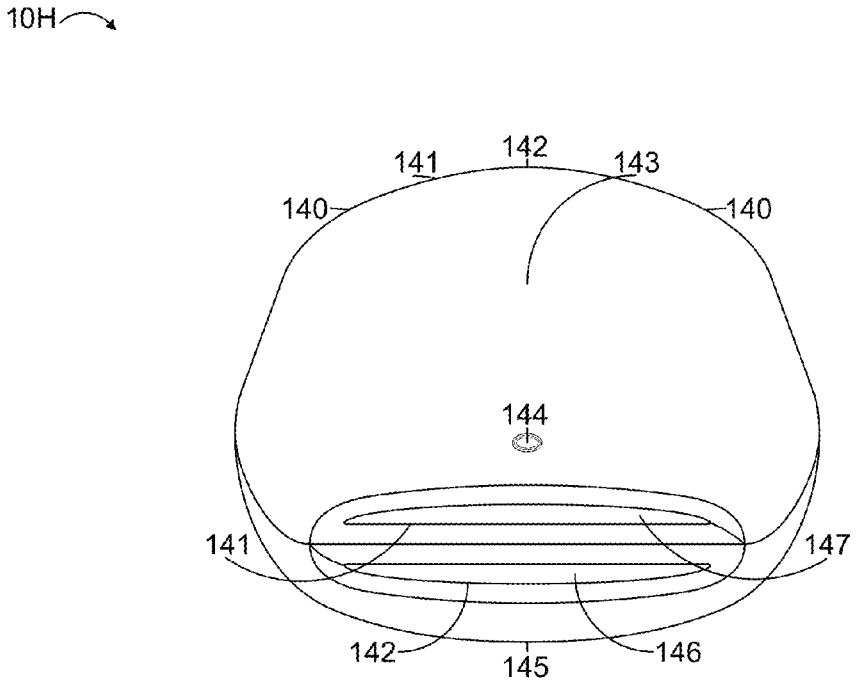
FIG. 32 depicts a top-side perspective view of the eighth embodiment of the Compartmented Cushioning Device in a rounded corner elongated octagon configuration, designed for use in multiple applications, and shown here with its four compartment openings, two compartments, and one access or fill valve.

FIG. 32 depicts a top-side perspective view of the eighth embodiment of the Compartmented Cushioning Device 10H in a rounded corner elongated octagon configuration, and designed for use in multiple applications. It is shown here with its two lower and upper compartments 146 and 147, along with its two matching upper compartment openings 141 and 141, which provide access for a user's fingers, hands, wrists, or arms into the upper compartment 147, which extends through the device, from one side to the other; as well as its two matching lower compartment openings 142 and 142, which provide access for a user's fingers, hands, wrists, or arms into the lower compartment 146, which also extends through the device, from one side to the other. This embodiment is designed with four rounded comfort-shape retention tapers, with one located at each corner of the device, to surround the four upper and lower compartment openings 141, 141, 142, and 142, as illustrated in this figure, by the upper and lower compartment openings 141 and 142, shown here at the back, which are surrounded by the two rounded comfort-shape retention tapers 140 and 140. The four rounded comfort-shape retention tapers, by reducing the perimeters of the four upper and lower compartment openings 141, 141, 142, and 142, as compared respectively to all or part of the parallel perimeters of their respective lower or upper compartments 146 or 147, are very helpful in the retention of the shape of the embodiment; by maintaining the position of the interior surface materials, relative to the exterior surface materials; as well as the position of the surface materials, relative to the filler materials. In addition, this feature also creates soft rounded corners at the exterior; an ergonomic design at the interior, for the user's fingers, hands, wrists, or arms; as well as a cozy cocoon or pod type shape to the cushioning device. The lower and upper compartments 146 and 147 are not divided by an inner component, but rather, by the layers of exterior and interior surface materials, along with the filler materials. The outer upper surface material 143 can be a cool feeling material, while the outer lower surface material 145, can be a warm feeling material. The interior surface material surrounding the upper compartment 147 can be the same cool feeling material as the outer upper surface material 143; while the interior surface material surrounding the lower compartment 146, can be the same warm feeling material as the outer lower surface material 145. Because the surface materials in this embodiment are interconnected, with no obstacles between the different areas or layers, the filler material can be continuous, or free to move from one area or layer to another. It should be noted that this embodiment can also be created by joining two separate cylinder-like or tube-like components; as well as hermetically sealed, by ultrasonic fusing of its seams, or other appropriate method, thereby allowing it to be inflatable or refillable, by way of an access or fill valve 144.

Figure 33:
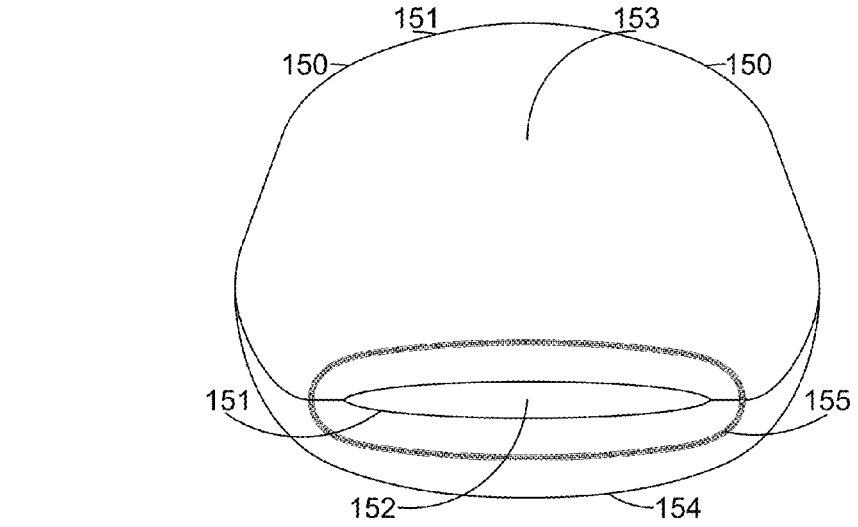
FIG. 33 depicts a top-side perspective view of the ninth embodiment of the Compartmented Cushioning Device in a rounded corner elongated octagon configuration, designed for use in multiple applications, and shown here with its two compartment openings, one compartment, and one zipper.

FIG. 33 depicts a top-side perspective view of the ninth embodiment of the Compartmented Cushioning Device 10I in a rounded corner elongated octagon configuration, and designed for use in multiple applications. It is shown here with its one compartment 152, along with its two matching compartment openings 151 and 151, which provide access for a user's fingers, hands, wrists, or arms into the compartment 152, which extends through the device, from one side to the other. This embodiment is designed with four rounded comfort-shape retention tapers, with one located at each corner of the device, to surround the two compartment openings 151 and 151, as illustrated in this figure, by the compartment opening 151, shown here at the back, which is surrounded by the two rounded comfort-shape retention tapers 150 and 150. The four rounded comfort-shape retention tapers, by reducing the perimeters of the two compartment openings 151 and 151, as compared respectively to all or part of the parallel perimeters of the compartment 152, are very helpful in the retention of the shape of the embodiment; by maintaining the position of the interior surface materials, relative to the exterior surface materials; as well as the position of the surface materials, relative to the filler materials. In addition, this feature also creates soft rounded corners at the exterior; an ergonomic design at the interior, for the user's fingers, hands, wrists, or arms; as well as a cozy cocoon or pod type shape to the cushioning device. The outer upper surface material 153, and the outer lower surface material 154, can be the same cool feeling material, the same warm feeling material, or a combination of two or more types of cool or warm feeling materials. Because the surface materials in this embodiment are interconnected, with no obstacles between the different areas or layers, the filler material can be continuous, or free to move from one area or layer to another. This embodiment, when constructed with granular or loose filler material, such as buckwheat hull or micro-beads, can mold to the parts of the body to which they are applied, due to the filler material's amorphous characteristics, thereby enhancing the level of comfort for the user. As an option, the use of baffles or quilting can help to minimize the shifting of, as well as ensure a more even distribution of the filler material within the cushioning device. When constructed with one single piece of surface material, it can be created with a minimum number of exterior and interior seams, thereby providing a maximum number of soft and smooth non-seam areas on the cushioning device. This embodiment can also be designed with an opening/closing means, such as a zipper 155, thereby allowing the surface materials, as well as the filler materials to be removed, in order to exchange or replace them, or for cleaning or washing, as required by the materials of which they are constructed. It should be noted that no inner components are shown in this figure, thus indicating that the Compartmented Cushioning Device 10A through 10P may or may not include an inner component, depending upon its design.

Figure 34:
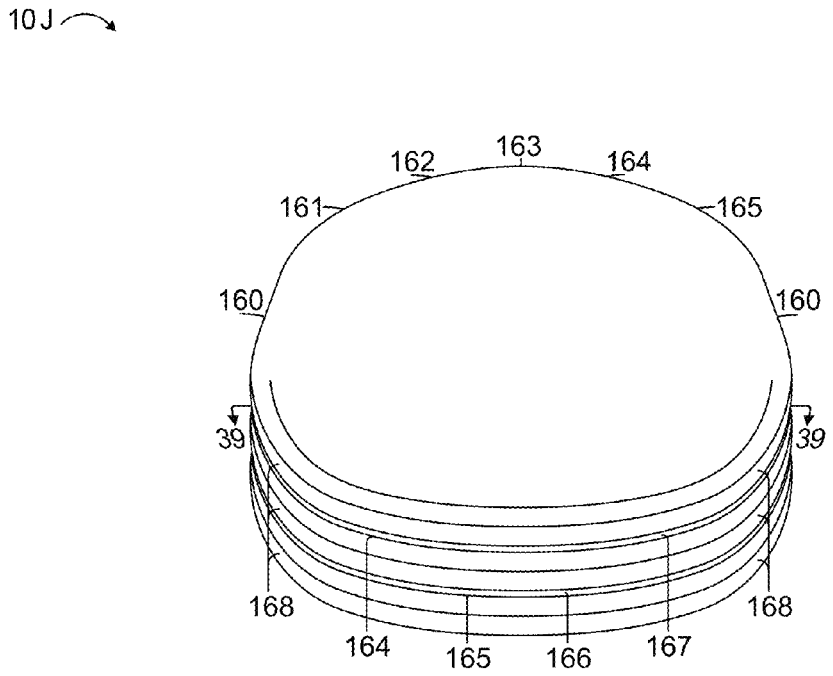
FIG. 34 depicts a top-side perspective view of the tenth embodiment of the Compartmented Cushioning Device in a rounded corner elongated octagon configuration, designed for use primarily in bed as a partitioned pillow, and shown here with its upper component, inner component, lower component, four compartment openings, and two compartments.
Figure 39:
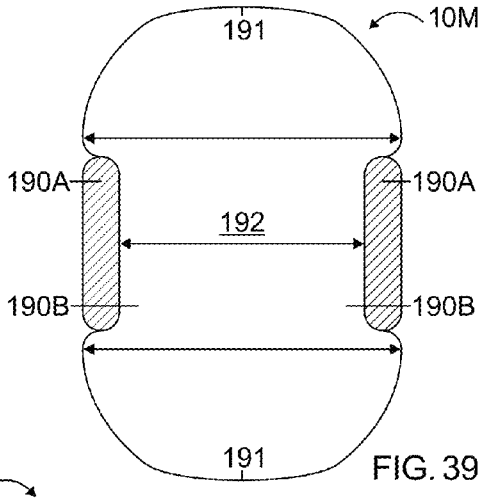
FIG. 39 depicts a top/front to bottom/back cut-away view of the thirteenth embodiment of the Compartmented Cushioning Device, showing the principal outer component, with its entire upper cushioning layer cut away, revealing portions of its compartment openings, its compartment, and the inner component located within; with the purpose of depicting and/or describing manners in which the inner component of the Compartmented Cushioning Device 10J can be fitted and locked releasably, attached releasably, or attached permanently, to or by the other components, in alternate configurations.

FIG. 34 depicts a top-side perspective view of the tenth embodiment of the Compartmented Cushioning Device 10J in a rounded corner elongated octagon configuration, and designed for use primarily in bed as a partitioned pillow. It is shown here, as well as in FIG. 35 from an alternate perspective, with its upper component 161, inner component 162, and lower component 163, with bands extending from the upper component 161 and the lower component 163, attached externally, at opposite sides of the device, by two seams 160 and 160; as well as internally, by additional seams, not visible in this figure, that join the upper, inner, and lower components 161, 162, and 163; thereby creating one single attached unit. The embodiment has two lower and upper compartments 166 and 167, along with two matching upper compartment openings 164 and 164, which provide access for a user's fingers, hands, wrists, or arms into the upper compartment 167, which extends through the device, from one side to the other; as well as two matching lower compartment openings 165 and 165, which provide access for a user's fingers, hands, wrists, or arms into the lower compartment 166, which also extends through the device, from one side to the other. The four upper and lower compartment openings 164, 164, 165, and 165, wrap around both sides and toward the center, where the upper, inner, and lower components 161, 162, and 163 are joined. With the surface material on both sides of the upper component 161, along with the surface material on the upper side of the inner component 162, composed of the same type of cool feeling surface material; the upper compartment 167, as well as the outer upper surface of the cushioning device, are composed of cool feeling materials. With the surface material on both sides of the lower component 163, along with the surface material on the lower side of the inner component 162, composed of the same type of warm feeling material; the lower compartment 166, as well as the outer lower surface of the device, are composed of warm feeling materials. This design configuration will provide access for a user's fingers, hands, wrists, or arms, from a variety of angles, to the warm feeling lower compartment 166, or the cool feeling upper compartment 167; as well as a choice of the cool feeling outer upper surface, or the warm feeling outer lower surface, located respectively at the top and bottom of the cushioning device. As an option, the surface materials on each side of the lower and upper compartments 166 and 167, as well as the outer upper surface material of the upper component 161, and the outer lower surface material of the lower component 163, can also be composed of either the same or different cool feeling or warm feeling surface materials, or any combination thereof. In addition, the bands extending from the upper and lower components 161 and 163, can be filled with filler material, or be comprised of surface material only. This embodiment is designed with twelve rounded comfort corners, with one located at each corner of the upper, inner, and lower components 161, 162, and 163, as illustrated in this figure, by the three components 161, 162, and 163, shown here at the front, with the six rounded comfort corners 168, 168, 168, 168, 168, and 168, which create soft rounded corners on the device, thus enhancing the potential level of comfort for the user. The upper, inner, and lower components 161, 162, and 163, which can be of equal or varying thickness, can also be constructed with opening/closing means of various types, thereby allowing the filler materials and/or the surface materials to be removed, in order to exchange or replace them, or for cleaning or washing, as required by the materials of which they are constructed. It should be noted that this embodiment, can also be designed with the inner component 162, attached releasably to or detached completely from the upper and the lower components 161 and 163, which independently, would be attached to each other. As a further option, this embodiment can be designed without an inner component, thus comprised of two components, and one compartment. Or, it can be designed with four or more components, and three or more compartments, as well. For the purpose of this embodiment: the terms components, cushioning layers, and partitions are intended to be synonyms, and can be substituted one for the other. Furthermore, this figure provides cut-away reference arrows 39 and 39, to show the location and direction of the top/front to bottom/back cut-away view as depicted in FIG. 39.

Figure 35:
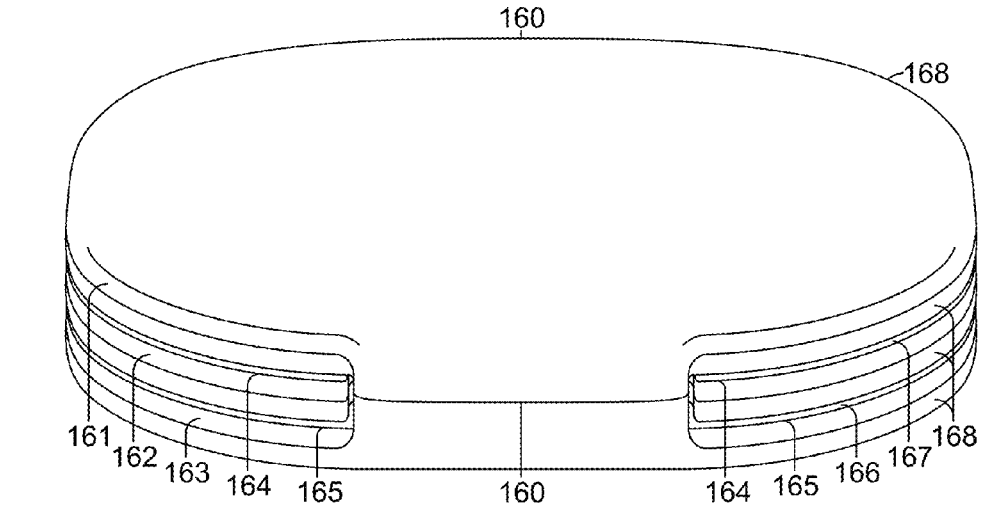
FIG. 35 depicts a top-side perspective view of the tenth embodiment of the Compartmented Cushioning Device as depicted and described in FIG. 34; although, turned counter clockwise 90 degrees, for an alternate and further revealing view of its components, compartment openings, and compartments.

FIG. 35 depicts a top-side perspective view of the tenth embodiment of the Compartmented Cushioning Device 10J as depicted and described in FIG. 34; although, turned counter clockwise 90 degrees for an alternate view, further revealing the location of its upper component 161, inner component 162, and lower component 163; as well as the location of its two upper compartment openings 164 and 164, and two lower compartment openings 165 and 165, which provide access for a user's fingers, hands, wrists, or arms, from a variety of angles, into the warm feeling lower compartment 166, or the cool feeling upper compartment 167. Further revealed in this figure are the two seams 160 and 160, which attach the upper component 161, to the lower component 163, at opposite sides of the device; as well as the twelve rounded comfort corners, which create soft rounded corners on the upper, inner, and lower components 161, 162, and 163.

Figure 36:
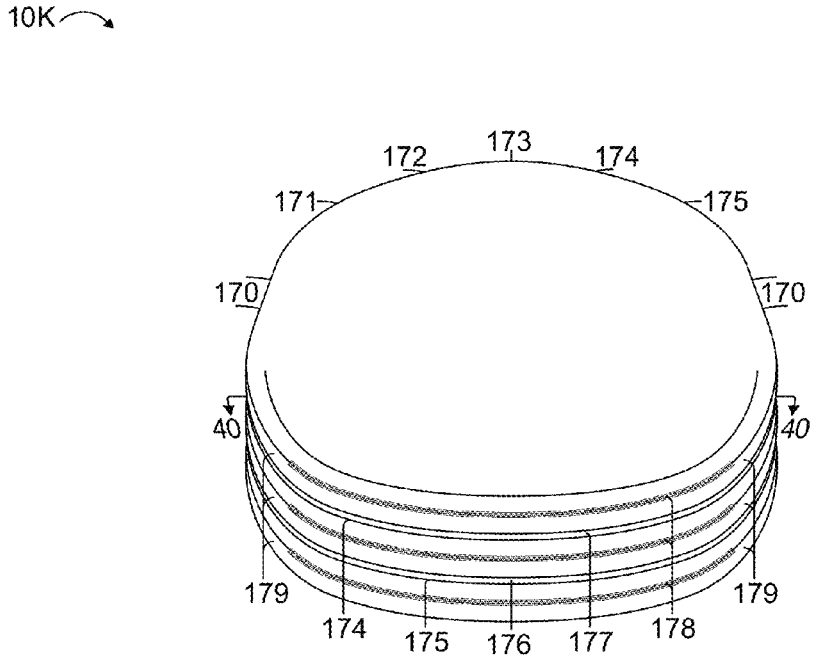
FIG. 36 depicts a top-side perspective view of the eleventh embodiment of the Compartmented Cushioning Device in a rounded corner elongated octagon configuration, designed for use primarily in bed as a partitioned pillow, and shown here with its upper component, inner component, lower component, four compartment openings, two compartments, and three zippers.
Figure 40:
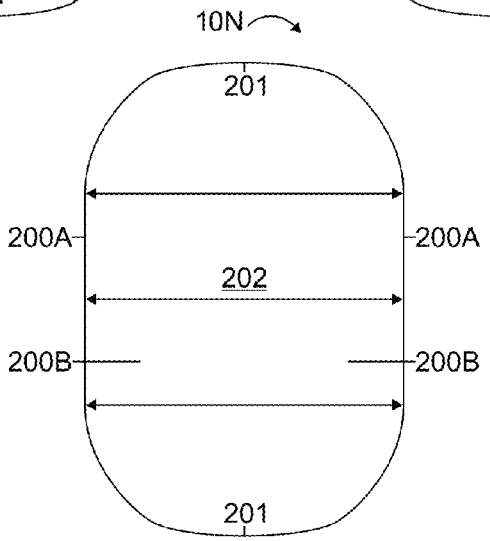
FIG. 40 depicts a top/front to bottom/back cut-away view of the fourteenth embodiment of the Compartmented Cushioning Device, showing the embodiment, with its entire upper cushioning layer cut away, revealing portions of two of its compartment openings, one of its compartments, and the inner component located between; with the purpose of depicting and/or describing manners in which the components of the Compartmented Cushioning Device 10K can be attached releasably, or attached permanently, one to the other, in alternate configurations.

FIG. 36 depicts a top-side perspective view of the eleventh embodiment of the Compartmented Cushioning Device 10K in a rounded corner elongated octagon configuration, and designed for use primarily in bed as a partitioned pillow. It is shown here, as well as in FIG. 37 from an alternate perspective, with its upper component 171, inner component 172, and lower component 173, attached at opposite sides of the device by four seams 170, 170, 170, and 170, that join the upper, inner, and lower components 171, 172, and 173; thereby creating one single attached unit. The embodiment has two lower and upper compartments 176 and 177, along with two matching upper compartment openings 174 and 174, which provide access for a user's fingers, hands, wrists, or arms into the upper compartment 177, which extends through the device, from one side to the other; as well as two matching lower compartment openings 175 and 175, which provide access for a user's fingers, hands, wrists, or arms into the lower compartment 176, which also extends through the device, from one side to the other. The four upper and lower compartment openings 174, 174, 175, and 175, wrap around both sides and toward the center, where the upper, inner, and lower components 171, 172, and 173 are joined. With the surface material on both sides of the upper component 171, along with the surface material on the upper side of the inner component 172, composed of the same type of cool feeling surface material; the upper compartment 177, as well as the outer upper surface of the cushioning device, are composed of cool feeling materials. With the surface material on both sides of the lower component 173, along with the surface material on the lower side of the inner component 172, composed of the same type of warm feeling material; the lower compartment 176, as well as the outer lower surface of the device, are composed of warm feeling materials. This design configuration will provide access for a user's fingers, hands, wrists, or arms, from a variety of angles, to the warm feeling lower compartment 176, or the cool feeling upper compartment 177; as well as a choice of the cool feeling outer upper surface, or the warm feeling outer lower surface, located respectively at the top and bottom of the cushioning device. As an option, the surface materials on each side of the lower and upper compartments 176 and 177, as well as the outer upper surface material of the upper component 171, and the outer lower surface material of the lower component 173, can also be composed of either the same or different cool feeling or warm feeling surface materials, or any combination thereof. This embodiment is designed with twelve rounded comfort corners, with one located at each corner of the upper, inner, and lower components 171, 172, and 173, as illustrated in this figure, by the three components 171, 172, and 173, shown here at the front, with the six rounded comfort corners 179, 179, 179, 179, 179, and 179, which create soft rounded corners on the device, thus enhancing the potential level of comfort for the user. Also depicted in this figure are three opening/closing means, comprised of three zippers 178, 178, and 178, with one installed on each of the upper, inner, and lower components 171, 172, and 173, thereby granting access to their interiors, and allowing the filler materials, as well as the attached surface unit, comprised of the surface materials of the upper, inner, and lower components 171, 172, and 173, to be removed and replaced, in order to clean, wash, or exchange them. It should be noted that the opening/closing means, comprised of three zippers 178, 178, and 178, can also be comprised of a number of others, such as those that utilize buttons, hooks and loops, flaps, snaps, or other appropriate means. It should also be noted that the filler materials of the upper, inner, and lower components 171, 172, and 173, can be of equal or varying thickness, thus providing a way of adjusting or controlling the height or thickness of the device. As an option, this embodiment can be designed with two components, and one compartment. Or, it can be designed with four or more components, and three or more compartments, as well. As a further option, this embodiment can also be created by the means of two or more components stacked one on top of the other; with the surface material of the upper component, attached to the surface material of the adjacent lower component, at one or more attachment points at any location; which in turn is attached to the surface material of the following lower component in the same manner; and so on, in succession, until reaching the lowest component; wherein a compartment is created between or surrounded by each set of adjacent components. For the purpose of this embodiment: the terms components, cushioning layers, and partitions are intended to be synonyms, and can be substituted one for the other. Furthermore, this figure provides cut-away reference arrows 40 and 40, to show the location and direction of the top/front to bottom/back cut-away view as depicted in FIG. 40.

Figure 37:
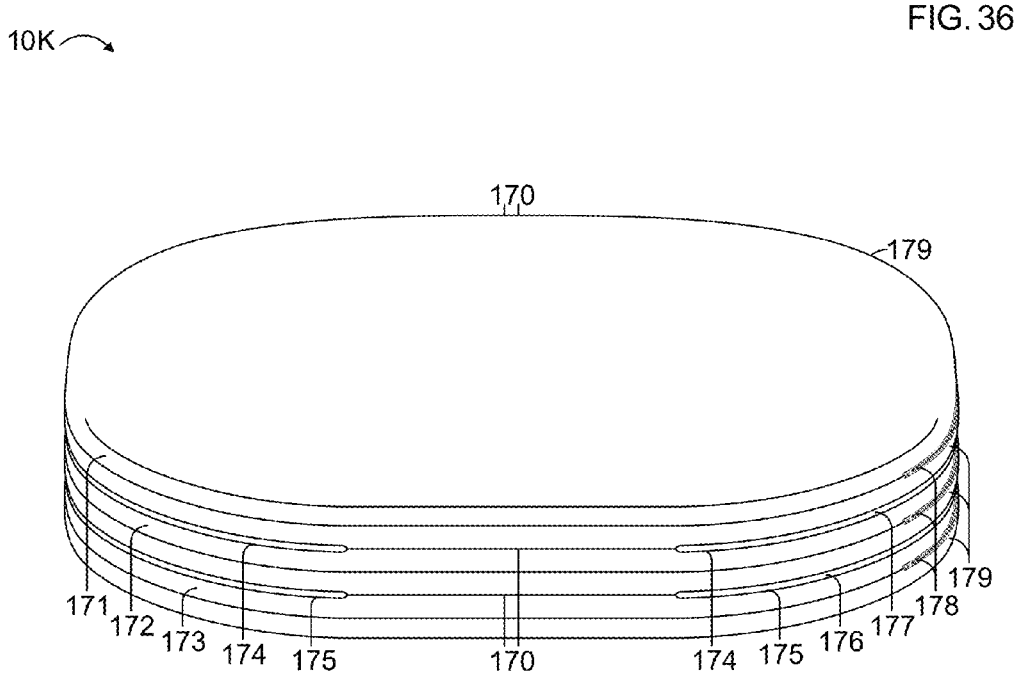
FIG. 37 depicts a top-side perspective view of the eleventh embodiment of the Compartmented Cushioning Device as depicted and described in FIG. 36; although, turned counter clockwise 90 degrees, for an alternate and further revealing view of its components, compartment openings, compartments, and zippers.

FIG. 37 depicts a top-side perspective view of the eleventh embodiment of the Compartmented Cushioning Device 10K as depicted and described in FIG. 36; although, turned counter clockwise 90 degrees for an alternate view, further revealing the location of its upper component 171, inner component 172, and lower component 173; as well as the location of its two upper compartment openings 174 and 174, and two lower compartment openings 175 and 175, which provide access for a user's fingers, hands, wrists, or arms, from a variety of angles, into the warm feeling lower compartment 176, or the cool feeling upper compartment 177.

Further revealed in this figure are the four seams 170, 170, 170, and 170, which attach the upper component 171, the inner component 172, and the lower component 173, at opposite sides of the device; along with the twelve rounded comfort corners, which create soft rounded corners on the upper, inner, and lower components 171, 172, and 173; as well as the three opening/closing means, comprised of the three zippers 178, 178, and 178, which grant access to their interiors.

FIG. 38 depicts a top/front to bottom/back cut-away view of the twelfth embodiment of the Compartmented Cushioning Device 10L, showing the principal outer component 180A, with its entire upper cushioning layer cut away, to reveal the inner component 180B located within. Further revealed, with a set of three arrows to illustrate their relative sizes, are the primary compartment openings 181 and 181, and the primary compartment 182, of the principal outer component 180A. The purpose of this figure is to depict and/or describe manners in which the components of the Compartmented Cushioning Device 10B and 10C can be fitted and locked releasably, one to or by the other; as well as attached releasably, or attached permanently, one to the other, in alternate configurations. In this first configuration, the principal outer component 180A is designed with four rounded and tapered corners, so that the perimeters of the primary compartment openings 181 and 181 are smaller than all or part of the parallel perimeters of the primary compartment 182. Described in a different way; the principal outer component 180A is sized and shaped so that all or part of the perimeters of the primary compartment 182, at or closer to the primary compartment openings 181 and 181, are smaller than all or part of the parallel perimeters of the primary compartment 182, further from the primary compartment openings 181 and 181. In turn, the inner component 180B is sized and shaped to conform to the size and shape of the primary compartment 182, thereby allowing it to fit and lock releasably and securely into place once inside. With the inner component 180B folded, it can easily be inserted through either primary compartment opening 181 or 181, to be placed within the primary compartment 182, of the principal outer component 180A. Once inside and fully extended, it will fit and lock releasably and securely into place within the primary compartment 182, and will not fall out. The smaller and larger parallel perimeters of the primary compartment 182, respectively, at or closer to, and further from the primary compartment openings 181 and 181, work together, to lock in the first inner component 180B, within the primary compartment 182, of the principal outer component 180A. This design feature partially encases and securely retains the inner component 180B, within the primary compartment 182, while still allowing it to easily be released. Further described in a different way; the principal outer component 180A and the inner component 180B are complementary in size and shape, and the periphery of the inner component 180B, is substantially the same as the periphery of the primary compartment 182; wherein the inner component 180B is locked releasably by the principal outer component 180A within the primary compartment 182. The three arrows in this figure, that are located at the center, floating within the primary compartment 182, and above the inner component 180B, are included to illustrate the smaller and larger parallel perimeters of the primary compartment 182, respectively, at or closer to, and further from the primary compartment openings 181 and 181; as well as to illustrate the complementary size and shape of the inner component 180B. In this first alternate configuration, the inner component 180B, for further security, can be attached releasably, such as with hooks and loops or zippers, to the principal outer component 180A. Or, in additional alternate configurations, the inner component 180B can be attached permanently, such as with seams, or with an appropriate adhesive as well. Please see cut-away reference arrows 38 and 38, in FIG. 22 and FIG. 26, to see the location and direction of the top/front to bottom/back cut-away view as depicted in this figure.

FIG. 39 depicts a top/front to bottom/back cut-away view of the thirteenth embodiment of the Compartmented Cushioning Device 10M, showing the principal outer component 190A, with its entire upper cushioning layer cut away, to reveal the inner component 190B located within. Further revealed, with a set of three arrows to illustrate their relative sizes, are the primary compartment openings 191 and 191, and the primary compartment 192, of the principal outer component 190A. The purpose of this figure is to depict and/or describe manners in which the inner component of the Compartmented Cushioning Device 10J can be fitted and locked releasably, attached releasably, or attached permanently, to or by the other components, in alternate configurations. In this first alternate configuration, the upper and lower components are attached permanently one to the other, thereby forming the principal outer component 190A, which is designed so that all or part of the perimeters of the primary compartment 192, central to the primary compartment openings 191 and 191, are smaller than all or part of the parallel perimeters of the primary compartment 192, further from the primary compartment openings 191 and 191. Described in a different way; the principal outer component 190A is sized and shaped so that all or part of the perimeters of the primary compartment 192, at or closer to the primary compartment openings 191 and 191, are smaller than all or part of the parallel perimeters of the primary compartment 192, further from the primary compartment openings 191 and 191. In turn, the inner component 190B is sized and shaped to conform to the size and shape of the primary compartment 192, thereby allowing it to fit and lock releasably and securely into place once inside. With the inner component 190B folded, it can easily be inserted through either primary compartment opening 191 or 191, to be placed within the primary compartment 192, of the principal outer component 190A. Once inside and fully extended, it will fit and lock releasably and securely into place within the primary compartment 192, and will not fall out. The smaller and larger parallel perimeters of the primary compartment 192, respectively, at or closer to, and further from the primary compartment openings 191 and 191, work together, to lock in the first inner component 190B, within the primary compartment 192, of the principal outer component 190A. This design feature partially encases and securely retains the inner component 190B, within the primary compartment 192, while still allowing it to easily be released. Further described in a different way; the principal outer component 190A and the inner component 190B are complementary in size and shape, and the periphery of the inner component 190B, is substantially the same as the periphery of the primary compartment 192; wherein the inner component 190B is locked releasably by the principal outer component 190A within the primary compartment 192. The three arrows in this figure, that are located at the center, floating within the primary compartment 192, and above the inner component 190B, are included to illustrate the smaller and larger parallel perimeters of the primary compartment 192, respectively, at or closer to, and further from the primary compartment openings 191 and 191; as well as to illustrate the complementary size and shape of the inner component 190B. In this second alternate configuration, the inner component 190B, for further security, can be attached releasably, such as with hooks and loops or zippers, to the principal outer component 190A.

The upper, inner, and lower components can also be attached permanently one to the other with seams, as depicted and described in FIG. 34 and FIG. 35; or in an additional alternate configuration, with an appropriate adhesive as well. Please see cut-away reference arrows 39 and 39, in FIG. 34, to see the location and direction of the top/front to bottom/back cut-away view as depicted in this figure.

FIG. 40 depicts a top/front to bottom/back cut-away view of the fourteenth embodiment of the Compartmented Cushioning Device 10N, showing the embodiment with its entire upper cushioning layer cut away, to reveal the inner component 200B located between. Further revealed, with a set of three arrows to illustrate their relative sizes, are the upper compartment openings 201 and 201, and the upper compartment 202, located above the inner component 200B. The purpose of this figure is to depict and/or describe manners in which the components of the Compartmented Cushioning Device 10K can be attached releasably, or attached permanently, one to the other, in alternate configurations. In this first alternate configuration, the lower component 200A is attached releasably at opposite sides of the device, such as with hooks and loops or zippers, to the inner component 200B, which in turn is attached releasably to the upper component, not shown here, in the same manner. The upper, inner, and lower components can also be attached permanently one to the other with seams, as depicted and described in FIG. 36 and FIG. 37, or in an additional alternate configuration, with an appropriate adhesive as well. Please see cut-away reference arrows 40 and 40, in FIG. 36, to see the location and direction of the top/front to bottom/back cut-away view as depicted in this figure.

FIG. 41 depicts a top/front to bottom/back cut-away view of the fifteenth embodiment of the Compartmented Cushioning Device 10O, showing the principal outer component 210A, with its entire upper cushioning layer cut away, to reveal the inner component 210B located within. Further revealed, with a set of three arrows to illustrate their relative sizes, are the primary compartment openings 211 and 211, and the primary compartment 212, of the principal outer component 210A. The purpose of this figure is to depict and/or describe manners in which the components of the Compartmented Cushioning Device 10B and 10C can be fitted and locked releasably, attached releasably, or attached permanently, one to or by the other, in alternate configurations. In this first alternate configuration, the principal outer component 210A is designed so that the perimeters of the primary compartment openings 211 and 211 are substantially equal to the parallel perimeters of the primary compartment 212. Described in a different way; the principal outer component 210A is sized and shaped so that the perimeters of the primary compartment 212, at or closer to the primary compartment openings 211 and 211, are substantially equal to the parallel perimeters of the primary compartment 212, further from the primary compartment openings 211 and 211. In turn, the inner component 210B is sized and shaped to conform to the size and shape of the primary compartment 212, thereby allowing it to fit into place once inside. With the inner component 210B folded, it can easily be inserted through either primary compartment opening 211 or 211, to be placed within the primary compartment 212, of the principal outer component 210A. Once inside and fully extended, it will fit and lock moderately into place within the primary compartment 212, although it may fall, slip, or be pushed or pulled out. This design feature partially encases and moderately retains the inner component 210B, within the primary compartment 212, while still allowing it to easily be released. Further described in a different way; the principal outer component 210A and the inner component 210B are complementary in size and shape, and the periphery of the inner component 210B, is substantially the same as the periphery of the primary compartment 212. The three arrows in this figure, that are located at the center, floating within the primary compartment 212, and above the inner component 210B, are included to illustrate the substantially equal parallel perimeters of the primary compartment 212, respectively, at or closer to, and further from the primary compartment openings 211 and 211; as well as to illustrate the complementary size and shape of the inner component 210B. Because the parallel perimeters of the primary compartment 212 are substantially equal, at or closer to, and further from the primary compartment openings 211 and 211; the inner component 210B may fall, slip, or be pushed or pulled out. Therefore, in this second alternate configuration, the inner component 210B, for further security, can be attached releasably, such as with hooks and loops or zippers, to the principal outer component 210A. Or, in additional alternate configurations, the inner component 210B can be attached permanently, such as with seams, or with an appropriate adhesive as well. Please see cut-away reference arrows 38 and 38, in FIG. 22 and FIG. 26, to see the location and direction of the top/front to bottom/back cut-away view as depicted in this figure.

FIG. 42 depicts a top/front to bottom/back cut-away view of the sixteenth embodiment of the Compartmented Cushioning Device 10P, showing the principal outer component 220A, with its entire upper cushioning layer cut away, to reveal the inner component 220B located within. Further revealed, with a set of three arrows to illustrate their relative sizes, are the primary compartment openings 221 and 221, and the primary compartment 222, of the principal outer component 220A. The purpose of this figure is to depict and/or describe manners in which the components of the Compartmented Cushioning Device 10B and 10C can be fitted and locked releasably, attached releasably, or attached permanently, one to or by the other, in alternate configurations. In this first alternate configuration, the principal outer component 220A is designed so that the perimeters of the primary compartment 222, at or closer to the primary compartment openings 221 and 221, are smaller than all or part of the parallel perimeters of the primary compartment 222, central to the primary compartment openings 221 and 221. Described in a different way; the principal outer component 220A is sized and shaped so that all or part of the perimeters of the primary compartment 222, at or closer to the primary compartment openings 221 and 221, are smaller than all or part of the parallel perimeters of the primary compartment 222, further from the primary compartment openings 221 and 221. In turn, the inner component 220B is sized and shaped to conform to the size and shape of the primary compartment 222, thereby allowing it to fit and lock releasably and securely into place once inside. With the inner component 220B folded, it can easily be inserted through either primary compartment opening 221 or 221, to be placed within the primary compartment 222, of the principal outer component 220A. Once inside and fully extended, it will fit and lock releasably and securely into place within the primary compartment 222, and will not fall out. The smaller and larger parallel perimeters of the primary compartment 222, respectively, at or closer to, and further from the primary compartment openings 221 and 221, work together, to lock in the first inner component 220B, within the primary compartment 222, of the principal outer component 220A. This design feature partially encases and securely retains the inner component 220B, within the primary compartment 222, while still allowing it to easily be released. Further described in a different way; the principal outer component 220A and the inner component 220B are complementary in size and shape, and the periphery of the inner component 220B, is substantially the same as the periphery of the primary compartment 222; wherein the inner component 220B is locked releasably by the principal outer component 220A within the primary compartment 222. The three arrows in this figure, that are located at the center, floating within the primary compartment 222, and above the inner component 220B, are included to illustrate the smaller and larger parallel perimeters of the primary compartment 222, respectively, at or closer to, and further from the primary compartment openings 221 and 221; and as well as to illustrate the complementary size and shape of the inner component 220B. In this second alternate configuration, the inner component 220B, for further security, can be attached releasably, such as with hooks and loops or zippers, to the principal outer component 220A. Or, in additional alternate configurations, the inner component 220B can be attached permanently, such as with seams, or with an appropriate adhesive as well. Please see cut-away reference arrows 38 and 38, in FIG. 22 and FIG. 26, to see the location and direction of the top/front to bottom/back cut-away view as depicted in this figure.

Description of Manufacturing Processes

The following is a description of manufacturing processes for the Compartmented Cushioning Device principal outer components 11A, 50A, 80A, and 120A; first inner component 11B, and single inner component 50B; as well as inner components 100B, 110B, 120B, and 130B, for those including filler material encased in surface material, two compartment openings, and one compartment.

1. Design the component using CAD software or other method.
2. Obtain encased filler unit(s), loose filler, encased component filler unit, or molded component foam unit, then go to step 5.
3. Or, using pattern, cut one or two foam panels, join with appropriate adhesive to create a component foam unit, then allow adhesive to dry.
4. Round all edges of component foam unit, where the component will have compartment openings.
5. Using patterns, cut outer and inner, upper and lower surface panels, and create/attach opening/closing means if/where desired.
6. Attach outer-upper to inner-upper surface panel at right side edge, to create the upper surface unit.
7. Attach outer-lower to inner-lower surface panel at left side edge, to create the lower surface unit.
8. Turn lower surface unit inside out, and place it in between upper surface unit.
9. If using encased component foam unit or component filler unit, go to step 11.
10. If using encased filler unit(s) or loose filler, go to step 12.
11. Fold component foam or filler unit half way into itself; then through its center, insert it in between center and top of surface units from previous step.
12. Attach outer-upper to inner-upper surface panel at remaining side edge.
13. Attach outer-lower to inner-lower surface panel at remaining side edge, then straighten all surface panels.
14. Attach outer-upper to outer-lower surface panel at top and bottom side edges, starting and ending with a partial attachment of the inner-upper to inner-lower surface panels.
15. Attach inner-upper to inner-lower surface panel at bottom side edges, then straighten all surface panels.
16. Attach inner-upper to inner-lower surface panel at top left and right tapered rounded corner edges only.
17. Straighten all surface panels, and if component foam or filler unit is being used, unfold it, and straighten it as well.
18. Insert one or two hands in between inner surface panels, and flip inner-upper surface panel, up and over and onto the other side.
19. If using encased component foam unit or component filler unit, go to step 21.
20. If using encased filler unit(s) or loose filler, go to step 24.
21. Straighten all surface panels, then push top of component foam or filler unit down into itself, in preparation for the next step.
22. Attach inner-upper to inner-lower surface panel at top edge.
23. Straighten all surface panels, and component foam or filler units, steam or iron inner surface panels, then go to step 27.
24. Attach inner-upper to inner-lower surface panel at top edge, leaving an opening at center, large enough to install encased filler unit(s) or loose filler.
25. Install encased filler unit(s) or loose filler into interior, and complete attachment of inner-upper to inner-lower surface panel at top edge.
26. Straighten all surface panels, and encased filler unit(s) or loose filler, then steam or iron inner surface panels.
27. Turn the component inside out, then straighten all surface panels and filler/foam, working all parts into place.
28. Steam or iron outer surface panels to complete the creation of the component.

The following is a description of manufacturing processes for the Compartmented Cushioning Device first inner component 11B, and second inner component 11C, respectively along with principal outer component 80A, and single inner component 80B, for those components or embodiments in which they are attached; as well as inner components 100B, 110B, 120B, and 130B, for those including filler material encased in surface material, two compartment openings, and two compartments.

1. Design the component using CAD software or other method.
2. Obtain encased filler unit(s), loose filler, encased outer component filler unit, or one molded outer component and one molded inner component foam units, then go to step 6.
3. Or, using pattern, cut one or two foam panels, join with appropriate adhesive to create an outer component foam unit, then allow adhesive to dry.
4. Round all edges of outer component foam unit, where the outer component will have compartment openings.
5. Using pattern, cut one inner component foam panel and round all edges.
6. Using patterns, cut outer and inner, upper and lower surface panels, and create/attach opening/closing means if/where desired.
7. Using pattern, cut two inner component surface panels, and create/attach opening/closing means if/where desired.
8. Attach outer-upper to inner-upper surface panel at right side edge, to create the upper surface unit.
9. Attach outer-lower to inner-lower surface panel at left side edge, to create the lower surface unit.
10. Turn lower surface unit inside out, and place it in between upper surface unit.
11. If using encased outer component foam unit or outer component filler unit, go to step 13.
12. If using encased filler unit(s) or loose filler, go to step 14.

13. Fold outer component foam or filler unit half way into itself; then through its center, insert it in between center and top of surface units from previous step.
14. Attach outer-upper to inner-upper surface panel at remaining side edge.
15. Attach outer-lower to inner-lower surface panel at remaining side edge, then straighten all surface panels.
16. Attach outer-upper to outer-lower surface panel at top and bottom side edges, starting and ending with a partial attachment of the inner-upper to inner-lower surface panels.
17. Attach inner-upper to inner-lower surface panel, at top and bottom, left and right tapered rounded corner edges only.
18. Straighten all surface panels, and if outer component foam or filler unit is being used, unfold it, and straighten it as well.
19. Attach inner component surface panels at left and right side edges, to create an inner component surface unit.
20. Turn inner component surface unit inside out.
21. Attach inner component surface panels at top and bottom, leaving an opening at top center, large enough to install encased filler unit, loose filler, or foam panel.
22. Insert inner component surface unit in between inner-upper and inner-lower surface panels.
23. Attach bottom of inner component surface unit, to bottom of inner-lower surface panel, then to bottom of inner-upper surface panel.
24. Insert one or two hands in between inner-upper surface panel, and inner component surface unit.
25. Flip inner-upper surface panel, up and over and onto the other side, then straighten all surface panels and filler/foam.
26. Surface panels should be as follows: inner-upper on top, then outer-upper, outer-lower, inner-lower, then inner component surface unit on the bottom.
27. Install encased filler unit, loose filler, or foam panel into inner component surface unit, close off area, if using loose filler, then complete attachment of its surface panels.
28. Attach top of inner component surface unit, to top of inner-lower surface panel.
29. If using encased outer component foam unit, or outer component filler unit, go to step 31.
30. If using encased filler unit(s) or loose filler, go to step 34.
31. Straighten all surface panels, then push top of outer component foam or filler unit down into itself, in preparation for the next step.
32. Attach inner-upper surface panel, to attached inner-lower and inner component surface panels at top edge.
33. Straighten all surface panels, and outer component foam or filler units, steam or iron inner surface panels, then go to step 37.
34. Install encased filler unit(s) or loose filler, into areas between outer-upper-inner-upper and outer-lower-inner-lower surface panels.
35. Attach inner-upper surface panel, to attached inner-lower and inner component surface panels at top edge.
36. Straighten all surface panels, and encased filler unit(s) or loose filler, then steam or iron inner surface panels.
37. Turn the component inside out, and straighten all surface panels and filler/foam, working all parts into place.
38. Steam or iron outer surface panels to complete the creation of the component.

The following is a description of manufacturing processes for the Compartmented Cushioning Device second inner component 11C, and single inner component 80B; as well as inner components 100B, 110B, 120B, and 130B, for those including filler material encased in surface material, zero compartment openings, and zero compartments.

1. Design the component using CAD software or other method.
2. Obtain encased filler unit, loose filler, or molded inner component foam panel, then go to step 4.
3. Or, using pattern, cut one inner component foam panel, and round all edges.
4. Using pattern, cut two inner component surface panels, and create/attach opening/closing means if/where desired.
5. Attach inner component surface panels at left and right side edges, to create an inner component surface unit.
6. Attach inner component surface panels at top and bottom side edges, leaving an opening at top center, large enough to install encased filler, loose filler, or foam panel.
7. Turn inner component surface unit inside out, then straighten all surface panels.
8. Install encased filler unit, loose filler, or foam panel into inner component surface unit, then close off area, if using loose filler, until completing the next step.
9. Complete attachment of top of inner component surface panels, then straighten all surface panels and filler/foam, working all parts into place.
10. Steam or iron surface panels to complete the creation of the component.

The following is a description of manufacturing processes for the Compartmented Cushioning Device principal outer components 100A and 110A.

1. Design the component using CAD software or other method.
2. Obtain two encased filler units, loose filler, or two molded component foam panels, then go to step 4.
3. Or, using pattern, cut two foam panels, and round all edges where the component will have compartment openings.
4. Using pattern(s), cut outer-upper and outer-lower surface panels, and create/attach opening/closing means if/where desired.
5. Using pattern(s), cut inner-upper and inner-lower surface panels, and create/attach opening/closing means if/where desired.
6. Attach outer-upper to inner-upper surface panel at edges, at all areas where the component will have compartment openings, to create the upper surface unit.
7. Attach outer-lower to inner-lower surface panel at edges, at all areas where the component will have compartment openings, to create the lower surface unit.
8. Turn lower surface unit inside out, feed it into the interior of the upper surface unit, then line up all unattached edges.
9. Attach outer-upper to outer-lower surface panel, at all unattached edges, starting and ending with a partial attachment of the inner-upper to inner-lower surface panels.
10. If using encased filler units or loose filler, go to step 12.
11. If using foam panels, go to step 13.
12. Complete attachment of inner-upper to inner-lower surface panel at all, except one unattached edges, to create the upper-lower surface unit.
13. Straighten all surface panels of the above created upper-lower surface unit, in preparation for the next step.
14. Turn upper-lower surface unit inside out, so that exterior face of surface panels and opening(s) are out and accessible.
15. Now turn the upper-lower surface unit inside out, so that the interior compartment area of the component is facing towards the outside.
16. If using foam panels, go to step 18.
17. If using encased filler units or loose filler, go to step 20.
18. Fill both interior areas of upper-lower surface unit with one foam panel each, then spread foam out, working all parts into place.

19. Pull corners of foam panels through openings, join with appropriate adhesive to create a component foam unit, allow adhesive to dry, reinsert corners, then go to step 22.
20. Fill both interior areas of upper-lower surface unit with encased filler units or loose filler, close off area, if using loose filler, then spread filler out, working all parts into place.
21. If using loose filler, be sure to keep the unattached edge closed off, until completing the next step.
22. Straighten all surface panels, then complete attachment of inner-upper to inner-lower surface panels, at all unattached edges.
23. Straighten all surface panels and filler/foam, then steam or iron inner surface panels.
24. Turn the component inside out, and straighten all surface panels and filler/foam, working all parts into place.
25. Steam or iron outer surface panels to complete the creation of the component.

The following is a description of an initial manufacturing process of an air circulation opening, where applicable, for the Compartmented Cushioning Device embodiments 10A through 10P.

1. Design the embodiment or component using CAD software or other method.
2. Using pattern, cut matching air circulation openings, into outer and inner surface panels.
3. Attach outer and inner surface panels around air circulation openings, to create an outer-inner surface unit with air circulation opening.
4. Feed and pull inner surface panel through air circulation opening, until it is completely on the opposite side of outer surface panel.
5. The outer-inner surface unit, with air circulation opening, will now be ready to be incorporated into the completion of an embodiment or a component, as required.

The following is a description of manufacturing processes for the Compartmented Cushioning Device principal outer component 130A.

1. Design the component using CAD software or other method.
2. Obtain encased filler unit(s), loose filler, encased outer component filler unit with air circulation opening, or molded outer component foam unit with air circulation opening, then go to step 5.
3. Or, using pattern, cut one or two foam panels, join with appropriate adhesive to create an outer component foam unit, then allow adhesive to dry.
4. Using pattern, cut air circulation opening into upper foam panel, then round all edges where the outer component will have compartment and air circulation openings.
5. Using patterns, cut outer and inner, upper and lower surface panels, and create/attach opening/closing means if/where desired.
6. Using pattern, cut matching air circulation openings into outer-upper and inner-upper surface panels.
7. Attach outer-upper to inner-upper surface panels around air circulation openings, to create an outer-inner surface unit with air circulation opening.
8. Feed and pull inner-upper surface panel through air circulation opening, until it is completely on the opposite side of outer-upper surface panel.
9. Attach outer-lower to inner-lower surface panel, at bottom side edges, where the component will have compartment opening.
10. Attach outer-upper to outer-lower surface panel at remaining top, left, and right side edges, including tapered rounded corners, to create the outer-inner surface unit.
11. Turn outer-inner surface unit inside out, and straighten all surface panels.
12. If using encased component filler unit with air circulation opening, or component foam unit with air circulation opening, go to step 14.
13. If using encased filler unit(s) or loose filler, go to step 25.
14. Insert inner-upper surface panel through top of air circulation opening, in outer component encased filler or foam unit.
15. Fit outer surface panels, of outer-inner surface unit, over exterior of outer component encased filler or foam unit.
16. Flip and place inner-lower surface panel, into the interior of outer component encased filler or foam unit.
17. Flip bottom side of outer-upper, up and over, and inner-upper, down and under surface and filler/foam units, and hold until completing the next step.
18. Attach outer-upper to inner-upper at bottom side edges, including tapered rounded corners, then turn surface and filler/foam units inside out.
19. Insert one or two hands in between inner surface panels, and turn surface and filler/foam units inside out again.
20. Flip left side of inner-upper, up and over, and inner-lower, down and under surface and filler/foam units, and hold until completing the next step.
21. Attach inner-upper to inner-lower at left side edges, starting and ending over attached outer surface panels, then turn surface and filler/foam units inside out.
22. Flip right side of inner-upper, up and over, and inner-lower, down and under surface and filler/foam units, and hold until completing the next step.
23. Attach inner-upper to inner-lower at right side edges, starting and ending over attached outer surface panels, then turn surface and filler/foam units inside out.
24. Straighten all surface panels and filler/foam, working all parts into place, then go to step 36.
25. Surface panels should be as follows: outer-upper on top, then inner-upper, and then outer-lower on the bottom, with inner-lower attached, and to the side.
26. Flip and place inner-lower surface panel, of outer-inner surface unit, in between inner-upper and outer-lower surface panels.
27. Flip bottom side of outer-upper, up and over, and inner-upper, down and under surface units, and hold until completing the next step.
28. Attach outer-upper to inner-upper at bottom side edges, including tapered rounded corners, then turn outer-inner surface unit inside out.
29. Insert one or two hands in between inner surface panels, and turn outer-inner surface unit inside out again.
30. Flip left side of inner-upper, up and over, and inner-lower, down and under outer-inner surface unit, and hold until completing the next step.
31. Attach inner-upper to inner-lower at left side edges, starting and ending over attached outer surface panels, then turn outer-inner surface unit inside out.
32. Flip right side of inner-upper, up and over, and inner-lower, down and under outer-inner surface unit, and hold until completing the next step.
33. Attach inner-upper to inner-lower at right side edges, starting and ending over attached outer surface panels, then turn outer-inner surface unit inside out.
34. Straighten all surface panels, working all parts into place.
35. Insert encased filler unit(s) or loose filler, then close off area, if using loose filler, until completing the next step.
36. Attach inner-upper to inner-lower surface panel at top-side edges, then steam or iron inner surface panels.

37. Turn the component inside out, and straighten all surface panels and filler/foam, working all parts into place.
38. Steam or iron outer surface panels to complete the creation of the component.

The following is a description of manufacturing processes for the Compartmented Cushioning Device embodiment 10H.

1. Design the embodiment using CAD software or other method.
2. Obtain encased filler unit(s), loose filler, or molded outer and molded inner foam panels, then go to step 5.
3. Or, using patterns, cut outer and inner foam panels, and round all edges where the embodiment will have compartment openings.
4. Join center tapered rounded corners of outer foam panel with appropriate adhesive, then allow adhesive to dry.
5. Using pattern, cut outer-upper and outer-lower surface panels, and attach opening/closing means if/where desired.
6. Using pattern, cut inner-upper and inner-lower surface panels, attach center tapered rounded corners, and opening/closing means if/where desired.
7. Align then attach left and right side edges of outer-upper and inner-upper surface panels, where the embodiment will have compartment openings, and will form the upper layer.
8. Align then attach left and right side edges of outer-lower and inner-lower surface panels, where the embodiment will have compartment openings, and will form the lower layer.
9. Align then attach left and right side edges of inner-upper and inner-lower surface panels, where the embodiment will have compartment openings, and will form the inner layer.
10. Attach outer-upper to outer-lower surface panel at top and bottom side edges, starting and ending with a partial attachment of inner-upper to inner-lower surface panels.
11. Attach top to bottom side edges of inner-upper surface panel, starting and ending over a portion of attached outer surface panels.
12. Attach a small portion of top to bottom side edges of inner-lower surface panel at both sides, starting and ending over a portion of attached outer surface panels.
13. Turn outer-inner surface unit inside out, and position it to have access to the exterior surface, and unattached area, of the inner-lower surface panel.
14. If using foam panels, go to step 16.
15. If using encased filler unit(s) or loose filler, go to step 20.
16. Join bottom of inner component foam panel, to bottom of interior center of outer foam panel with appropriate adhesive, to create a foam unit, then allow adhesive to dry.
17. Insert foam unit through inner-lower surface panel opening, then straighten it out, working all parts into place.
18. Join top to bottom side edges of outer foam panel with appropriate adhesive, including tapered rounded corners, then allow adhesive to dry.
19. Join top of inner component foam panel, to top of interior center of outer foam panel with appropriate adhesive, allow adhesive to dry, then go to step 21.
20. Insert encased filler unit(s) or loose filler through inner-lower surface panel opening, then close off area, if using loose filler.
21. Straighten all surface panels and filler/foam, working all parts into place, being sure to close off area, if using loose filler, until completing the next step.
22. Complete attachment of top to bottom side edges of inner-lower surface panel, including tapered rounded corners.
23. Steam or iron inner surface panels, then turn the embodiment inside out, and straighten all surface panels and filler/foam, working all parts into place.
24. Steam or iron outer surface panels to complete the creation of the embodiment.

The following is a description of manufacturing processes for the Compartmented Cushioning Device embodiment 10I.

1. Design the embodiment using CAD software or other method.
2. Obtain encased filler unit(s), loose filler, or molded component foam panel, then go to step 5 or step 6.
3. Or, using pattern, cut foam panel, and join center tapered rounded corners with appropriate adhesive, then allow adhesive to dry.
4. Round all edges of foam panel, where the embodiment will have compartment openings.
5. To create the embodiment using one surface panel for both outer and inner surfaces, go to step 7.
6. To create the embodiment using two surface panels for both outer and inner surfaces, go to step 10.
7. Using pattern, cut outer-inner surface panel, then attach center tapered rounded corners, and opening/closing means if/where desired.
8. With the outer portion on the left, fold outer-inner surface panel in half, from left to right, then center and align left and right side edges.
9. Attach outer to inner portion of outer-inner surface panel at right side edges, where the embodiment will have compartment openings, starting over center tapered rounded corner, then go to step 13.
10. Using pattern, cut outer and inner surface panels, then attach center tapered rounded corners, and opening/closing means if/where desired.
11. Place outer surface panel over inner surface panel, then center and align left and right side edges.
12. Attach outer to inner surface panel, at left and right side edges, where the embodiment will have compartment openings, starting over center tapered rounded corners.
13. Straighten all surface panels of the above created outer-inner surface unit, then fold it in half from top to bottom, and align top to bottom side edges of its outer portion.
14. Attach top to bottom side edges of outer portion of outer-inner surface unit, starting and ending with a partial attachment of the inner-upper to inner-lower surface panel.
15. Insert one or two hands in between upper inner portion, and adjacent outer portion, of outer-inner surface unit, then flip inner portion, up and over and onto the other side.
16. Align and attach top to bottom side edges of inner portion of outer-inner surface unit, leaving an opening at center, large enough to install encased filler unit(s), loose filler, or foam panel.
17. Insert one or two hands in between upper and lower portions of inner portion of outer-inner surface unit, then flip upper inner portion, up and over and onto the other side.
18. Straighten all surface panels, in preparation for the next step.
19. If using foam panel, go to step 21.
20. If using encased filler unit(s) or loose filler, go to step 23.
21. Insert foam panel, working all parts into place, then pull top and bottom sides out, join with appropriate adhesive, including tapered rounded corners, then allow adhesive to dry.
22. Reinsert end of foam unit, straighten all surface panels and foam unit, working all parts into place, then go to step 25.

23. Insert encased filler unit(s) or loose filler, then close off area, if using loose filler, until completing the next step.
24. Straighten all surface panels, and distribute encased filler unit(s) or loose filler evenly, being sure to close off area, if using loose filler, until completing the next step.
25. Complete attachment of remaining top to bottom side edges of inner portion of outer-inner surface unit.
26. Straighten all surface panels and filler/foam, then steam or iron inner surface panels.
27. Turn the embodiment inside out, and straighten all surface panels and filler/foam, working all parts into place.
28. Steam or iron outer surface panels to complete the creation of the embodiment.

The following is a description of manufacturing processes for the Compartmented Cushioning Device embodiment 10J.

1. Design the embodiment using CAD software or other method.
2. Obtain encased filler unit(s), loose filler, or two outer and one inner molded component foam panels, then go to step 4.
3. Or, using patterns, cut two outer and one inner component foam panels, and round all edges where the embodiment will have compartment openings.
4. Using pattern, cut outer and inner, upper and lower component surface panels, and create/attach opening/closing means if/where desired.
5. Using pattern, cut upper and lower inner component surface panels, and create/attach opening/closing means if/where desired.
6. Attach outer-upper to inner-upper surface panel at edges, at all areas where the embodiment will have compartment openings, to create the upper component surface unit.
7. Attach outer-lower to inner-lower surface panel at edges, at all areas where the embodiment will have compartment openings, to create the lower component surface unit.
8. Turn the lower component surface unit inside out, and position it, so that it's in the same direction as the upper component surface unit.
9. Feed the lower component surface unit, into the interior of the upper component surface unit, and line up all unattached edges.
10. Attach outer-upper to outer-lower surface panel, at all unattached edges, starting and ending with a partial attachment of the inner-upper to inner-lower surface panels.
11. Straighten all surface panels of the above created upper-lower component surface unit, in preparation for the next step.
12. Position surface panels of upper-lower component surface unit as follows: inner-upper on top, then inner-lower, outer-lower, then outer-upper on the bottom.
13. Attach inner component surface panels at edges, at all areas where the embodiment will have compartment openings, to create the inner component surface unit.
14. Turn inner component surface unit inside out, then straighten all surface panels.
15. Attach inner component surface panels at top and bottom, leaving an opening at top center, large enough to install encased filler unit, loose filler, or foam panel.
16. Straighten all surface panels, then insert inner component surface unit, in between inner-upper and inner-lower surface panels, of the upper-lower component surface unit.
17. Attach bottom of inner component surface unit, to bottom of inner-lower surface panel, then to bottom of inner-upper surface panel.
18. Straighten all surface panels of the above created upper-inner-lower component surface unit, in preparation for the next step.
19. Insert one or two hands in between inner-upper surface panel, and inner component surface unit.
20. Flip inner-upper surface panel, up and over and onto the other side, then flip the upper-inner-lower component surface unit over, and straighten all surface panels.
21. Surface panels should be as follows: inner-upper on top, then outer-upper, outer-lower, inner-lower, then inner component surface unit on the bottom.
22. Install encased filler unit, loose filler, or foam panel into inner component surface unit, close off area, if using loose filler, then complete attachment of its surface panels.
23. Flip upper-inner-lower component surface unit over, and straighten all surface panels and filler/foam, in preparation for the next step.
24. Attach top of inner component surface unit, to top of inner-lower surface panel.
25. Straighten and evenly distribute all surface panels and filler/foam, in preparation for the next step.
26. If using foam panels, go to step 28.
27. If using encased filler unit(s) or loose filler, go to step 31.
28. If foam is to be a one-piece unit, join bottom edges of foam panel with appropriate adhesive, then allow adhesive to dry.
29. Feed foam panel, into areas between outer-upper and inner-upper, and outer-lower and inner-lower surface panels.
30. Join top edges of foam panel with appropriate adhesive, to create an outer component foam unit, allow adhesive to dry, then go to step 32.
31. Install encased filler unit(s) or loose filler, into areas between outer-upper and inner-upper, and outer-lower and inner-lower surface panels.
32. Push encased filler unit(s), loose filler, or outer component foam unit away from opening, then close off area, if using loose filler, until completing the next step.
33. Attach top of inner-upper surface panel, to top of attached inner component surface unit and inner-lower surface panel.
34. Straighten all surface panels and filler/foam, working all parts into place.
35. Steam or iron inner surface panels, then insert one or two hands in between upper and lower layers.
36. Flip upper layer, up and over inner layer and onto the other side, so that upper layer is on top, then inner layer, then the lower layer on the bottom.
37. Straighten all surface panels and filler/foam, working all parts into place.
38. Steam or iron outer surface panels to complete the creation of the embodiment.

The following is a description of manufacturing processes for the Compartmented Cushioning Device embodiment 10K.

1. Design the embodiment using CAD software or other method.
2. Obtain encased filler units, loose filler, or three molded component foam panels, then go to step 4.
3. Or, using pattern, cut three foam panels, and round all edges.
4. Using pattern, cut outer and inner, upper and lower component surface panels, and create/attach opening/closing means if/where desired.
5. Using pattern, cut inner component upper and lower surface panels, and create/attach opening/closing means if/where desired.

6. Attach inner-upper to upper-inner surface panel, along right angle interior edge, where the embodiment will not have compartment openings, to create the upper component surface unit.
7. Attach inner-lower to lower-inner surface panel, along right angle interior edge, where the embodiment will not have compartment openings, to create the lower component surface unit.
8. Turn upper component surface unit upside down, and position it on top of lower component surface unit, lining up all edges.
9. Surface panels should be as follows: upper-inner on top, then inner-upper, inner-lower, then the lower-inner surface panel on the bottom.
10. Attach upper-inner surface panel, to lower-inner surface panel, at all unattached edges, to create the inner component surface unit.
11. Turn inner component surface unit inside out, and position it from top to bottom: inner-upper on top, then upper-inner, lower-inner, then the inner-lower on the bottom.
12. Place the inner component surface unit, on top of the outer-upper surface panel, lining up all edges.
13. Surface panels should be as follows: inner-upper on top, then upper-inner, lower-inner, inner-lower, then outer-upper surface panel on the bottom.
14. Straighten all surface panels, then attach inner-upper surface panel, to outer-upper surface panel, at all unattached edges, to create the upper-inner component surface unit.
15. Insert one or two hands in between inner-lower surface panel, and attached outer-upper surface panel.
16. Flip outer-upper surface panel, up and over and onto the other side, then straighten all surface panels.
17. Turn upper-inner component surface unit upside down, then place it on top of outer-lower surface panel, lining up all edges.
18. Surface panels should be as follows: inner-lower on top, then lower-inner, upper-inner, inner-upper, outer-upper, then the outer-lower surface panel on the bottom.
19. Straighten surface panels, then attach inner-lower surface panel, to outer-lower surface panel, at all unattached edges, to create the upper-inner-lower component surface unit.
20. Insert one or two hands in between outer-upper surface panel, and attached outer-lower surface panel.
21. Flip outer-lower surface panel, up and over and onto the other side, then straighten all surface panels.
22. Install encased filler units, loose filler, or foam panels, into the upper, inner, and lower components of the upper-inner-lower component surface unit.
23. Straighten all surface panels and filler/foam, then attach/complete openings or close/complete/process opening/closing means.
24. Steam or iron outer and inner surface panels to complete the creation of the embodiment.

The Compartmented Cushioning Device 10A through 10P shown in the drawings and described in detail herein disclose arrangements of elements of particular configuration and construction for illustrating selected embodiments of structure and method of operation of the present application. It is to be understood, however, that elements of different configuration and construction and other arrangements thereof, other than those illustrated and described may be employed for providing a Compartmented Cushioning Device 10A through 10P in accordance with the spirit of this disclosure, and such alternations, changes, and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

PARTS LIST

10A—Compartmented Cushioning Device with three components, four compartment openings, and four compartments
10B—Compartmented Cushioning Device with two components, four compartment openings, and three compartments
10C—Compartmented Cushioning Device with two components, two compartment openings, and two compartments
10D—Compartmented Cushioning Device with two or more components, four or more compartment openings, and two or more compartments
10E—Compartmented Cushioning Device with two or more components, two or more compartment openings, two or more compartments, one video game controller opening, and one headset cord opening
10F—Compartmented Cushioning Device with two or more components, two or more compartment openings, two or more compartments, and one air circulation opening
10G—Compartmented Cushioning Device with two or more components, one or more compartment openings, two or more compartments, and one air circulation opening
10H—Compartmented Cushioning Device with one component, four compartment openings, two compartments, and one access or fill valve
10I—Compartmented Cushioning Device with one component, two compartment openings, one compartment, and one zipper
10J—Compartmented Cushioning Device with four compartment openings, and two compartments
10K—Compartmented Cushioning Device with four compartment openings, two compartments, and three zippers
10L—Compartmented Cushioning Device with two components, two or more compartment openings, and two or more compartments
10M—Compartmented Cushioning Device with two or more components, four compartment openings, and two compartments
10N—Compartmented Cushioning Device with three components, four compartment openings, and two compartments
10O—Compartmented Cushioning Device with two components, two or more compartment openings, and two or more compartments
10P—Compartmented Cushioning Device with two components, two or more compartment openings, and two or more compartments
11A—Principal outer component
11B—First inner component
11C—Second inner component
12—Primary compartment opening
13—Primary compartment
13A—Primary upper or front compartment
13B—Primary lower or back compartment
14—Secondary compartment opening

15—Secondary compartment
15A—Secondary upper or front compartment
15B—Secondary lower or back compartment
16—Seam
17—Outer upper surface material
18—Inner upper surface material
19—Outer upper surface material
20—Seam
21—Inner upper surface material
22—Upper surface material
23—Seam
24—Seam
25—Seam
26—Seam
27—Seam
28—Outer lower surface material
29—Inner lower surface material
30—Seam
31—Inner lower surface material
32—Lower surface material
33—Seam
34—Outer lower surface material
35—Filler material
36—Filler material
37—Filler material
38—Comfort-lock-in taper
39—Fit-in-lock-in taper
40—Fit-in taper
50A—Principal outer component
50B—Single inner component
51—Comfort-lock-in taper
52—Primary compartment opening
53—Primary compartment
53A—Primary upper or front compartment
53B—Primary lower or back compartment
54—Secondary compartment opening
55—Secondary compartment
56—Fit-in-comfort taper
57—Outer upper surface material
58—Seam
59—Inner upper surface material
60—Outer upper surface material
61—Seam
62—Seam
63—Seam
64—Inner upper surface material
65—Custom made audio, heart beat simulation, heating, or vibration device
66—Outer lower surface material
67—Seam
68—Inner lower surface material
69—Seam
70—Inner lower surface material
71—Outer lower surface material
80A—Principal outer component
80B—Single inner component
81—Comfort-lock-in taper
82—Primary compartment opening
83—Primary compartment
83A—Primary upper or front compartment
83B—Primary lower or back compartment
84—Fit-in taper
85—Outer upper surface material
86—Seam
87—Inner upper surface material
88—Upper surface material
89—Seam
90—Seam
91—Outer lower surface material
92—Seam
93—Inner lower surface material
94—Lower surface material
100A—Principal outer component
100B—Inner component
101—Primary compartment opening
102—Comfort-lock-in taper
103—Primary compartment
110A—Principal outer component
110B—Inner component
111—Video game controller
112—Video game controller opening
113—Headset cord opening
114—Comfort-lock-in taper
115—Primary compartment opening
116—Primary compartment
117—Comfort-lock-in taper
120A—Principal outer component
120B—Inner component
121—Comfort-lock-in taper
122—Primary compartment
123—Primary compartment opening
124—Comfort-lock-in taper
125—Air circulation opening
130A—Principal outer component
130B—Inner component
131—Primary compartment opening
132—Primary compartment
133—Comfort-lock-in taper
134—Air circulation opening
140—Comfort-shape retention taper
141—Upper compartment opening
142—Lower compartment opening
143—Outer upper surface material
144—Access or fill valve
145—Outer lower surface material
146—Lower compartment
147—Upper compartment
150—Comfort-shape retention taper
151—Compartment opening
152—Compartment
153—Outer upper surface material
154—Outer lower surface material
155—Zipper
160—Seam
161—Upper component
162—Inner component
163—Lower component
164—Upper compartment opening
165—Lower compartment opening
166—Lower compartment
167—Upper compartment
168—Comfort corner
170—Seam
171—Upper component
172—Inner component
173—Lower component
174—Upper compartment opening
175—Lower compartment opening
176—Lower compartment
177—Upper compartment
178—Zipper
179—Comfort corner
180A—Principal outer component
180B—Inner component

181—Primary compartment opening
182—Primary compartment
190A—Principal outer component
190B—Inner component
191—Primary compartment opening
192—Primary compartment
200A—Lower component
200B—Inner component
201—Upper compartment opening
202—Upper compartment
210A—Principal outer component
210B—Inner component
211—Primary compartment opening
212—Primary compartment
220A—Principal outer component
220B—Inner component
221—Primary compartment opening
222—Primary compartment

I claim:

1. A cushioning device, comprising:
(a) an outer component having surface material, and including filler material encased in the surface material;
(b) the outer component having a primary compartment;
(c) the outer component having one or more primary compartment openings;
(d) one or more inner components having inner component surface material, and including inner component filler material encased in the inner component surface material;
(e) the one or more inner components being disposed within the primary compartment;
(f) the one or more inner components defining two or more compartments for receiving upper extremities; whereby a user has multiple options when placing all or part of one or more of their fingers, hands, wrists, or arms within one or more of the two or more compartments;
(g) wherein the outer component and the one or more inner components are complementary in size and shape, and the periphery of the one or more inner components, is substantially the same as the periphery of the primary compartment; and
(h) wherein one or more of the one or more inner components attached releasably to the outer component within the primary compartment.

2. A cushioning device, comprising:
(a) an outer component having surface material, and including filler material encased in the surface material;
(b) the outer component having a primary compartment;
(c) the outer component having one or more primary compartment openings;
(d) one or more inner components having inner component surface material, and including inner component filler material encased in the inner component surface material;
(e) the one or more inner components being disposed within the primary compartment;
(f) the one or more inner components defining two or more compartments for receiving upper extremities; whereby a user has multiple options when placing all or part of one or more of their fingers, hands, wrists, or arms within one or more of the two or more compartments;
(g) wherein the outer component and the one or more inner components are complementary in size and shape, and the periphery of the one or more inner components, is substantially the same as the periphery of the primary compartment; and
(h) wherein one or more of the one or more inner components attached permanently to the outer component within the primary compartment.

3. A cushioning device, comprising:
(a) an outer component having surface material, and including filler material encased in the surface material;
(b) the outer component having a primary compartment;
(c) the outer component having one or more primary compartment openings;
(d) two or more inner components having inner component surface material, and including inner component filler material encased in the inner component surface material;
(e) the two or more inner components being disposed within the primary compartment;
(f) the two or more inner components defining two or more compartments for receiving upper extremities; whereby a user has multiple options when placing all or part of one or more of their fingers, hands, wrists, or arms within one or more of the two or more compartments;
(g) wherein the two or more inner components being disposed within the primary compartment;
(h) wherein the two or more inner components located side by side; and
(i) wherein the two or more inner components defining three or more compartments for receiving upper extremities;
whereby a user has multiple options when placing all or part of one or more of their fingers, hands, wrists, or arms within one or more of the three or more compartments.

4. A cushioning device, comprising:
(a) an outer component having surface material, and including filler material encased in the surface material;
(b) the outer component having a primary compartment;
(c) the outer component having one or more primary compartment openings;
(d) an inner component having inner component surface material, and including inner component filler material encased in the inner component surface material;
(e) the inner component being disposed within the primary compartment;
(f) the inner component defining two or more compartments for receiving upper extremities; whereby a user has multiple options when placing all or part of one or more of their fingers, hands, wrists, or arms within one or more of the two or more compartments;
(g) wherein the inner component having a secondary compartment;
(h) wherein the inner component having one or more secondary compartment openings;
(i) wherein the inner component being disposed within the primary compartment; and,
(j) wherein the inner component defining three compartments for receiving upper extremities;
whereby a user has multiple options when placing all or part of one or more of their fingers, hands, wrists, or arms within one or more of the three compartments.

5. The cushioning device, according to claim 4:
(k) further comprising one or more additional inner components having additional inner component surface material, and including additional inner component filler material encased in the additional inner component surface material;
(l) wherein the one or more additional inner components being disposed within the secondary compartment; and (m) wherein the one or more additional inner components defining four or more compartments for receiving upper extremities;

whereby a user has multiple options when placing all or part of one or more of their fingers, hands, wrists, or arms within one or more of the four or more compartments.

6. The cushioning device, according to claim 5:

(n) wherein the inner component and the one or more additional inner components are complementary in size and shape, and the periphery of the one or more additional inner components, is substantially the same as the periphery of the secondary compartment; and (o) wherein one or more of the one or more additional inner components locked releasably by the inner component within the secondary compartment.

7. The cushioning device, according to claim 6:

wherein the inner component is sized and shaped so that all or part of the perimeters of the secondary compartment, at or closer to the one or more secondary compartment openings, are smaller than all or part of the parallel perimeters of the secondary compartment, further from the one or ore secondary compartment openings.

8. A cushioning device, comprising:

(a) three or more components each having surface material, and including filler material encased in the surface material;

(b) the three or more components attached to each other by one or more attachment points, to hold them in place relative to each other;

(c) the three of more components defining one or more compartments for receiving upper extremities;

(d) the three or more components defining one or more compartment openings;

whereby a user has multiple options when placing all or part of one or more of their fingers, hands, wrists, or arms within the one or more compartments;

(e) wherein the three or more components defining two or more compartments for receiving upper extremities;

(f) wherein the three or more components defining two or more compartment openings; and (g) wherein each of the two or more compartments having different comfort, insulative, or thermal characteristics than one or more of the two or more compartments.

* * * * *